US008230536B2

(12) United States Patent
Clapper et al.

(10) Patent No.: US 8,230,536 B2
(45) Date of Patent: Jul. 31, 2012

(54) FABRIC FASTENED CHANGING TABLE

(75) Inventors: Joshua E. Clapper, West Chester, PA (US); Jeffrey David Swan, West Chester, PA (US); Neil C. Penza, Boyertown, PA (US); Todd D. Sorzano, Alpharetta, GA (US); Matthew J. Ransil, Richland, PA (US); Thomas J. Pollack, West Chester, PA (US); Jonathan M. Pacella, Coatesville, PA (US); Robert T. Pike, Reading, PA (US); Michael A. Dotsey, Pottstown, PA (US)

(73) Assignee: Graco Children's Products Inc., Atlanta, GA (US)

( * ) Notice: Subject to any disclaimer, the term of this patent is extended or adjusted under 35 U.S.C. 154(b) by 0 days.

(21) Appl. No.: 13/053,153

(22) Filed: Mar. 21, 2011

(65) Prior Publication Data

US 2011/0197356 A1 Aug. 18, 2011

Related U.S. Application Data

(63) Continuation of application No. 11/244,403, filed on Oct. 6, 2005, now Pat. No. 7,908,686.

(60) Provisional application No. 60/615,958, filed on Oct. 6, 2004.

(51) Int. Cl.

| | |
|---|---|
| ***A47D 7/00*** | (2006.01) |
| ***A47D 13/06*** | (2006.01) |
| *A47C 7/00* | (2006.01) |
| *A47C 16/00* | (2006.01) |
| *B68G 5/00* | (2006.01) |

(52) U.S. Cl. ..... 5/93.2; 5/98.1; 5/93.1; 5/655

(58) Field of Classification Search ..... 5/93.1, 5/93.2, 98.1, 655, 99.1, 97, 95

See application file for complete search history.

(56) References Cited

U.S. PATENT DOCUMENTS

| | | | | |
|---|---|---|---|---|
| 2,128,978 | A * | 9/1938 | Akin | 5/93.1 |
| 3,864,048 | A | 2/1975 | Parker | |
| 5,542,151 | A | 8/1996 | Stranski et al. | |
| 6,192,535 | B1 | 2/2001 | Warner, Jr. et al. | |
| 6,948,197 | B1 | 9/2005 | Chen | |
| 7,581,269 | B2 | 9/2009 | Chen et al. | |
| 2002/0092094 | A1 * | 7/2002 | Welsh, Jr. | 5/95 |
| 2002/0104161 | A1 | 8/2002 | Kuo | |
| 2002/0152550 | A1 * | 10/2002 | Tharalson et al. | 5/95 |
| 2002/0166169 | A1 | 11/2002 | Longenecker et al. | |
| 2005/0150053 | A1 | 7/2005 | Hartenstine | |
| 2009/0113622 | A1 | 5/2009 | Hartenstine | |
| 2009/0113624 | A1 | 5/2009 | Tuckey | |
| 2010/0162484 | A1 | 7/2010 | Thomas et al. | |

OTHER PUBLICATIONS

Jiangsu Guotai International Group Co. Ltd. (Shenzhen), Baby Playpen, www.alibaba.com, 3 pp. (Sep. 29, 2005).

ASTM Int'l., Standard Consumer Safety Specification for Non-Full-Size Baby Cribs/Play Yards, pp. 1-21, 2005.

ASTM Int'l., Standard Consumer Safety Specification for Bassinets and Cradles, pp. 1-6, 2005.

ASTM Int'l., Standard Consumer Safety Specification for Baby Changing Tables for Domestic Use, pp. 1-7. (2005).

* cited by examiner

*Primary Examiner* — Jonathan Liu

(74) *Attorney, Agent, or Firm* — Lempia Summerfield Katz LLC

(57) ABSTRACT

A changing table for a playard has a flexible platform sized to support a child and a changing table mount arranged to releasably engage the platform to the playard. The changing table mount can have a plurality of straps each having a fastener and removably received in corresponding slots of the playard. The changing table mount can comprise a zipper releasably connecting the changing table to the playard.

12 Claims, 43 Drawing Sheets

Fig. 30A
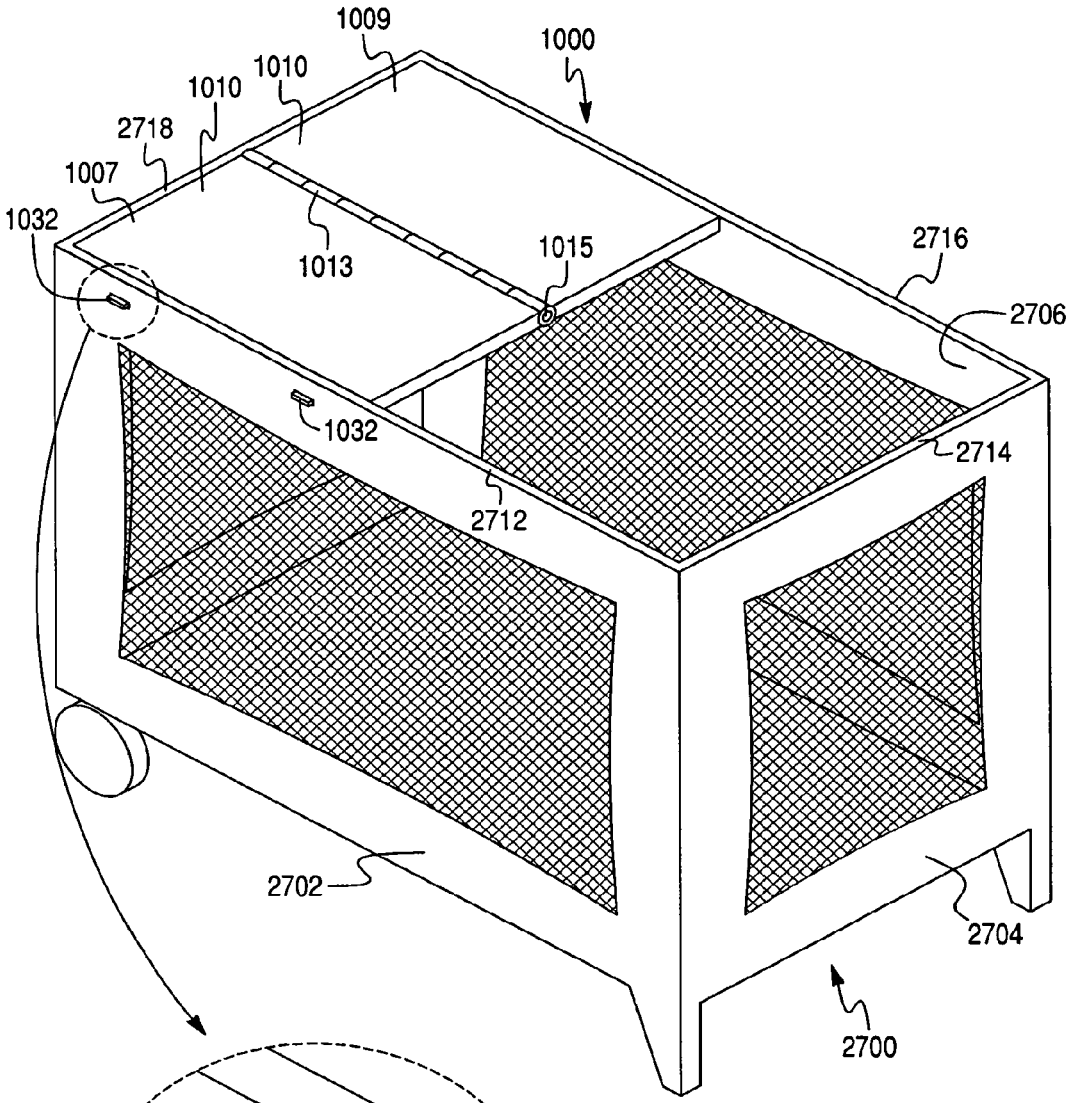
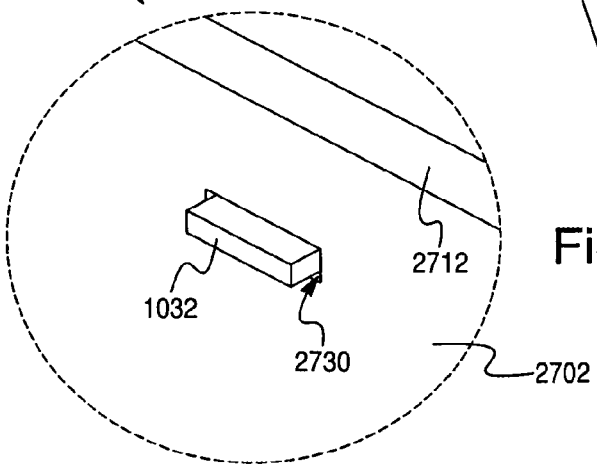
Fig. 30B

FABRIC FASTENED CHANGING TABLE

RELATED APPLICATION DATA

This patent is a continuation of, and claims the priority benefit of, U.S. patent application Ser. No. 11/244,403, filed on Oct. 6, 2005, which claims the priority benefit of U.S. provisional patent application Ser. No. 60/615,958, filed on Oct. 6, 2004. The entire disclosures of these prior applications are hereby incorporated by reference in their entirety.

FIELD OF THE INVENTION

This invention relates to a changing table for a playard. More specifically, this invention relates to a changing table that can be engaged to a playard and that provides a surface upon which a caregiver can change a child's diaper.

BACKGROUND OF THE INVENTION

Playards provide a child containment area in which a child can be placed by a caregiver. Playards often include accessories that can be releasably attached to the playard's top rails and/or corner mounts. Such accessories can include a bassinet, a canopy, a toy bar, and a changing table.

Traditionally, changing tables have been configured to be attached to the playard so that the changing surface is approximately at the level of the top rails of the playard. In such playard/changing table arrangements, the height of the playard's top rails dictates the height of the changing table's changing surface. Typically, the height of a playard's top rails is less than 32" above the surface on which the playard rests. As a result, when an average height adult changes a diaper of a child on the changing table, the adult may be forced to bend into an uncomfortable position during use of the changing table. Thus, there is a need in the art for a changing table that can be attached to the playard so that the changing table's changing surface is disposed above the playard's top rails. There also is a need for a juvenile product that includes a playard and such a changing table.

In addition, a changing table that is releasably engaged to the playard in such a manner to withstand an upward force on the changing table is desired. For example, there is a need in the art for a changing table that will not be inadvertently disengaged from the playard if a child in the playard applies an upward and outward force on it. There also is a need for a juvenile product that includes a playard and such a changing table.

SUMMARY OF THE INVENTION

An aspect of the invention relates to a changing table for use with a playard. The changing table includes, among other possible things: a platform that is sized to support a child; and at least one changing table mount arranged relative to the platform to releasably engage the platform to the playard. The changing table mount includes a release actuator. When the changing table is engaged with the playard, the changing table is configured to remain engaged with the playard when a force of less than or equal to 25 pounds is applied to a location on the changing table other than the release actuator.

Another aspect of the invention relates to a juvenile product that includes, among other possible things: a playard; and a changing table that is configured to releasably engage the playard. The changing table includes at least one changing table mount. When the changing table is engaged with the playard, the changing table is configured to remain engaged with the playard when a force of less than or equal to 25 pounds is applied to a location on the changing table other than a release actuator of the at least one changing table mount.

Another aspect of the invention relates to a changing table for use with a playard. The changing table includes, among other possible things: a platform that is sized to support a child, the platform being movable between an in-use position and a storage position relative to the playard; and a lock mechanism configured to maintain the platform in the in-use position by engaging the playard. The lock mechanism includes a lock actuator. When the changing table is engaged with the playard, the changing table is configured to remain engaged with the playard when a force of less than or equal to 25 pounds is applied to a location on the changing table other than the lock actuator.

Another aspect of the invention relates to a juvenile product that includes, among other possible things: a playard; and a changing table. The changing table includes, among other possible things: a platform that is sized to support a child, the platform being movable between an in-use position and a storage position relative to the playard; and a lock mechanism configured to maintain the platform in the in-use position by engaging the playard, the lock mechanism including a lock actuator. The changing table is configured to releasably engage the playard. When the changing table is engaged with the playard, the changing table is configured to remain engaged with the playard when a force of less than or equal to 25 pounds is applied to a location on the changing table other than the lock actuator.

Another aspect of the invention relates to a changing table for use with a playard. The changing table includes, among other possible things, a platform that is sized to support a child. The changing table is configured to be fixedly engaged to a playard. When the changing table is fixedly engaged to the playard, the changing table is configured to remain engaged with the playard when a force of less than or equal to 25 pounds is applied to the changing table.

Another aspect of the invention relates to a juvenile product that includes, among other possible things: a playard; and a changing table that is configured to be fixedly engaged to the playard. When the changing table is fixedly engaged with the playard, the changing table is configured to remain engaged with the playard when a force of less than or equal to 25 pounds is applied to the changing table.

Another aspect of the invention relates to a changing table that includes, among other possible things, a platform that is sized to support a child. The changing table is configured to be releasably engaged to the playard. When the changing table is engaged with the playard, the changing table is configured to remain engaged with the playard when a force of less than or equal to 25 pounds is applied to the platform.

Another aspect of the invention relates to a juvenile product that includes, among other possible things: a playard; and a changing table that is configured to be releasably engaged to the playard. When the changing table is engaged with the playard, the changing table is configured to remain engaged with the playard when a force of less than or equal to 25 pounds is applied to the platform.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

FIG. 30A is a perspective view of the changing table of FIG. 28 attached to a playard;

FIG. 30B is a close-up perspective view of the engagement between the changing table of FIG. 28 and the playard of FIG. 30A;

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

FIGS. 1-3, 4A-4B, and 5A-5B illustrate an embodiment of a juvenile product that includes a playard 100 and a changing table 200. This juvenile product provides an advantage over conventional playard/changing table juvenile products. When the changing table 200 is engaged with the playard 100, the changing table 200 will withstand a force of 25 pounds or less applied upwardly or outwardly to a platform 210 of the changing table 200, without disengaging from the playard 100. Accordingly, if a child playing in the playard 100 raises up against the platform of the changing table 200 with a force of 25 pounds or less, the changing table 200 will remain secured to the playard 100. The embodiments of FIGS. 6-8, FIGS. 9-11, FIGS. 12, 13, and 14A-14C, FIGS. 15-17 and 18A-18B, FIGS. 19-21, FIGS. 22,23, and 24A-24B, FIGS. 25, 26, and 27A-27B, FIGS. 28, 29, and 30A-30B, FIGS. 31, 32, and 33A-33B, and FIGS. 34-36 illustrate alternative juvenile products that provide this advantage.

This advantage can be recognized even in changing tables designed with actuators that can be actuated intentionally with less than 25 pounds of force by a caregiver to either disengage the changing table from the playard or to move the changing table from an in-use position to a storage position. For such a changing table, the changing table can be configured to remain engaged to the playard upon application of a force less than or equal to 25 pounds to any location on the changing table other than the actuator(s). Thus, if a child inadvertently bumps against the changing table with a force of 25 pounds or less, the changing table will remain secured to the playard.

Figure 2:
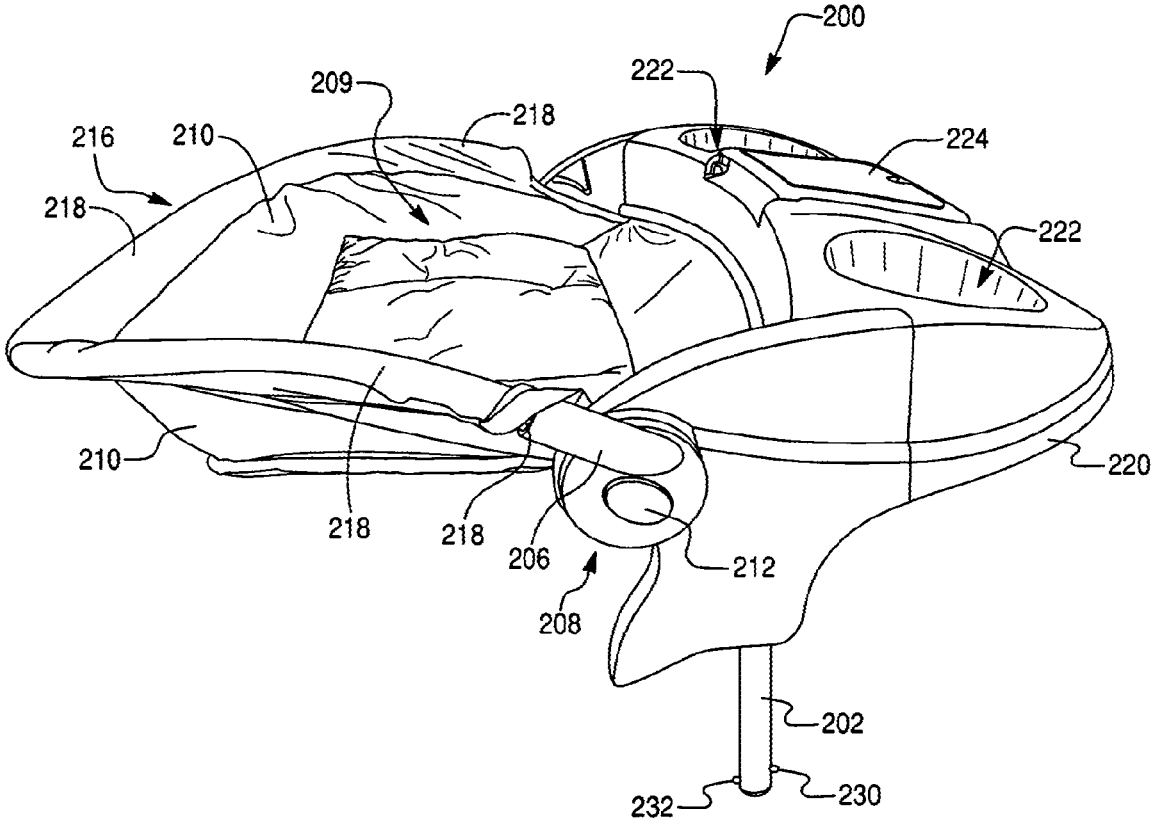
FIG. 2 is a perspective view of a first embodiment of a changing table that is configured to releasably engage the playard of FIG. 1.
Figure 3:
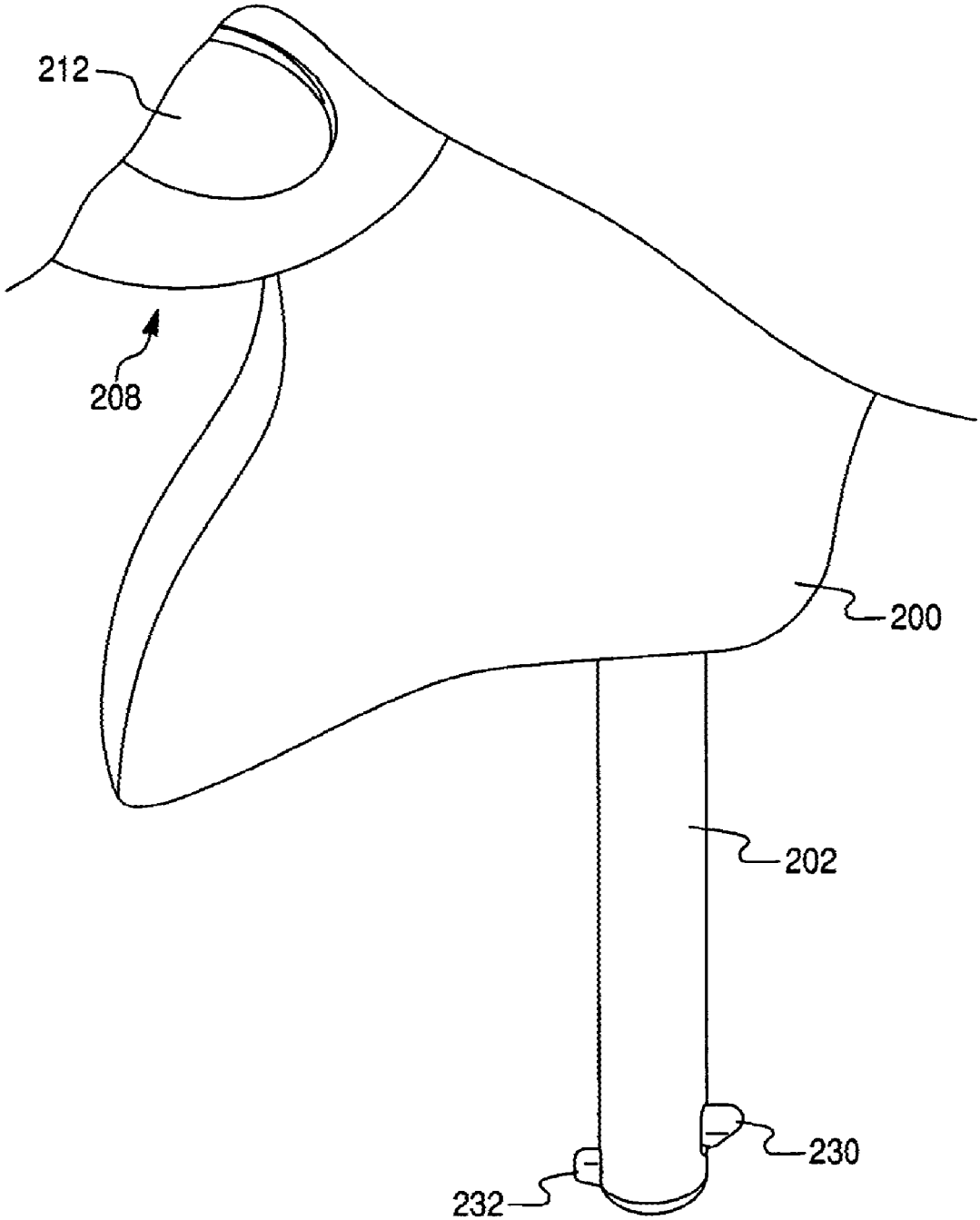
FIG. 3 is a close-up perspective view of a changing table mount of the changing table of FIG. 2, the view illustrating that the changing table mount includes a spring-actuated locking member.
Figure 4A:
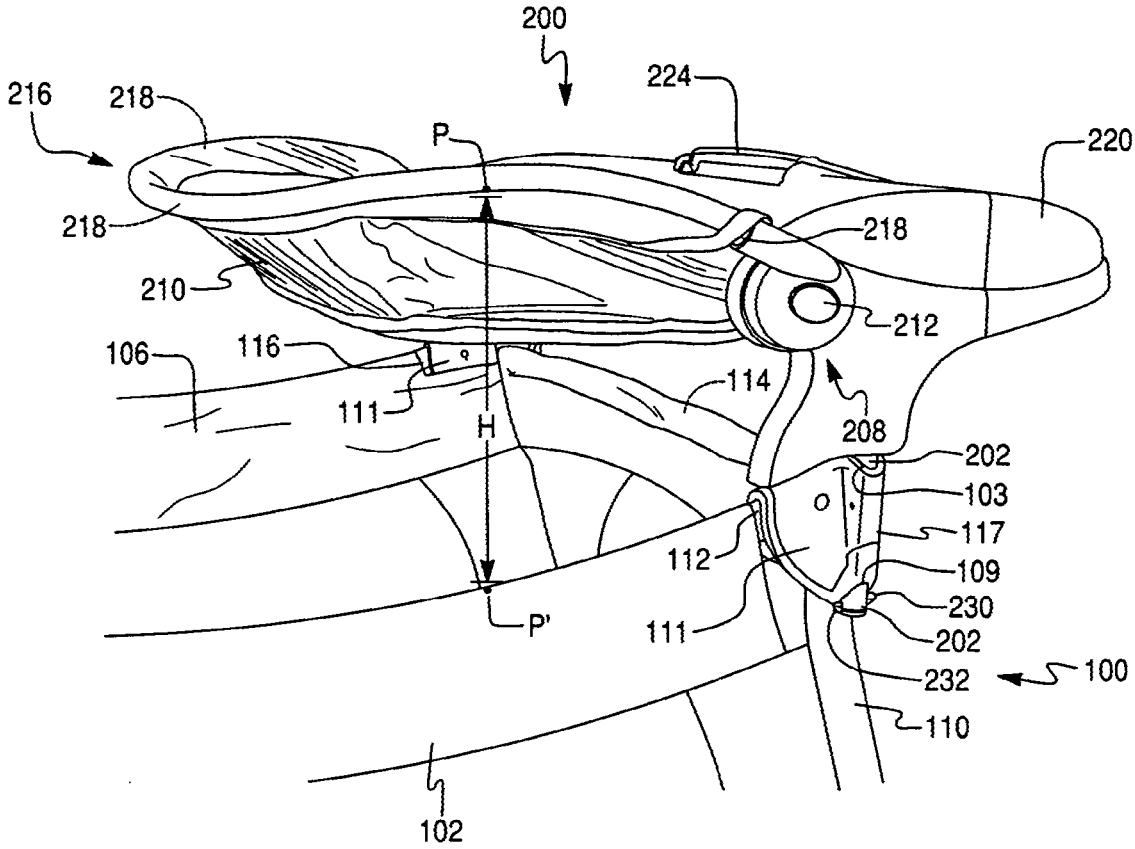
FIG. 4A is a close-up perspective view of the changing table of FIG. 2 attached to the playard of FIG. 1, the view illustrating the changing table in an in-use position.

The embodiment of FIGS. 1-3, 4A-4B, and 5A-5B provides a second advantage over conventional playard/changing table juvenile products. As can be seen in FIG. 4A, when the changing table is engaged with the playard 100 in an in-use position, the changing table 200 is elevated above the playard top rails 112, 114, 116, 118. As a result, an adult caregiver can comfortably access the changing table surface without needing to stoop. The embodiments of FIGS. 31, 32, and 33A-33B and FIGS. 34-36 illustrate alternative juvenile products that provide this advantage.

The elevated nature of the changing table 200 relative to the playard 100 in the embodiment shown in FIGS. 1-3, 4A-4B and 5A-5B provides a third advantage over conventional playard/changing table juvenile products. The changing table 200 is designed such that, where an opening is present between the changing table 200 and a nearest of the top rails 112, 114, 116, 118 of the playard 100, and a child conceivably could place his head in the opening, the opening is sized to allow ready passage of the child's head back-and-forth through the opening. For example, a portion of the opening in a direction normal to the nearest top rail can be at least 9 inches. Thus, should a curious child decide to place his head in such an opening between the changing table 200 and a nearest top rail 112, 114, 116, 118, the child will be able to freely pass his head back-and-forth through that opening. The embodiments of FIGS. 31, 32, and 33A-33B and FIGS. 34-36 illustrate alternative juvenile products that provide this advantage.

Various embodiments of a juvenile product will now be described. FIGS. 1-3, 4A-4B, and 5A-5B illustrate an embodiment of a juvenile product that includes a playard 100 and a changing table 200.

Figure 1:
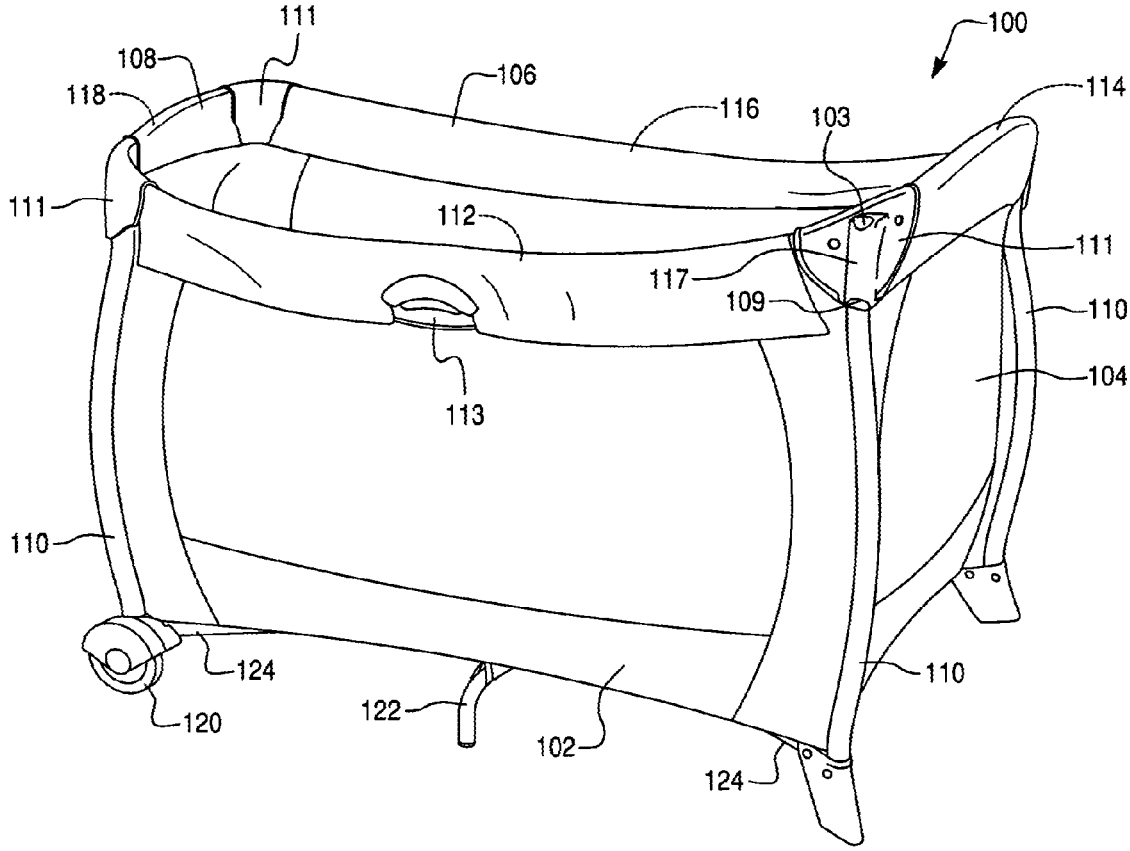
FIG. 1 is a perspective view of a playard that is configured to support a changing table.

The playard 100, which is shown best in FIG. 1, generally includes a collapsible frame and a softgoods/fabric enclosure mounted to and supported by the collapsible frame. The playard 100 provides a safe, confined environment for a child. The playard 100 can be used as a play space and is sized to accommodate a child and toys. The playard 100 also can be used as a sleep space; a child can sleep either on the floor of the playard 100 or in a bassinet suspended from top rails of the playard frame.

As shown in FIG. 1, the softgoods enclosure of the playard 100 can include a floor area (not shown) and four upright walls 102, 104, 106, 108 that surround the floor area. The number of upright walls is not limiting and other embodiments may have one (e.g., circular), two, three, or five or more upright walls. The frame of the playard 100 can include, for example, top rails 112, 114, 116, 118; corner posts 110; corner brackets 111; and a bottom frame including a center hub (not shown), supports 122, and cross-bracing beams 124.

The top rails 112, 114, 116, 118 are covered by softgoods in FIG. 1 and, therefore, are labeled with hidden lines. In the four-sided embodiment of FIG. 1, two of the top rails are side rails 112, 116 and extend along opposite sides of the playard, and two of the top rails are end rails 114, 118 and extend along opposite ends of the playard.

The four-sided embodiment of FIG. 1 includes four corner posts 110, three of which are shown in FIG. 1. A corner bracket 111 is mounted to the top end of each corner post 110. Each of the corner brackets 111 receives an end of a side rail 112, 116 and an end of the adjacent end rail 114, 118. The corner brackets 111 may pivotally receive the ends of the rails 112, 114, 116, 118 such that the playard 100 may be collapsed into a storage configuration.

The playard 100 may be provided with one or more wheels 120 at the bottom end of one or more corner posts 110. For example, wheels 120 can be mounted to the bottom ends of corner posts 110 on either side of endwall 108. The wheels 120 may be used to facilitate movement of the playard 100.

As previously mentioned, the playard frame also may be provided with one or more supports 122 and/or cross-bracing beams 124. The supports 122 and the beams 124 may be used to maintain the floor area in a position above a surface on which the playard 100 rests.

FIGS. 2-5 illustrate a first embodiment of a changing table 200 that is configured to be releasably engaged to the playard 100 of FIG. 1. Although only one side of the changing table 200 and the playard 100 may be shown in particular figures, it is to be understood that the other side of the changing table 200 and the playard 100 are the mirror image of the side that is shown. Accordingly, whereas various features of the changing table 200 and the playard 100 are shown and described, it is to be understood that mirror images of those features are provided on the opposite side of the changing table 200 and the playard 100.

The changing table 200 can include a platform 210 sized to support a child and a support structure or frame 216 to which the platform 210 is coupled. The support structure 216 in this embodiment includes a generally U-shaped bar 218 (shown best in FIG. 4B), a diaper organizer 220, and pivot joints 208 that connect the U-shaped bar 218 and the diaper organizer 220.

The diaper organizer 220 is provided to aid a caregiver in changing a child's diaper. Specifically, the diaper organizer 220 may include, for example, a compartment 224 to store baby wipes and additional compartments 222 to store diaper cream or other diaper-related items and accessories. Finally, the diaper organizer 220 may include a diaper storage compartment (not shown) under compartment 224.

The U-shaped bar 218, which may be at least partially covered by softgoods (as shown), and the diaper organizer 220 of the support structure 216 support the platform 210. The platform 210 may be suspended from the U-shaped bar 218 and the diaper organizer 220 such that a child changing area 209 is formed. The platform 210 can be attached to the diaper organizer 220 in a number of ways. For example, the platform 210 can be threaded over a tube element (not shown) of the diaper organizer 220 in a tongue and groove arrangement, can be fastened to the diaper organizer 220 with Velcro® straps, or can include a plastic mounting member on the platform softgoods to clamp to the diaper organizer 220. The child changing area 209 can be concave to facilitate maintaining a child on the platform 210 when, for example, a caregiver is changing the child's diaper.

The platform 210 can be formed of a fabric material, such as vinyl or polyester, or other material (or combination of materials) that is strong enough to support a child's weight. Moreover, the platform 210 can be formed of the same material that serves as the softgoods that encircle the U-shaped bar 218.

Figure 4B:
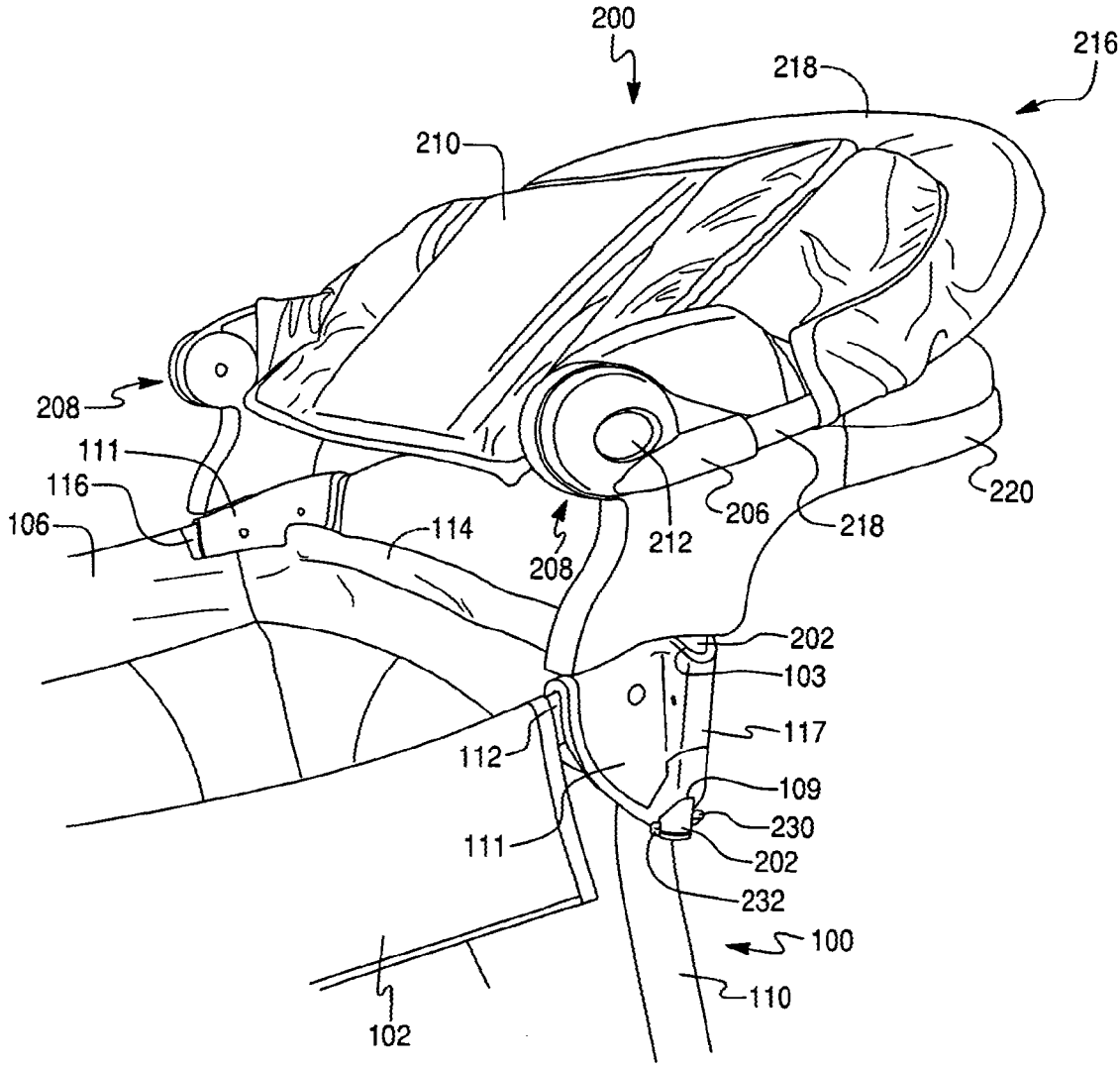
FIG. 4B is a close-up perspective view of the changing table of FIG. 2 attached to the playard of FIG. 1, the view illustrating the changing table in a storage position.
Figure 5A:
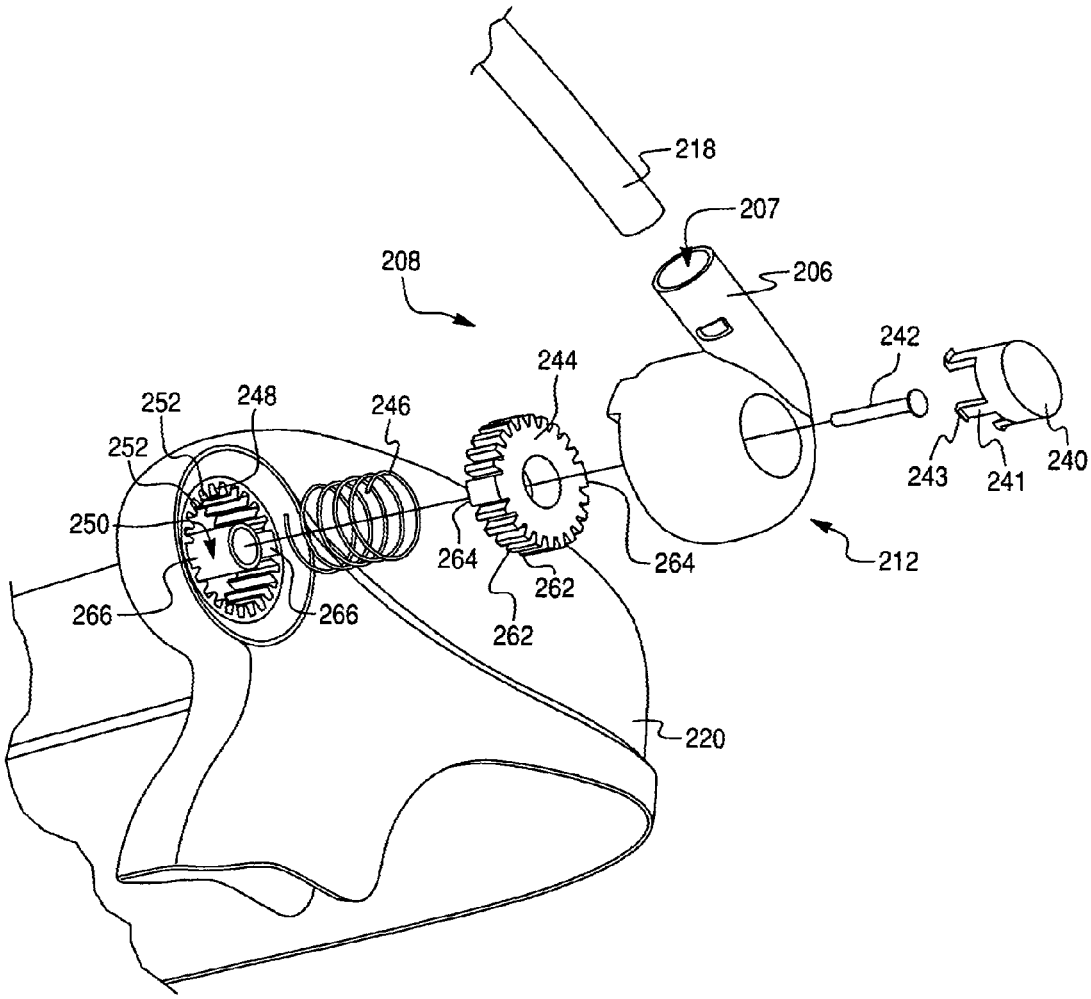
FIG. 5A is an exploded perspective view of a push-button lock mechanism of the changing table of FIG. 2.
Figure 5B:
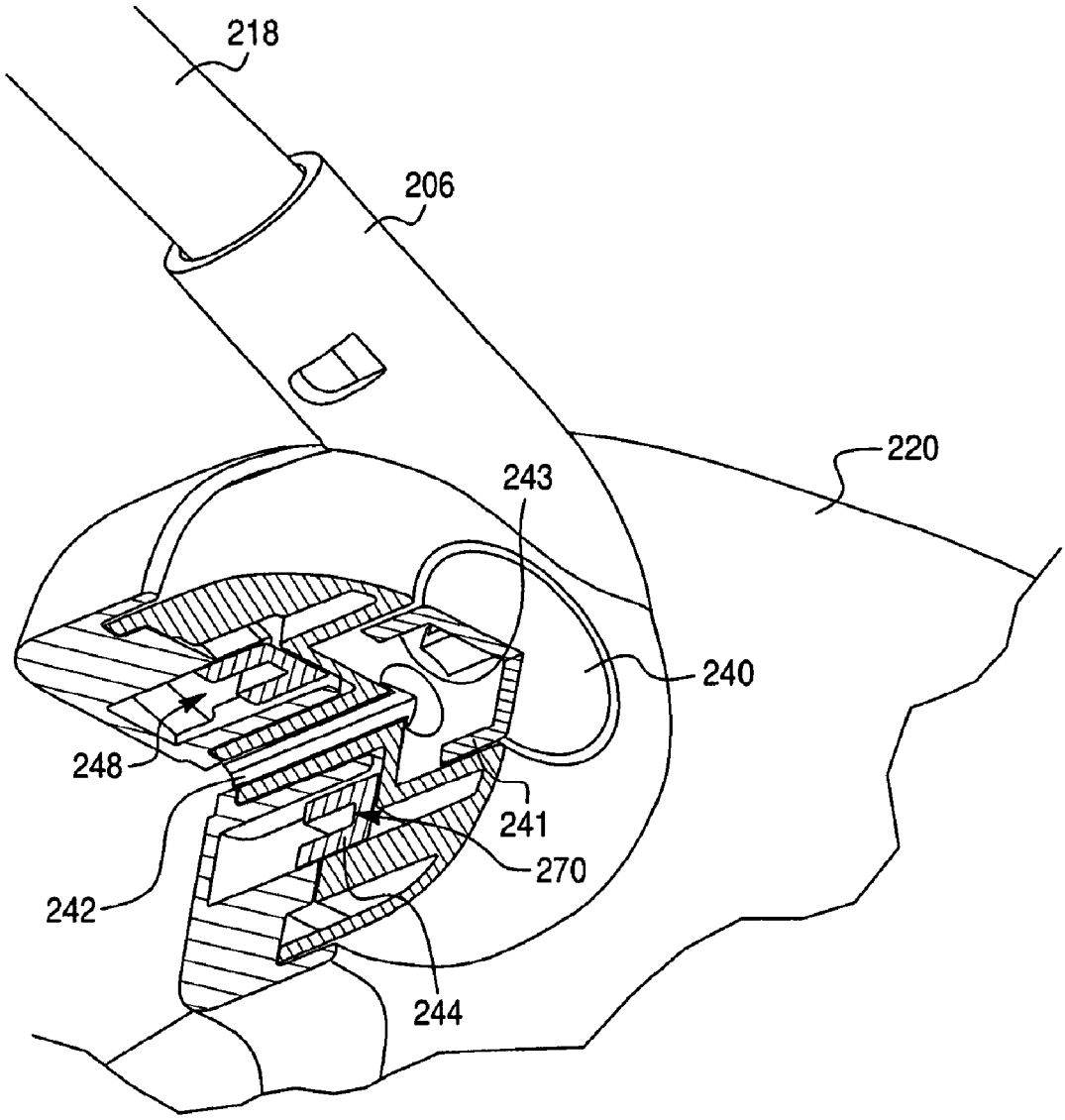
FIG. 5B is a break-away perspective view of the push-button lock mechanism of FIG. 5A.

The platform 210 can be pivotally movable relative to the playard 100 between an in-use position (FIG. 4A) and a storage position (FIG. 4B). Pivot joints 208 enable this movement. Each pivot joint 208 joins an end of the U-shaped bar 218 to the diaper organizer 220. Each pivot joint 208 can include a housing 206. The housings 206 include sockets 207 (FIG. 5A) that are sized to receive a respective free end of the U-shaped bar 218. At least one of the pivot joints 208 also includes a push-button lock mechanism 212 that enables the U-shaped bar 218, and the platform 210 supported by the U-shaped bar 218, to move between the in-use position (FIG. 4A) and the storage position (FIG. 4B). This push-button lock mechanism 212 will now be discussed in connection with FIGS. 5A-5B.

The push-button lock mechanism 212 generally includes the housing 206 (which includes a first gear housing 270), a lock actuator such as a spring-biased push-button 240, a gear 244, a spring 246, a second gear housing 248 formed in the diaper organizer 220, and a fastener (e.g., a bolt) 242 that fastens the housing 206 to the diaper organizer 220.

The second gear housing 248 includes a circular spring-receiving space 250 in which the spring 246 can be positioned, i.e., one end of the spring 246 is positioned against an inner wall of the second gear housing 248. The other end of the spring 246 is positioned against a first face of the gear 244. The other face of the gear 244 faces an internal wall of the first gear housing 270 in the housing 206.

The first and second gear housings 270, 248 have matching perimeters, which include a plurality of narrow recesses 252 and at least two block receiving spaces 266. The block receiving spaces 266 may, as shown, be diametrically opposed. Similarly, the gear 248 includes a plurality of narrow teeth 262 that are sized to be received in the narrow recesses 252 of the first and second gear housings 270, 248 and two block teeth 264 that are sized to be received in the block receiving spaces 266 of the first and second gear housings 270, 248.

When the platform 210 is in the in-use position, part of the gear 244 will be received in the narrow recesses 252 and the block receiving spaces 266 of the second gear housing 248. The remainder of the gear 244 will be received in the narrow recesses 252 and the block receiving spaces 266 of the first gear housing 270. As a result of the engagement of the gear 244 and both gear housings 248, 270, the first and second gear housings 270, 248 are immobilized with respect to each other.

To move the platform 210 to the storage position, the engagement between the gear 244 and the first gear housing 270 can be released. To release this engagement, the caregiver pushes on the push-button 240. As a result, legs 241 of the push-button 240 (which project into the first gear housing 270 and are retained therein by feet 243) push the gear 244 against the biasing force of the spring 246. When the spring 246 is completely compressed, the gear 244 will be completely received in the second gear housing 248. When the gear 244 is completely received in the second gear housing 248, the first gear housing 270 is able to rotate with respect to the second gear housing 248.

When the caregiver rotates the platform 210, the push-button 240 may be released. Initially, the gear 244 will be unable to spring into the first gear housing 270 because the block teeth 264 will be aligned with narrow recesses 252 of the first gear housing 270. However, when the changing table 200 has been rotated by 180°, the block teeth 264 will again align with the block receiving spaces 266. As a result, the gear 244 will spring outwardly such that part of the gear 244 is again positioned in the first gear housing 270 and part of the gear 244 is positioned in the second gear housing 248, thereby immobilizing the first and second gear housings 248, 270 with respect to each other.

To return the platform 210 to the in-use position, the caregiver would once again push the push-button 240 to disengage the gear 244 from the first housing 270. Subsequently, the platform 210 would be rotated toward the in-use position. When the platform 210 reaches the in-use position (i.e., when it rotates 180°), the gear 244 would once again spring into the first gear housing 270.

It will be understood that the location of the block receiving spaces 266 and the block teeth 264 can be changed to vary the rotation angle between the platform in-use and storage positions. Further, the number of block receiving spaces 266 and block teeth 264 may be adjusted to provide a plurality of locking positions.

The changing table 200 is releasably engaged to the playard 100. Accordingly, a caregiver can remove the changing table 200 from the playard 100 when the caregiver wants to collapse the playard 100 for storage or travel. In this regard, the changing table 200 includes changing table mounts that can releasably engage the playard 100. The changing table mounts of this embodiment can include first and second legs 202 that are coupled to the diaper organizer 220, as shown in FIG. 3. Although only one leg 202 is shown, it is to be understood that the other leg 202 is provided on the other side of the changing table 200.

The legs 202 can releasably engage first and second housings 117 of the playard 100. In this embodiment, the housings 117, one of which is shown in FIGS. 4A-4B, are mounted to adjacent corner brackets 111 of the playard frame at an end of the playard 100. The housings 117 each include a socket 103 (FIG. 1) into which the legs 202 are sized to slide. Although the legs 202 are shown as being generally tubular in shape, the shape of the legs 202 (and the corresponding shape of the sockets 103) is not limiting, and other shapes (e.g., legs and sockets having rectangular cross-sections) are fully within the scope of the invention.

The legs 202 of the changing table mount each can include a release actuator at their lower ends. As shown in FIG. 2, the release actuator can be a fastener such as a spring-actuated Valco® button 230. The lower ends of the legs 202 also can include guiding ribs 232, as best shown in FIG. 3. The guiding ribs 232 may be aligned with slots formed in the corner bracket housings 117 so that the changing table 200 may be properly aligned with the playard 100 when mounting the changing table 200 to the playard 100. Moreover, when the changing table 200 is properly aligned with the playard 100, the spring-actuated Valco® buttons 230 may be inwardly depressed into the legs 202 such that the legs 202 will fit into the correspondingly sized sockets 103. Subsequently, the legs 202 may be lowered into and through the sockets 103 until the spring-actuated Valco® buttons 230 outwardly spring under lower surfaces 109 of the housings 117, as shown in FIGS. 4A-4B.

When the spring-actuated Valco® buttons 230 outwardly spring under the lower surfaces 109 of the housings 117, the changing table 200 is releasably engaged to the playard 100. To release the changing table 200 from the playard 100, the caregiver can push inwardly the spring-actuated Valco® buttons 230 until the buttons 230 clear the lower surfaces 109 of the housings 117 and simultaneously lift the changing table 200 off of the playard 100.

This releasable engagement, between the spring-actuated Valco® buttons 230 of the changing table 200 and the lower surfaces 109 of the housings 117, enables the changing table 200 to be completely removed from the playard 100, if desired. Moreover, this releasable engagement is configured to withstand an upward or outward force of 25 pounds or less applied to the platform 210, without disengaging the changing table 200 from the playard 100. In this embodiment, the changing table 200 can remain engaged with the playard 100 when a force of 25 pounds or less is applied anywhere on the changing table 200 other than the spring-actuated Valco® buttons 232 of the changing table mount. Accordingly, if a child, who is positioned in the playard 100, inadvertently bumps or pushes the changing table 200 upwardly or outwardly with a force of 25 pounds or less, the changing table 200 will remain engaged to the playard 100.

According to another aspect of this embodiment, which provides a changing table 200 elevated above the top rails of the playard 100, an opening can be defined at least in part by a portion of the changing table support structure 216 and a nearest one of the top rails 112, 114, 116, 118. For example, the opening can be defined by the U-shaped bar 218, the diaper organizer 220, and the side rail 112 of the playard. A portion of the opening in a direction normal to the side rail 112 is at least 9 inches. By way of a specific example, with respect to FIG. 4A, at least one point P on the U-shaped bar 218 is separated from a nearest point P' on the nearest top rail, here, a side rail 112, of the playard 100 by a height H. The distance of the height H is least 9 inches. As a result of this spacing between the U-shaped bar 218 and the side rail 112, if a curious child in the playard 100 places his head into the opening between the changing table 200 and the playard top rail 112, the child can readily withdraw his head from the opening.

It should be understood that the "normal" direction is a direction perpendicular from a point on the top rail toward a nearest point on the support structure 216. This "normal" direction need not be perpendicular to a surface on which the playard 100 rests and will depend on the orientation of the support structure 216 and the nearest rail 112, 114, 116, 118. For example, the support structure 216 of the changing table 200 can be offset from the top rail 112 such that the "normal" direction is not perpendicular to the surface on which the playard 100 rests.

Figure 6:
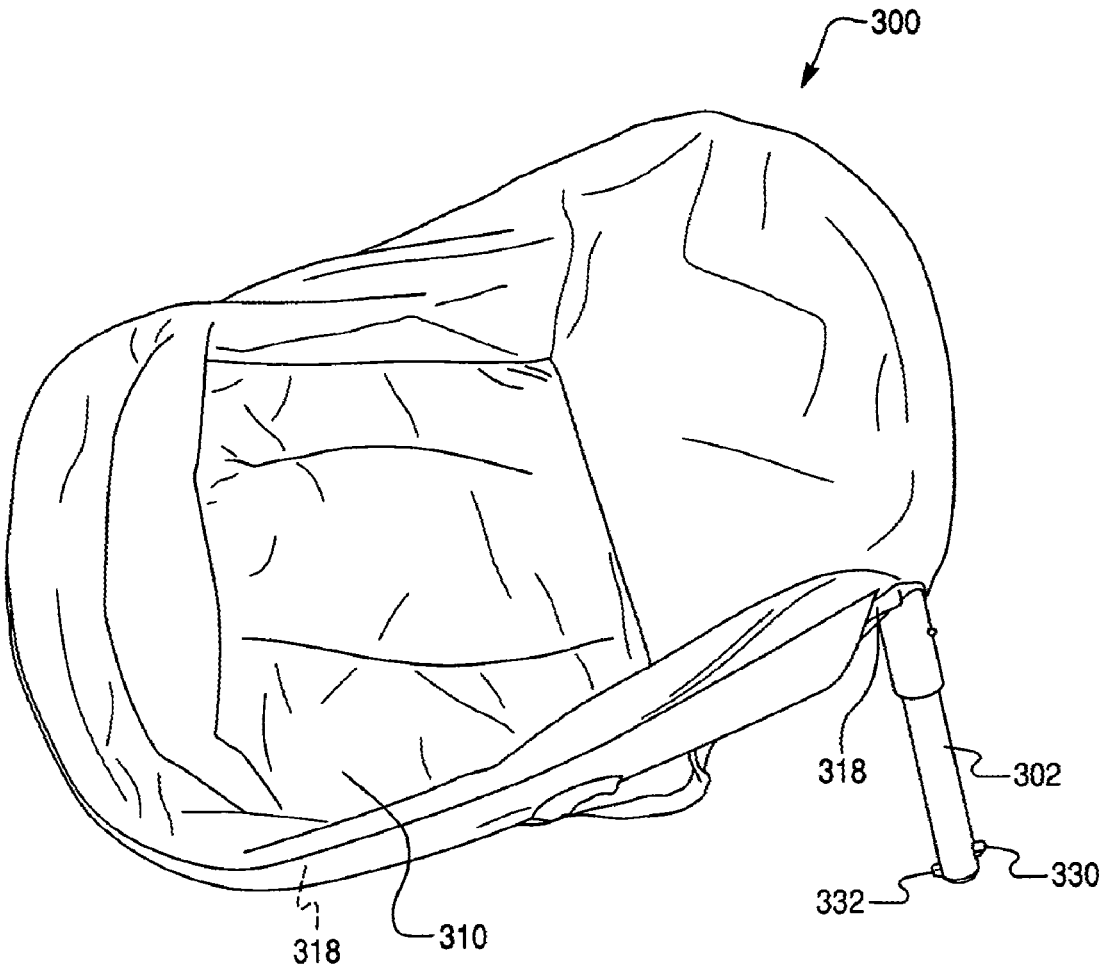
FIG. 6 is a perspective view of a second embodiment of a changing table that is configured to releasably engage the playard of FIG. 1.
Figure 7:
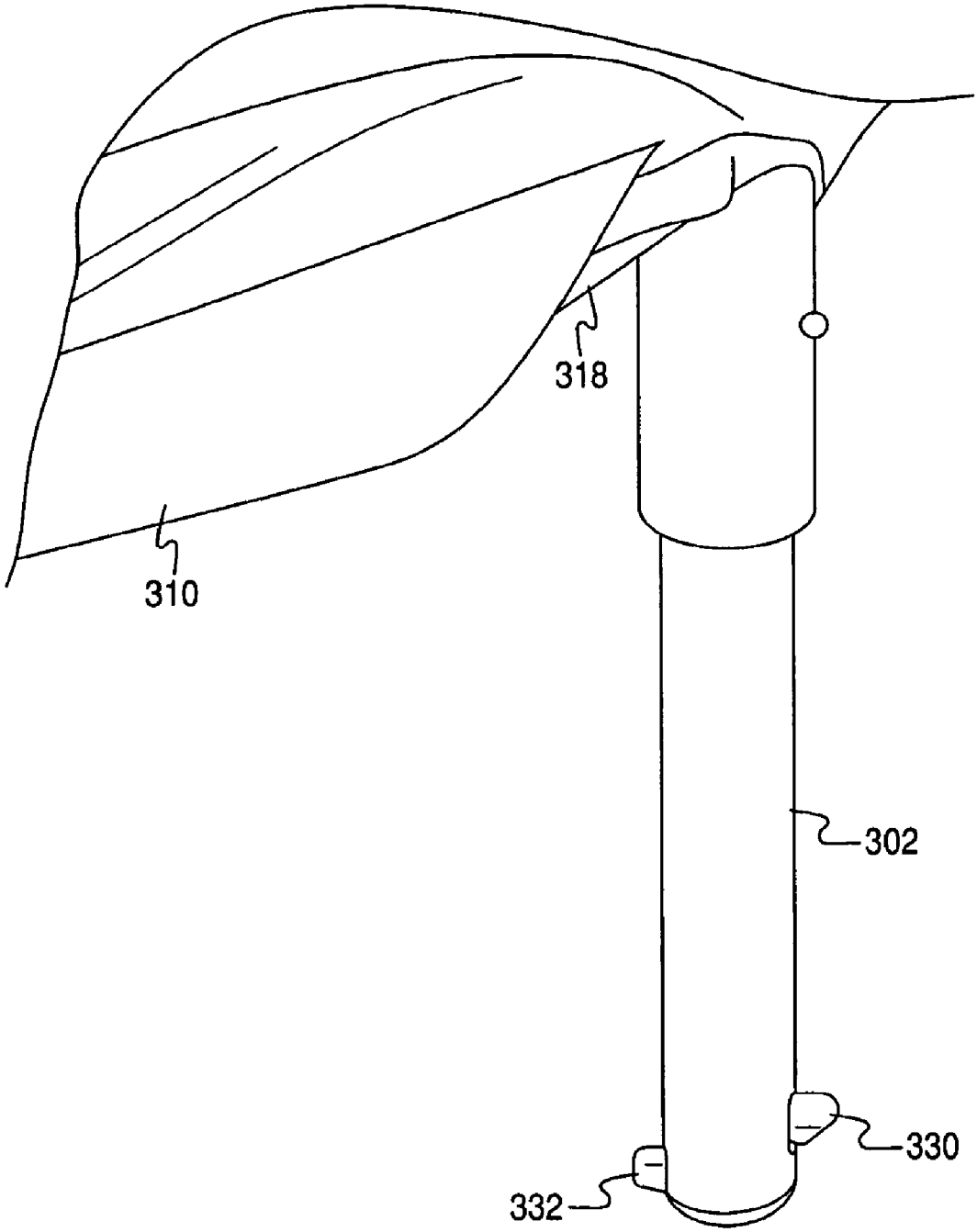
FIG. 7 is a close-up perspective view of a changing table mount of the changing table of FIG. 6, the view illustrating that the changing table mount includes a spring-actuated locking member.
Figure 8:
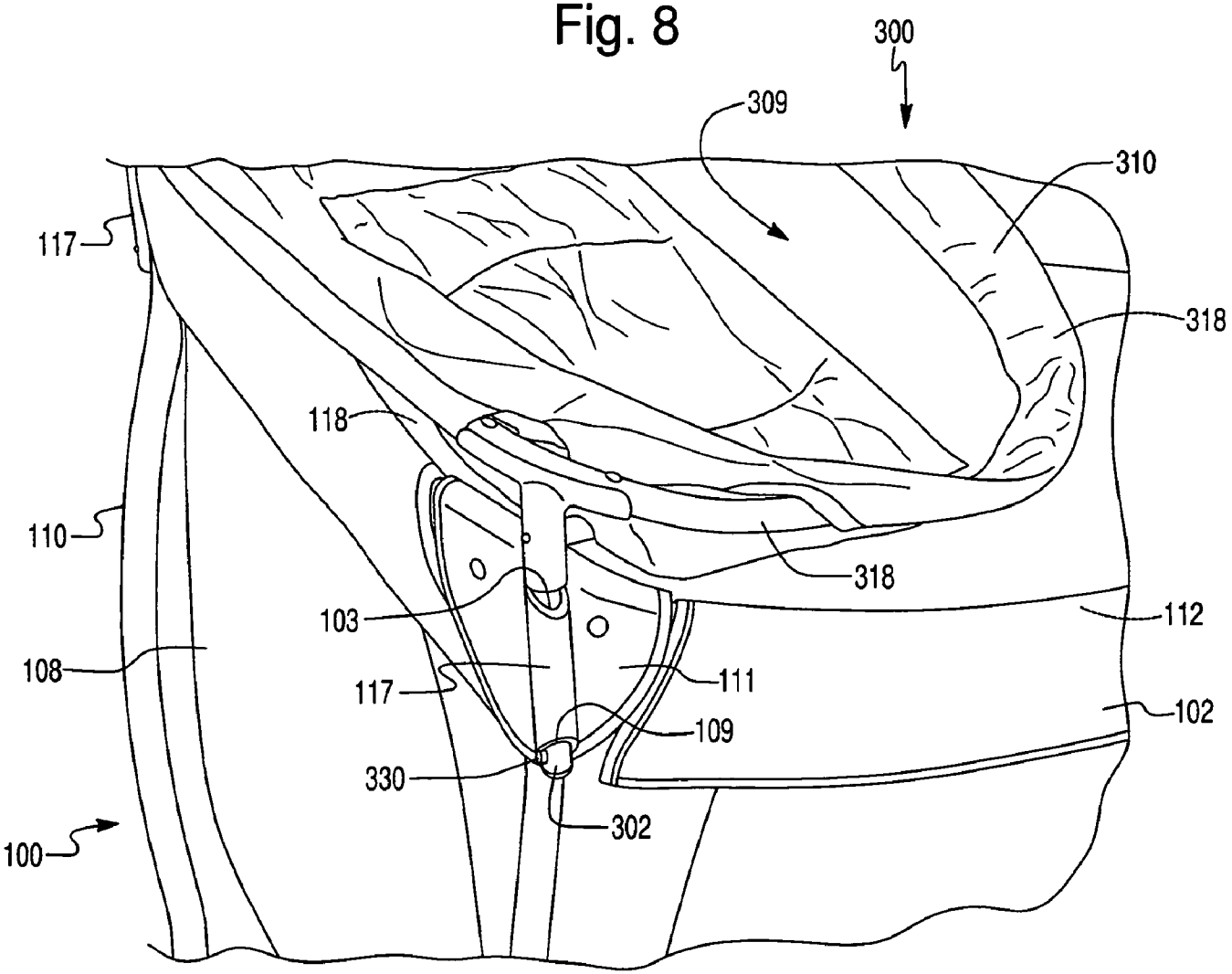
FIG. 8 is a close-up perspective view of the changing table of FIG. 6 attached to the playard of FIG. 1.

FIGS. 6-8 illustrate another changing table embodiment that is configured to be releasably engaged to the playard 100 of FIG. 1. Although only one side of the changing table 300 and the playard 100 may be shown in particular figures, it is to be understood that the other side of the changing table 300 and the playard 100 are the mirror image of the side that is shown. Accordingly, whereas various features of the changing table 300 and the playard 100 are shown and described, it is to be understood that mirror images of those features are provided on the opposite side of the changing table 300 and the playard 100.

The changing table can include a platform 310 sized to support a child and a support structure or frame 318 (best shown in FIG. 8) to which the platform 310 is coupled. The support structure 318 can be generally rectangular in shape, and the platform 310 can be suspended from the support structure 318 such that a concave child changing area 309 is formed. The platform 310 can be formed of a fabric material, such as vinyl or polyester, or other material (or combination of materials) that is strong enough to support a child's weight.

The changing table 300 is releasably engaged to the playard 100. Accordingly, a caregiver can remove the changing table 300 from the playard 100 when the caregiver wants to collapse the playard 100 for storage or travel. In this regard, the changing table 300 includes changing table mounts that can releasably engage the playard 100. The changing table mounts of this embodiment include first and second legs 302, one of which is shown in FIG. 7.

Although only one leg 302 is shown, it is to be understood that the other leg 302 is provided on the other side of the changing table 300. The legs 302 are sized to slide into the sockets 103 (FIG. 1) in housings 117 of the adjacent corner brackets 111 at an end of the playard 100. Although the legs 302 are shown as being generally tubular in shape, the shape of the legs 302 (and the corresponding shape of the sockets 103) is not limiting, and other shapes (e.g., legs and sockets having rectangular cross-sections) are fully within the scope of the instant invention The legs 302 each can include a release actuator at their lower ends. As shown in FIG. 7, the release actuator can be a fastener such as a spring-actuated Valco® button 330. The lower ends of the legs 302 also may include guiding ribs 332. The guiding ribs 332 may be aligned with slots formed in the corner bracket housings 117 so that the changing table 300 may be properly aligned with the playard 100 when mounting the changing table 300 to the playard 100. Moreover, when the changing table 300 is properly aligned with the playard 100, the spring-actuated Valco® buttons 330 may be inwardly depressed into the legs 302 such that the legs 302 will fit into the correspondingly sized sockets 103. Subsequently, the legs 302 may be lowered into and through the sockets 103 until the spring-actuated Valco® buttons 330 outwardly spring under lower surfaces 109 of the housings 117, as shown in FIG. 8.

When the spring-actuated Valco® buttons 330 outwardly spring under the lower surfaces 109 of the housings 117, the changing table 300 is releasably engaged with the playard 100. To release the changing table 300 from the playard 100, the caregiver can push inwardly the spring-actuated Valco® buttons 330 until they clear the lower surfaces 109 of the housings 117 and simultaneously lift the changing table 300 off of the playard 100.

This releaseable engagement, between the spring-actuated Valco® buttons 330 of the changing table 300 and the lower surfaces 109 of the housings 117, enables the changing table 300 to be completely removed from the playard 100, if desired. Moreover, this releasable engagement is configured to withstand an upward or outward force of 25 pounds or less applied to the platform 310, without disengaging from the playard 100. In this embodiment, the changing table 300 can remain engaged with the playard 100 when a force of 25 pounds or less is applied anywhere on the changing table 300 other than the spring-actuated Valco® buttons 332 of the changing table mount. Accordingly, if a child, who is positioned in the playard 100, inadvertently bumps or pushes the changing table 300 upwardly or outwardly with a force of 25 pounds or less, the changing table 300 will remain engaged to the playard 100.

Figure 9:
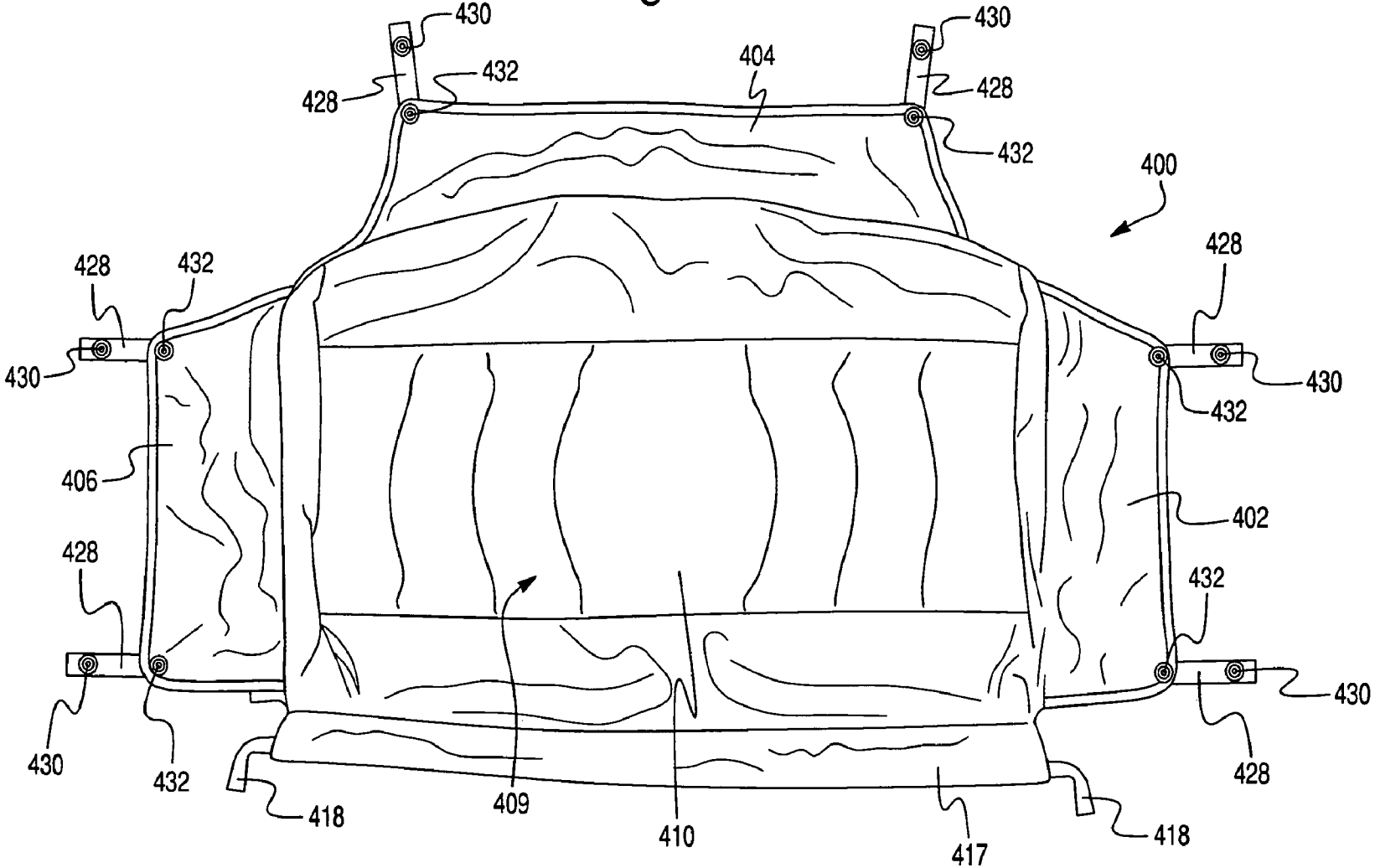
FIG. 9 is a top plan view of a third embodiment of a changing table that is configured to releasably engage a playard.
Figure 10:
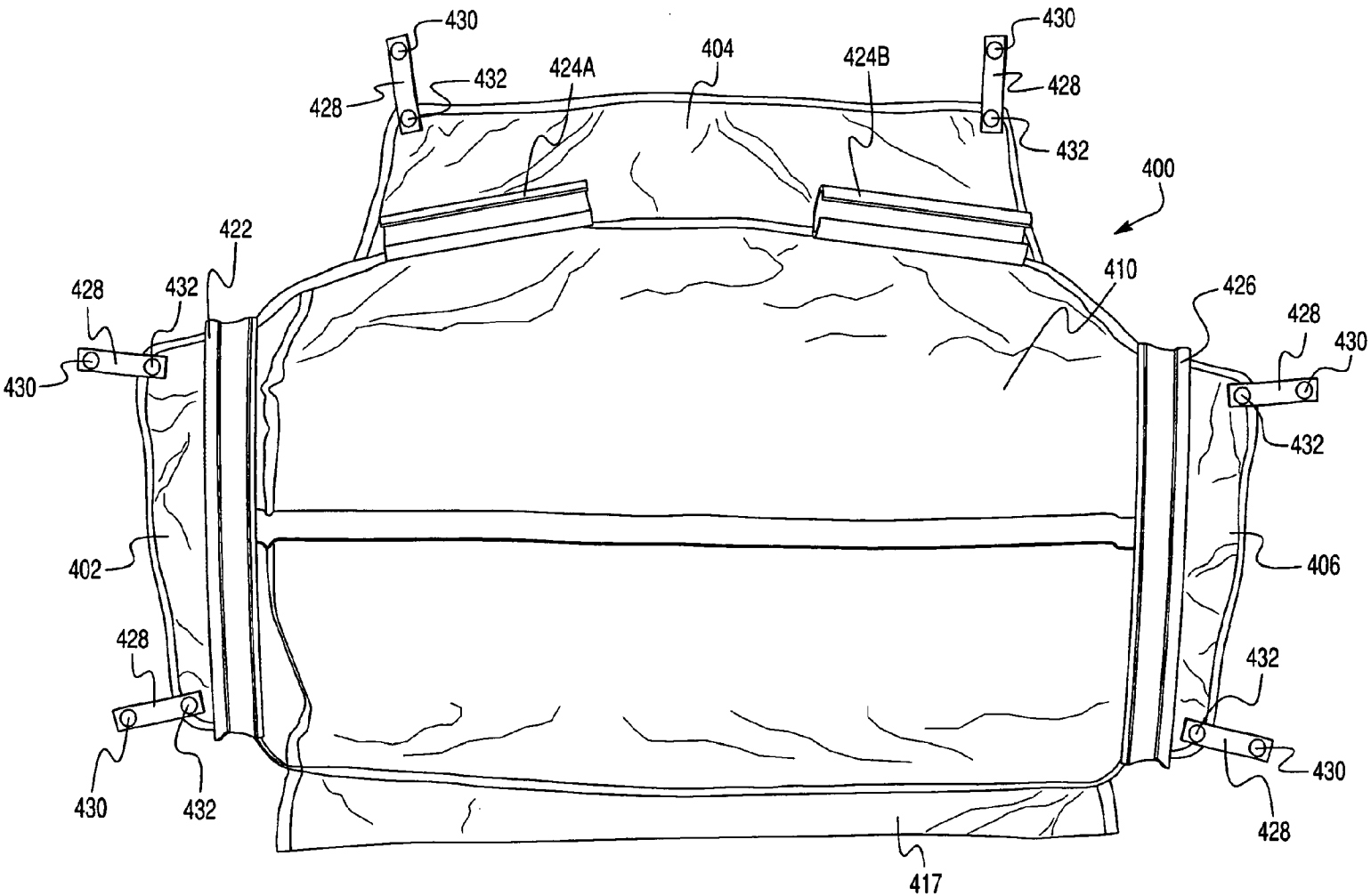
FIG. 10 is a bottom plan view of the changing table of FIG. 9, the view illustrating that the changing table mount includes a plurality of snaps and c-clips.
Figure 11:
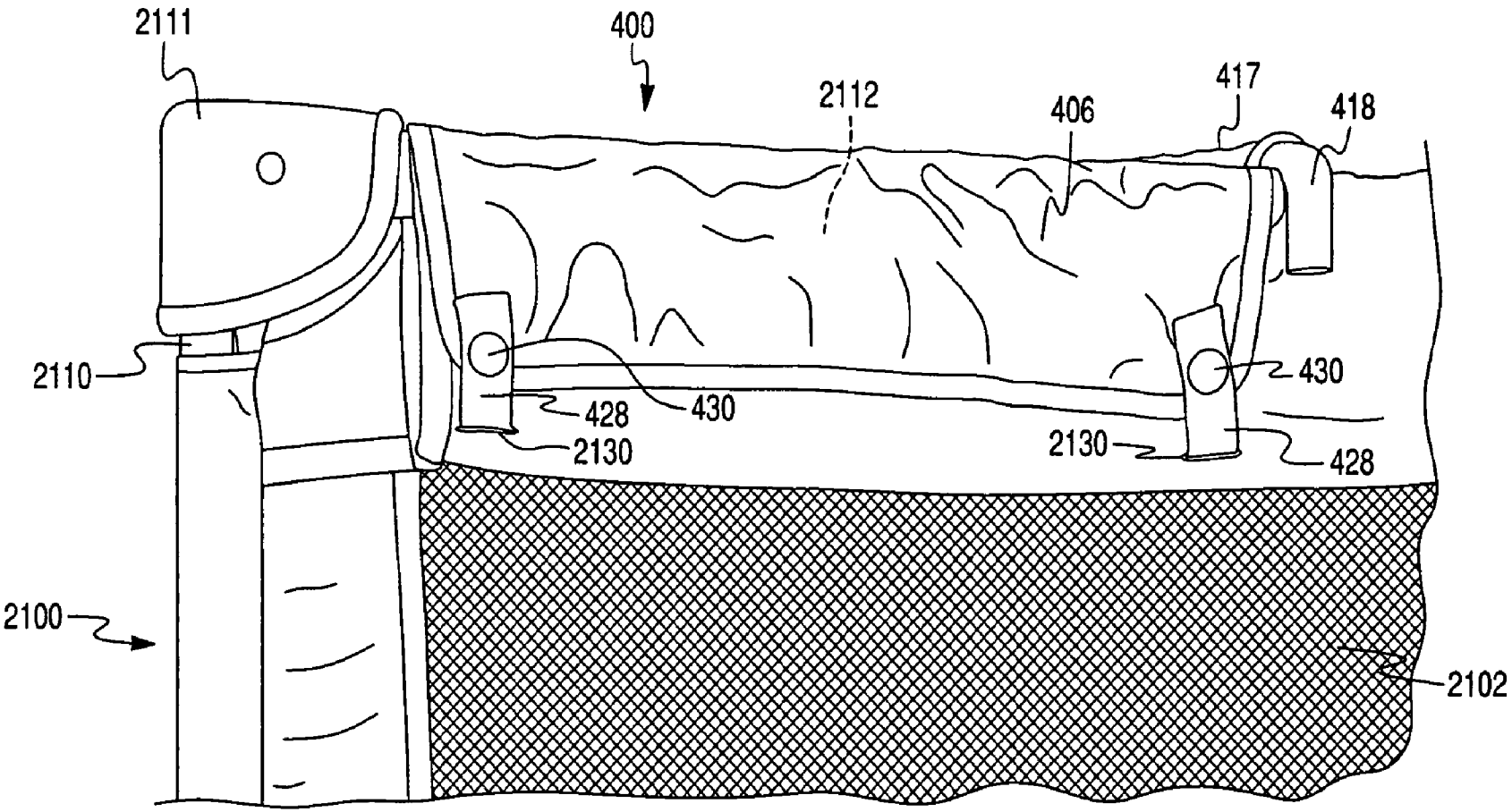
FIG. 11 is a close-up side elevation view of the changing table of FIG. 9 attached to a playard.

FIGS. 9-11 illustrate a changing table 400 that is configured to be releasably engaged to a playard 2100. Although a section of only one side of the playard 2100 may be shown in particular figures, it is to be understood that the other side of the playard 2100 is the mirror image of the side that is shown. Accordingly, whereas various features of the playard 2100 are shown and described, it is to be understood that mirror images of those features are provided on the opposite side of the playard 2100.

The changing table 400 includes a platform 410 sized to support a child and a support structure to which the platform 410 is coupled. The support structure can be generally rectangular in shape, and the platform 410 can be suspended from the support structure such that a concave child changing area 409 is formed. The support structure can include a beam 418 that is received within a pocket 417 of the platform 410 and a plurality of c-clips 422, 424A, 424B, 426, which can serve to provide structure to the changing table 400. The platform 410 can be formed of a fabric material, such as vinyl or polyester, or other material (or combination of materials) that is strong enough to support a child's weight.

The changing table 400 is releasably engaged to the playard 2100. Accordingly, a caregiver can remove the changing table 400 from the playard 2100 when the caregiver wants to collapse the playard 2100 for storage or travel. In this regard, the changing table 400 includes changing table mounts that can releasably engage the playard 2100. The changing table mounts of this embodiment can include the c-clips 422, 424A, 424B, 426, and fastener straps 428.

As shown in FIGS. 10 and 11, the two side c-clips 422, 426 are configured to clamp onto the side rails (one side rail 2112 being shown in FIG. 11) of the playard 2100. Similarly, the two end c-clips 424A, 424B are configured to clamp onto an end rail 2118 of the playard 2100. Although the end c-clips 424A, 424B could be combined into one c-clip, by separating them, a fold latch along an end rail of the playard 2100, similar to a fold latch 113 of the side rail 112 shown in FIG. 1, may be accommodated therebetween. Each of the c-clips 422, 424A, 424B, 426 can include a release actuator, such as a tab molded as part of the c-clip, to enable a caregiver to remove the c-clips 422, 424A, 424B, 426 from the top rails of the playard 2100.

The platform 410 can include three panels 402, 404, 406 and the pocket 417. Two of the panels are side panels 402 and 406, and the third of the panels is an end panel 404. Each of the panels 402, 404, 406 includes at least two release actuators, which may, as shown, be in the form of fastener straps 428. In the illustrated embodiment, the fastener straps 428 contain female snap members 430. The female snap members 430 are configured to engage corresponding male snap members 432 formed on the panels 402, 404, 406. Of course, the arrangement of the female and male snap members 430, 432 could be reversed.

The fastener straps 428 are configured to be received in slots 2130 formed in, or on, the sidewalls (one sidewall 2102 is shown in FIG. 11) and an endwall of the playard 2100. Specifically, the fastener straps 428 that project from the side panels 402, 406 are configured to slide through slots 2130 formed on the sidewalls of the playard 2100, and the fastener straps 428 that project from the end panel 404 are configured to slide through slots 2130 formed on an endwall of the playard 2100. FIG. 11 shows the fastener straps 428 received in slots 2130 formed in sidewall 2102 of the playard 2100.

To engage the changing table 400 to the playard 2100, the following steps are taken. First, the two side c-clips 422, 426 are clamped onto the side rails of the playard 2100, and the end c-clips 424A, 424B are clamped onto an end rail of the playard 2100. As a result, beam 418 will extend across both the side rails (FIG. 11). Subsequently, the fastener straps 428 of each of the panels 402, 404, 406 are slid through corresponding slots 2130 formed in, or on, the corresponding sidewalls and endwall of the playard 2100. Finally, the fastener straps 428 are bent onto themselves such that the female snap members 430 of the fastener straps 428 align with the corresponding male snap members 432 of the panels 402, 404, 406. The female and male snap members 430, 432 then are engaged.

To disengage the changing table 400 from the playard 2100, the caregiver can grip ends of the fastener straps 428 to release the engagement of the male and female snap members 430, 432. Subsequently, edges of the c-clips 422, 424A, 424B, 426 can be pulled such that the c-clips 422, 424A, 424B, 426 are pulled off the corresponding playard rails. When the c-clips 422, 424A, 424B, 426 are released from the rails, the changing table 400 can be removed.

This releaseable engagement of the changing table 400 and the playard 2100 enables the changing table 400 to be completely removed from the playard 2100, if desired. Moreover, the combination of the c-clips 422, 424A, 424B, 426, and the fastener straps 428 enables the changing table 400 to withstand an upward or outward force of 25 pounds or less applied to the platform 410, without disengaging the changing table 400 from the playard 2100. In this embodiment, the changing table 400 can remain engaged with the playard 2100 when a force of 25 pounds or less is applied anywhere on the changing table 400 other than the fastener straps 428 and/or the release actuator tabs of the c-clips 422, 424A, 424B, 426 of the changing table mount. Accordingly, if a child, who is positioned in the playard 2100, inadvertently bumps or pushes the changing table 400 upwardly or outwardly with a force of 25 pounds or less, the changing table 400 will remain engaged to the playard 2100.

The number of c-clips 424, 424A, 424B, 426, and/or fastener straps 428 may be changed, while enabling the resultant changing table to retain the functionality of the changing table 400 shown in FIGS. 9-11. Moreover, an alternate embodiment could include only fastener straps 428 and no c-clips 422, 424A, 424B, 426. Another alternate embodiment could include only c-clips 422, 424A, 424B, 426, and no fastener straps 428. In addition, the c-clips may be configured to simply rest on top of the playard top rails, in which case the fastener straps 428 would maintain the changing table 400 to the playard 2100 upon application of a force of 25 pounds or less. In each of these alternative embodiments, the changing table mounts are designed to ensure that the changing table can withstand an upward or outward force of 25 pounds or less, without disengaging the changing table from the playard.

FIGS. 12, 13, and 14A-14C illustrate another changing table embodiment that is configured to be releasably engaged to a playard 2200. Although only one side of the changing table 500 and the playard 2200 may be shown in particular figures, it is to be understood that the other side of the changing table 500 and the playard 2200 are the mirror image of the side that is shown. Accordingly, whereas various features of the changing table 500 and the playard 2200 are shown and described, it is to be understood that mirror images of those features are provided on the opposite side of the changing table 500 and the playard 2200.

The changing table 500 includes a platform 510 and a support structure to which the platform 510 is coupled. The platform 510 can be suspended from the support structure such that a concave child changing area 509 is formed. The platform 510 can be formed of a fabric material, such as vinyl or polyester, or other material (or combination of materials) that is strong enough to support a child's weight.

Figure 12:
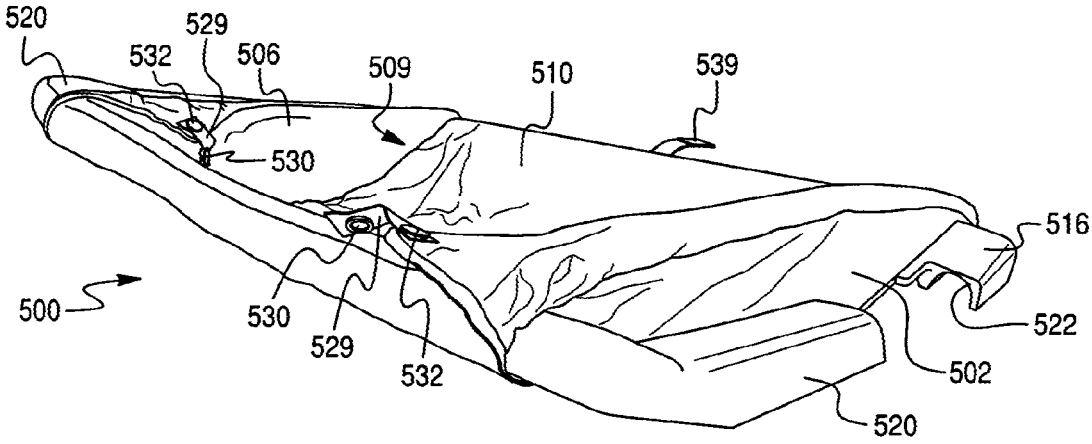
FIG. 12 is a perspective view of a fourth embodiment of a changing table that is configured to releasably engage a playard.
Figure 14A:
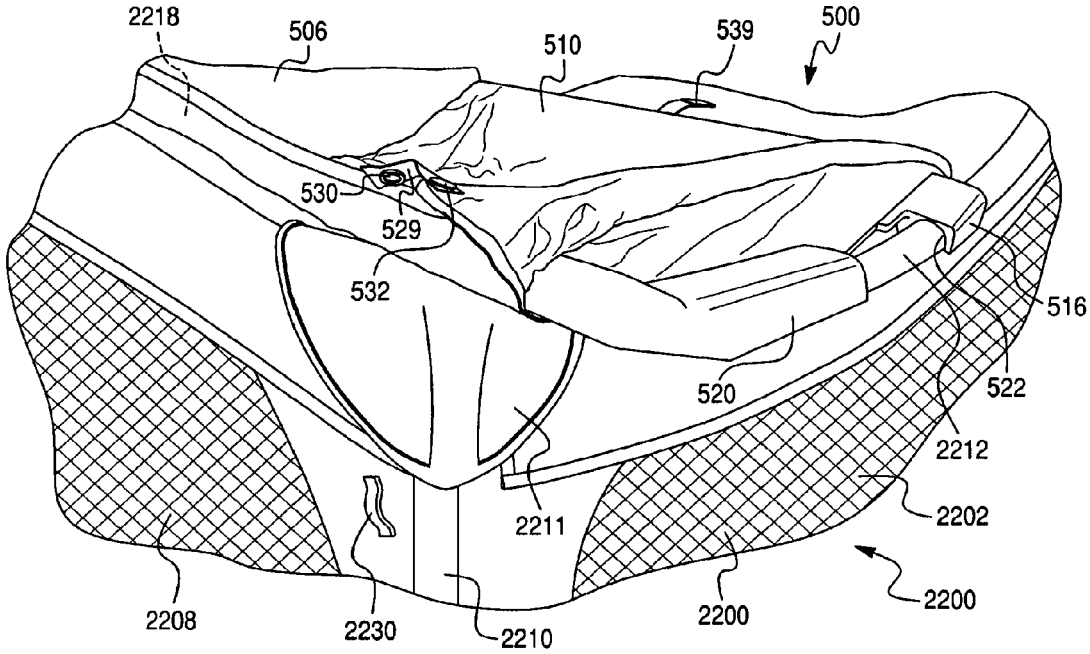
FIG. 14A is a perspective view of the changing table of FIG. 12 partially engaged to a playard.

The support structure of changing table 500 generally includes three members that partially circumscribe the child changing area 509. Two of the members (member 516 is shown in FIG. 12) are configured to respectively engage the side rails (one side rail 2212 is shown in FIG. 14A) of the playard 2200. FIG. 14A shows member 516 engaged to a side rail 2112 of the playard 2200; a similarly-shaped member engages the other side rail. The third member 520 is generally U-shaped and is configured to overlay portions of the side rails of the playard 2200 as well as an end rail 2218 of the playard 2200.

As shown in FIG. 14A, the support structure members (e.g., 516, 520) support the platform 510. Moreover, as the first two support structure members (e.g., 516) are configured to separately engage the side rails of the playard 2200, a depth of the child changing area 509 may be increased or decreased by moving those support structure members toward or away from the third support structure member 520 along the side rails of the playard 2200.

The changing table 500 is releasably engaged to the playard 2200 by support structure members and changing table mounts formed as part of those support structure members. In this regard, each of the support structure members (e.g., 516, 520) includes a c-clip (e.g., 522) formed on a lower side. Each c-clip is configured to mount to the associated top rail of the playard 2200. For example, as shown in FIGS. 12 and 14A, member 516 has a c-clip formed on its lower side to engage the side rail 2112 of the playard 2200. Each of the c-clips (522) can include a release actuator, such as a tab molded as part of the c-clip, to enable a caregiver to remove the c-clips (522) from the top rails of the playard 2200.

Figure 13:
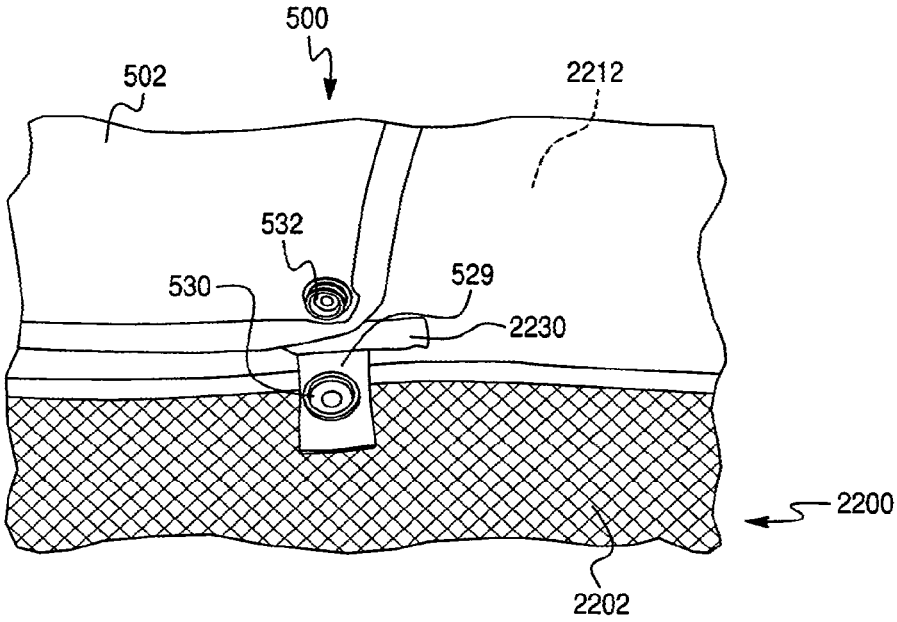
FIG. 13 is a close-up side elevation view of a changing table mount of the changing table of FIG. 12, the view illustrating a snap of the changing table mount.
Figure 14B:
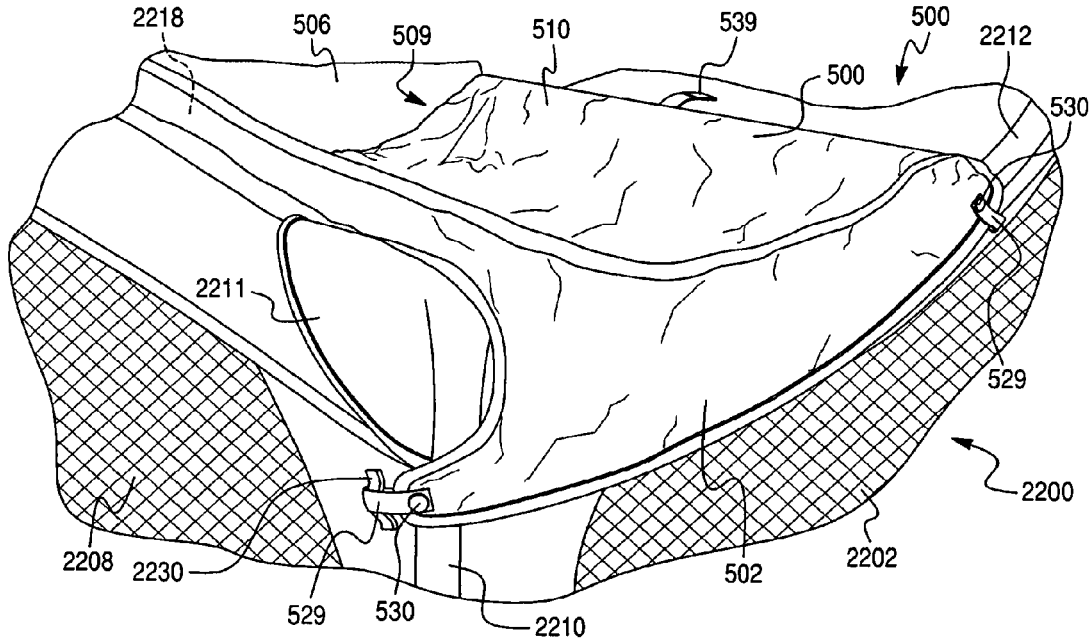
FIG. 14B is a close-up perspective view of the changing table of FIG. 12 completely engaged to a playard in an in-use position.

The changing table mount of this embodiment may also include fastener straps 529 that extend from side panels 502, 506. The fastener straps 529 can include female snap members 530. The fastener straps 529 may slide through slots 2230 formed on, or in, the sidewalls (e.g., 2202) and the endwall 2208 of the playard 2200, as shown in FIG. 13. Subsequently, the fastener straps 529 may be bent onto themselves such that the female snap members 530 engage corresponding male snap members 532 of the platform 510, as shown in FIG. 14B. Although FIG. 14B only shows one side panel 502 being reinforced by two fastener straps 529, it should be readily understood that the other side panel 506 may be similarly reinforced.

By clamping the c-clips of the support structure members to the side rails and an end rail of the playard 2200 and by fastening the fastener straps 529, the changing table 500 may be releasably connected to the playard 2200 in the in-use position shown in FIG. 14B.

The fastener straps 529 serve as release actuators to enable removal of the changing table 500 from the playard 2200. To completely remove the changing table 500 from the playard 2200, the ends of the fastener straps 529 are pulled such that the male and female snap members 530, 532 are disengaged. Subsequently, edges of the c-clips are pulled to release them from the top rails of the playard 2200. When the c-clips are released from the playard 2200, the changing table 500 may be completely removed from the playard 2200.

This releasable engagement of the changing table 500 and the playard 2200 enables the changing table 500 to be completely removed from the playard 2200, if desired. Moreover, the combination of the c-clips and the fastener straps 529 enables the changing table 500 to withstand an upward or outward force of 25 pounds or less applied to the platform 510, without disengaging the changing table 500 from the playard 2200. In this embodiment, the changing table 500 can remain engaged with the playard 2200 when a force of 25 pounds or less is applied anywhere on the changing table 500 other than the fastener straps 529 and/or the release actuator tabs of the c-clips of the support structure members of the changing table mount. Accordingly, if a child, who is positioned in the playard 2200, inadvertently bumps or pushes the changing table 500 upwardly or outwardly with a force of 25 pounds or less, the changing table 500 will remain engaged to the playard 2200.

Figure 14C:
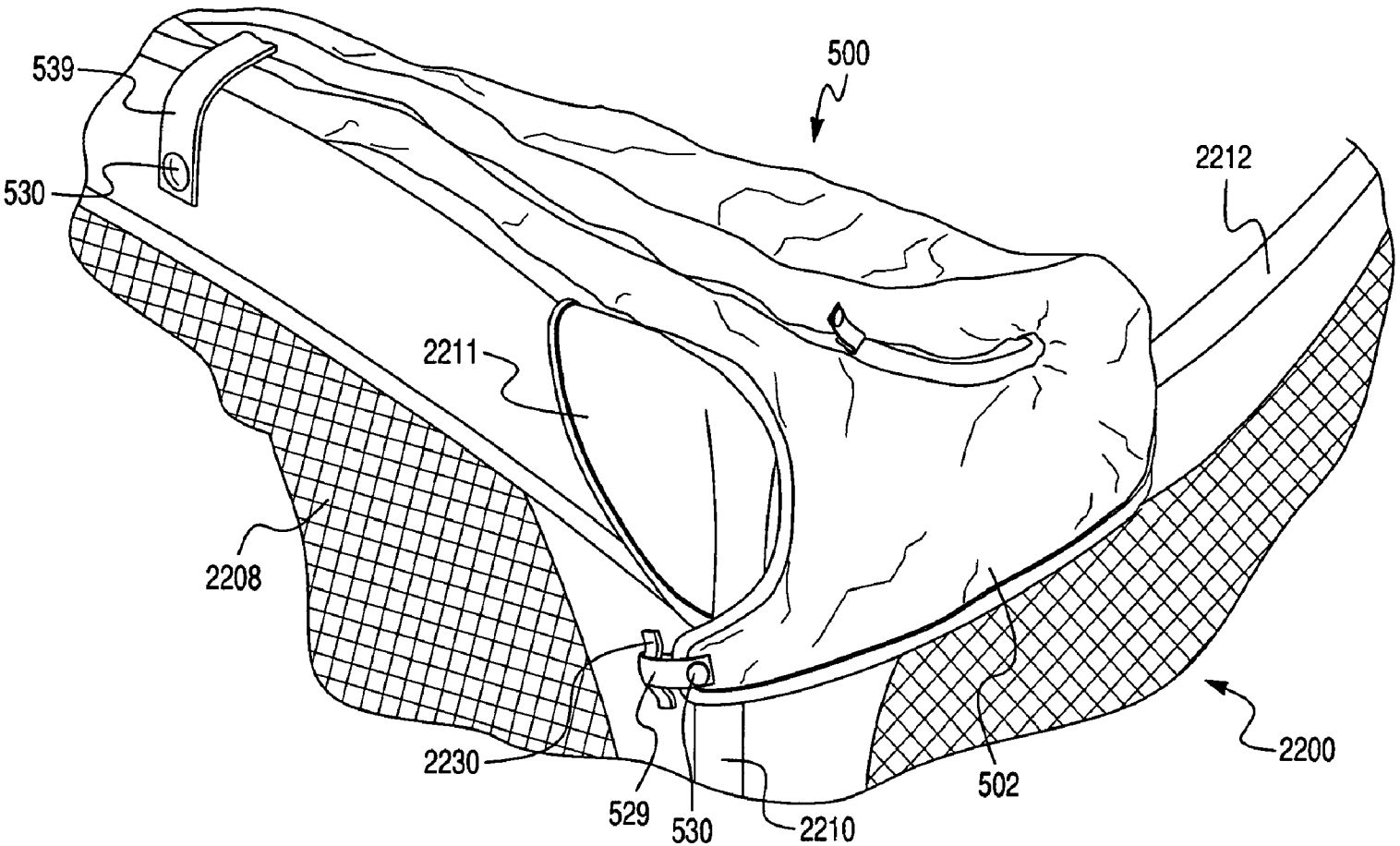
FIG. 14C is a close-up perspective view of the changing table of FIG. 12 completely engaged to a playard in a storage position.
Figure 15:
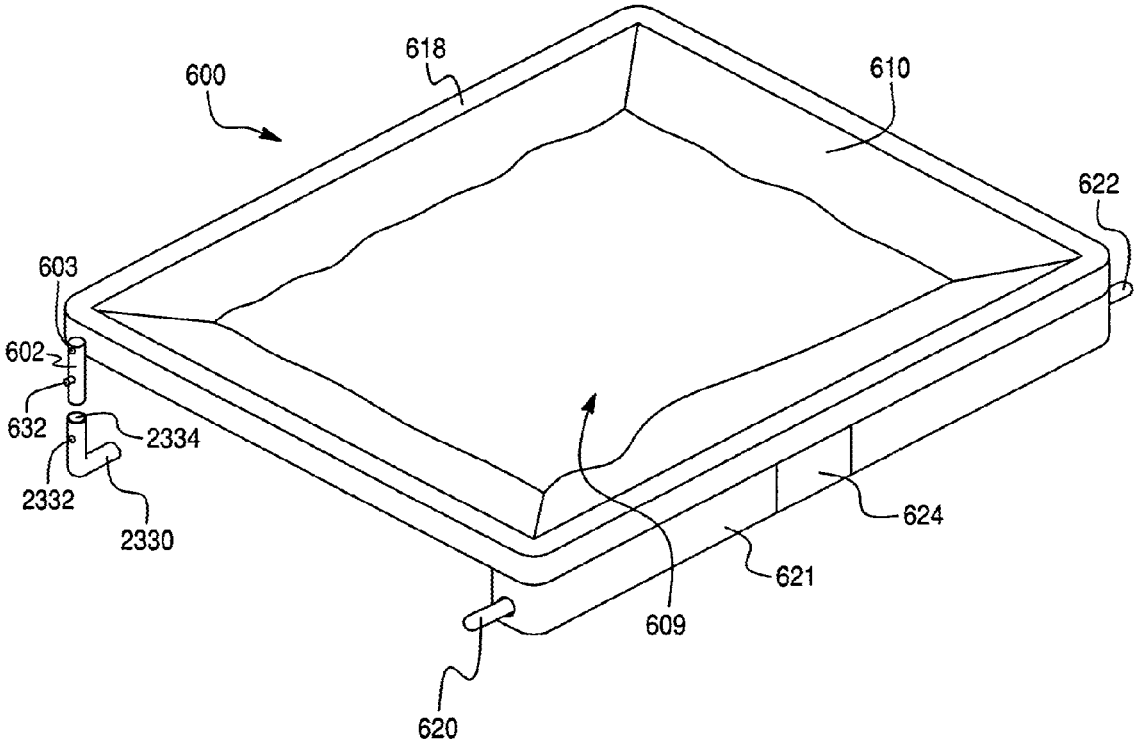
FIG. 15 is a perspective view of a fifth embodiment of a changing table that is configured to releasably and pivotally engage a playard.

A caregiver can move the platform 510 to a storage position. As with complete removal of the changing table 500, the fastener straps 529 of the side panels 502, 506 are unfastened. Similarly, the c-clips (e.g., 522) of the first two support structure members (e.g., 516) are released from the corresponding side rails (e.g., 2212) of the playard 2200. At this time, the first two support structure members (e.g., 516) can be placed on an upper surface of the platform 510, and the platform 510 can be folded toward the end rail 2218 to a storage position, as shown in FIG. 14C.

The changing table 500 may be releasably maintained in the storage position by engaging another fastener (e.g., a snap, Velcro®, buckle, etc) mounted to a strap 539 that extends from the platform 510 with a corresponding fastener 540 on an outer side of the endwall 2208 of the playard 2200. In the illustrated embodiment, the fastener strap 539 can include a female snap member 530 that is configured to engage a male snap member positioned on the exterior of the endwall 2208 of the playard 2200.

The number of c-clips 522 and/or fastener straps 529 may vary, while enabling the resultant changing table to retain the functionality of the changing table 500 shown in FIGS. 12, 13, 14A-14C. Moreover, an alternate embodiment could include only fastener straps 529 and no c-clips 522. Another alternate embodiment could include only c-clips 522 and no fastener straps 529. In addition, the c-clips may be configured to simply rest on top of the playard top rails, in which case the fastener straps 529 would maintain the changing table 500 to the playard 2200 upon application of a force of 25 pounds or less. In each of these alternative embodiments, the changing table mounts are designed to ensure that the changing table can withstand an upward or outward force of 25 pounds or less, without disengaging the changing table from the playard.

FIGS. 15-17 and 18A-18B are illustrative of another changing table embodiment according to the present invention that is configured to be releasably engaged to a playard 2300. In this embodiment, the changing table 600 is configured to be releasably and pivotally engaged to the playard 2300. Although only one side of the changing table 600 and the playard 2300 may be shown in particular figures, it is to be understood that the other side of the changing table 600 and the playard 2300 are the mirror image of the side that is shown. Accordingly, whereas various features of the changing table 600 and the playard 2300 are shown and described, it is to be understood that mirror images of those features are provided on the opposite side of the changing table 600 and the playard 2300.

The changing table 600 includes a platform 610, which is sized to support a child, and a support structure 618 to which the platform 610 is coupled. The support structure 618 can be generally rectangular in shape, and the platform 610 can be suspended from the support structure 618 such that a concave child changing area 609 is formed. The platform 610 can be formed of a fabric material, such as vinyl or polyester, or other material (or combination of materials) that is strong enough to support a child's weight.

The changing table 600 is releasably engaged to the playard 2300. Accordingly, a caregiver can remove the changing table 600 from the playard 2300 when the caregiver wants to collapse the playard 2300 for storage or travel. In this regard, the changing table 600 includes changing table mounts that can releasably engage the playard 2300. The changing table mounts of this embodiment can include two depending pivot legs 602 (only one of which is shown).

Figure 16:
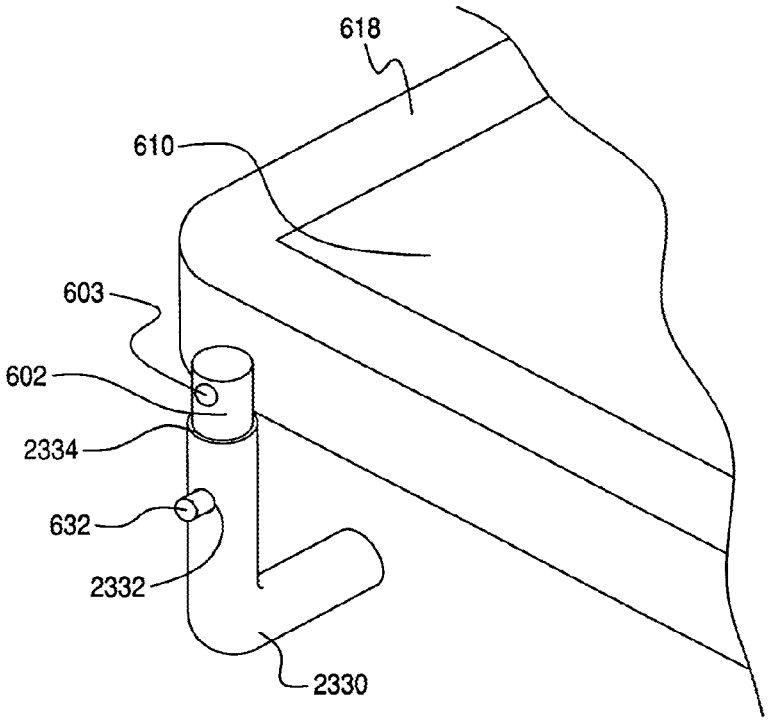
FIG. 16 is a close-up perspective view of a changing table mount of the changing table of FIG. 15 and a corresponding housing of a playard, the view illustrating a pivot joint of the changing table mount.
Figure 17:
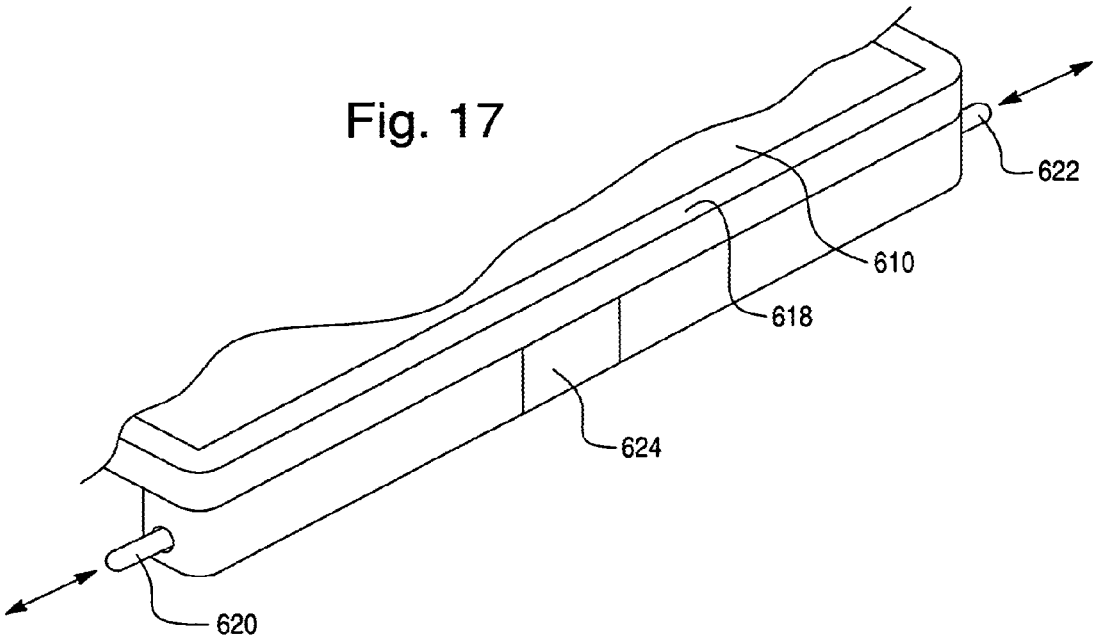
FIG. 17 is another close-up perspective view of a changing table mount of the changing table of FIG. 15, the view illustrating that the changing table mount includes spring-actuated fasteners.
Figure 18A:
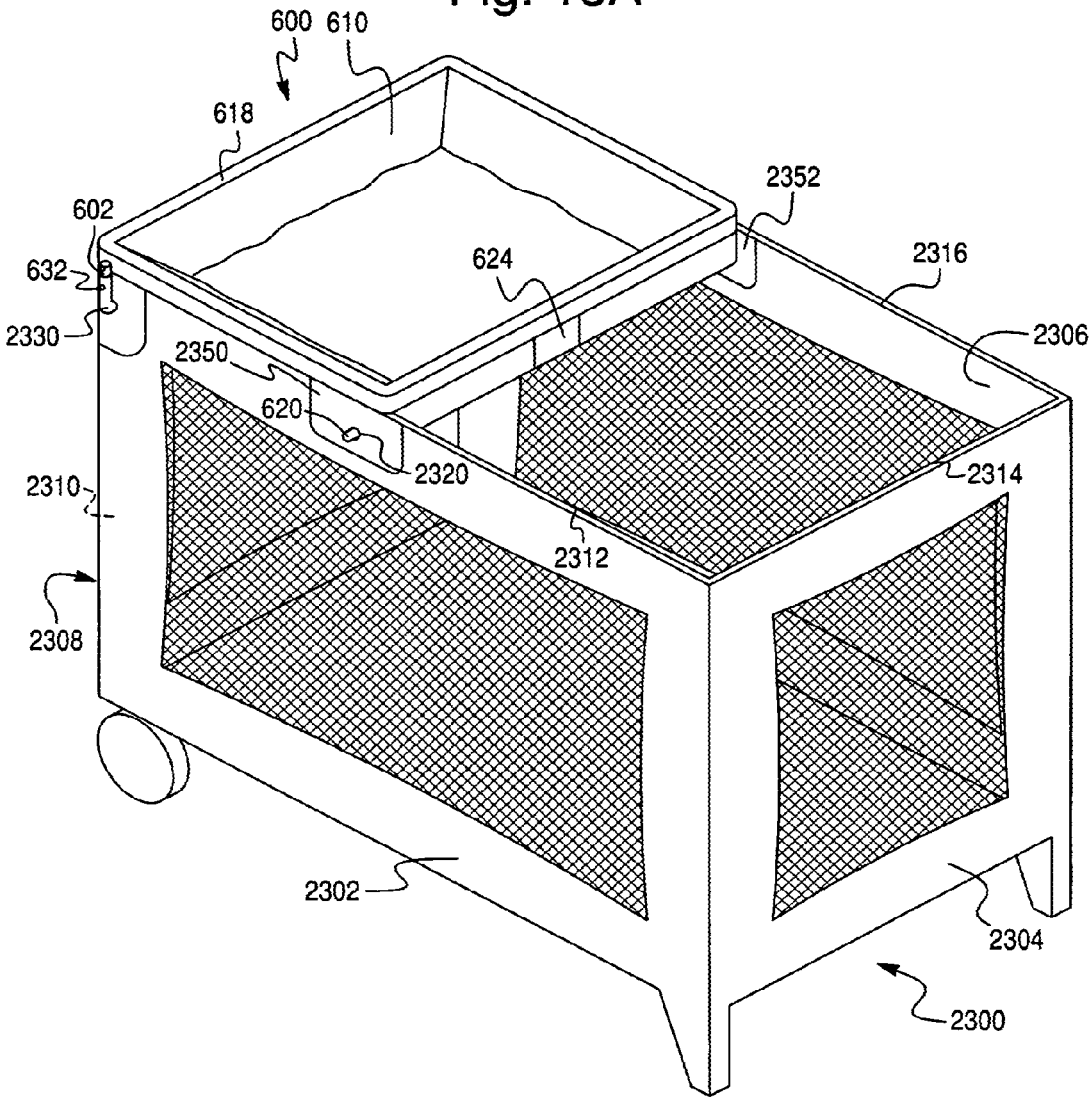
FIG. 18A is a perspective view of the changing table of FIG. 15 attached to a playard, the view illustrating the changing table in an in-use position.
Figure 18B:
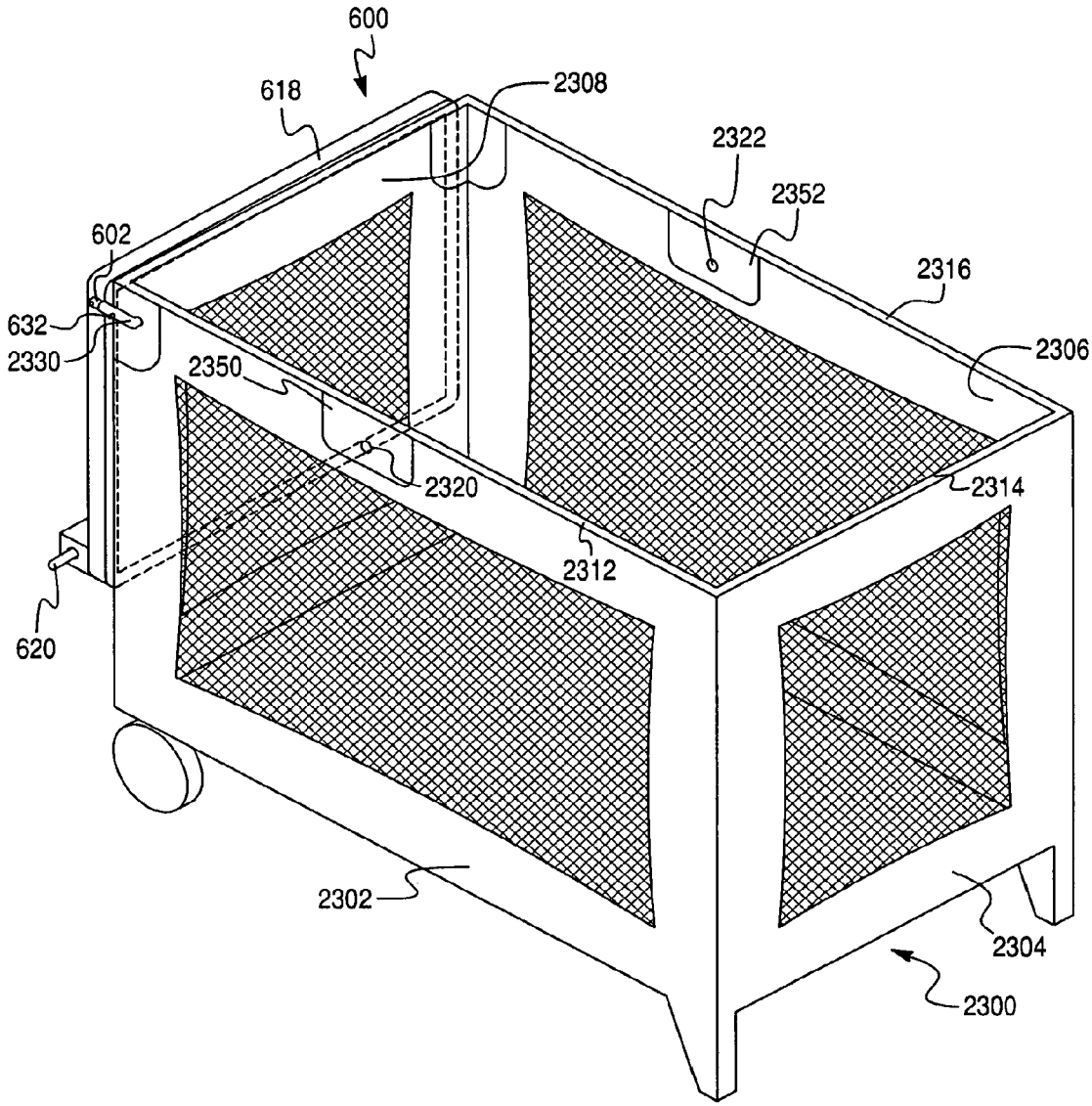
FIG. 18B is a perspective view of the changing table of FIG. 15 attached to the playard of FIG. 18A, the view illustrating the changing table in a storage position.

The lower ends of the pivot legs 602 may include release actuators. The release actuators can be fasteners such as spring-actuated Valco® buttons 632 that project outwardly from the legs 602. The spring-actuated Valco® buttons 632 are configured to releasably engage the playard 2300. Specifically, when the spring-actuated Valco® buttons 632 are depressed inwardly into the pivot legs 602, the pivot legs 602 are configured to be received in sockets 2334 formed in respective pivot housings 2330 that are themselves pivotally coupled to corner posts 2310 of the playard 2300. When the legs 602 are fully received in the sockets 2334, the spring-actuated Valco® buttons 632 can spring outwardly through holes 2332 formed in the sides of the housings 2330, as shown in FIG. 16.

If the caregiver wanted to completely remove the changing table 600 from the playard 2300, the caregiver can depress inwardly the spring-actuated Valco® buttons 632 into the legs 602, and the legs 602 can be pulled out of the housings 2330. This releaseable engagement of the changing table 600 and the playard 2300 enables the changing table 600 to be completely removed from the playard 2300, if desired.

In addition to being releasably engaged to the playard 2300, the changing table 600 is also pivotally engaged with the playard 2300. In this regard, the platform 610 of the changing table 600 may rotate between an in-use position (FIG. 18A) and a storage position (FIG. 18B) adjacent an exterior side of an endwall 2308 of the playard 2300. To enable movement between the in-use and storage positions, the legs 602 are pivotally connected to the support structure 618 by means of pivot pins 603, which are configured to rotate at least 270° with respect to the support structure 618. In other words, the movement between the in-use position and the storage position is enabled by the pivoting nature of the pivot housing 2330 and the pivoting nature of the pivot pin 603. As the platform 610 rotates 270° from the in-use position to the storage position, the pivot housing 2330 rotates 90°, i.e., the pivot pin 603 enables the pivot housing 2330 to invert its orientation with respect to the support structure 618.

The changing table 600 can include a lock mechanism configured to maintain the platform 610 in the in-use position. The lock mechanism can include a locking block 621, spring-biased fasteners 620, 622 (which may, as shown, be in the form of pins), a lock actuator handle 624, and cords (not shown) that connect the fasteners 620, 622 to the lock actuator handle 624. The fasteners 620, 622 are spring-biased out of the locking block 621.

To maintain the platform 610 in the in-use position (FIG. 18A), the spring-biased fasteners 620, 622 can engage sockets 2320, 2322 formed in housings 2350, 2352 provided in, or below, the top side rails 2312, 2316 of the playard 2300. Specifically, to engage the spring-biased fasteners 620, 622 and the sockets 2320, 2322, a caregiver can lift upwardly on the lock actuator handle 624, thereby retracting the spring-biased fasteners 620, 622 into a release position in the locking block 621. Subsequently, the platform 610 can be lowered into the in-use position, and the lock actuator handle 624 can be released. When the lock actuator handle 624 is released, the spring-actuated fasteners 620, 622 can move outwardly (under the force of the spring bias) into a lock position in which the fasteners 620, 622 are engaged in the sockets 2320, 2322 formed in the housings 2350, 2352.

To retract the spring-biased fasteners 620, 622 into the locking block 621 to enable pivoting of the platform 610 to the storage position, the lock actuator handle 624 again can be pulled, i.e., lifted upwardly. By pulling on the lock actuator handle 624, the cords within the locking block 621 inwardly pull the fasteners 620, 622 against the bias of their associated springs. When the fasteners 620, 622 are retracted, the platform 610 is able to rotate about the pivot housings 2330 and pivot pins 603.

The combination of the spring-biased fasteners 620, 622 (and associated sockets 2320, 2322) and spring-actuated Valco® buttons 632 (and associated holes 2332) enables the changing table 600 to withstand an upward or outward force of 25 pounds or less applied to the platform 610, without disengaging from the playard 2300. In this embodiment, the changing table 600 can remain engaged with the playard 2300 when a force of 25 pounds or less is applied anywhere on the changing table 600 other than the spring-actuated Valco® buttons 632 of the changing table mount and/or the lock actuator handle 624 of the lock mechanism. Accordingly, if a child, who is positioned in the playard 2300, inadvertently bumps or pushes the changing table 600 upwardly or outwardly with a force of 25 pounds or less, the changing table 600 will remain engaged to the playard 2300.

Figure 19:
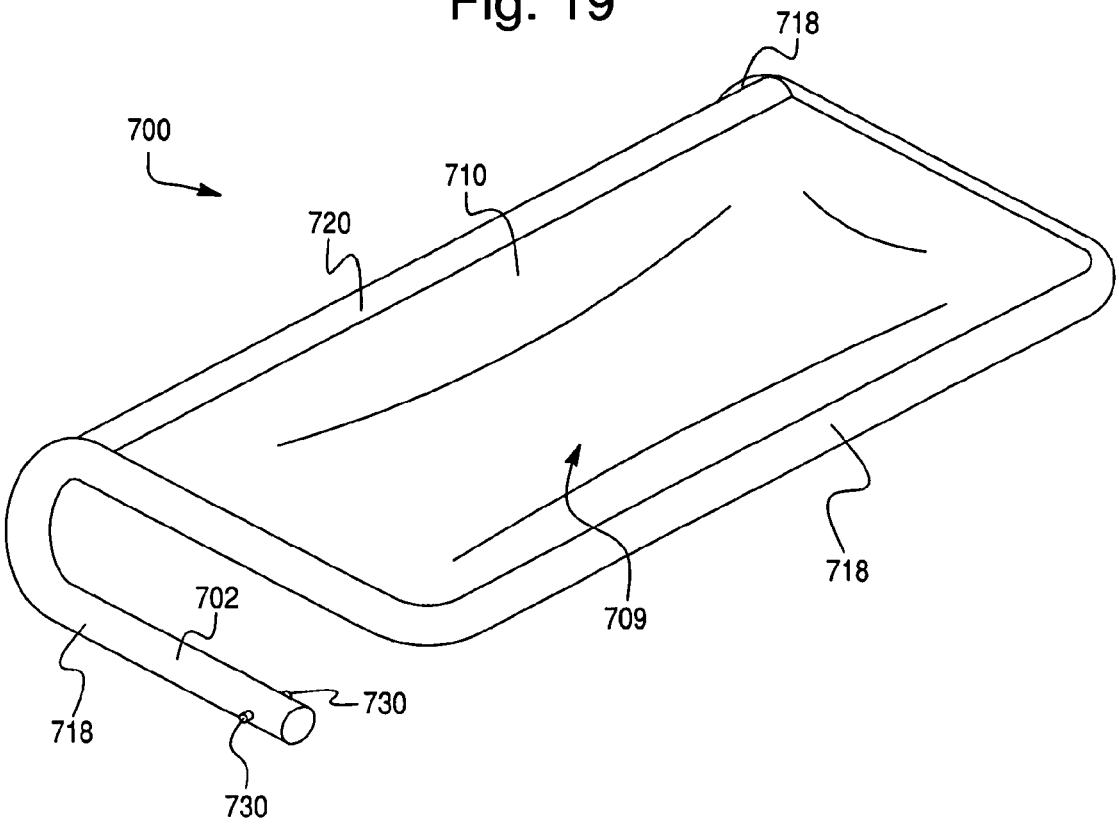
FIG. 19 is a perspective view of a sixth embodiment of a changing table that is configured to releasably engage a playard.
Figure 20:
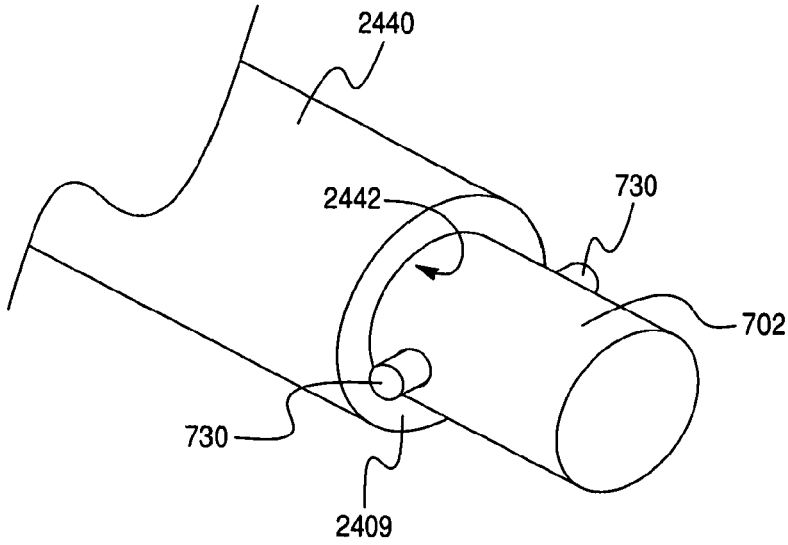
FIG. 20 is a close-up perspective view of a changing table mount of the changing table of FIG. 19 and a housing of a playard that is configured to receive the changing table mount, the view showing that the changing table mount includes spring-actuated fasteners.
Figure 21:
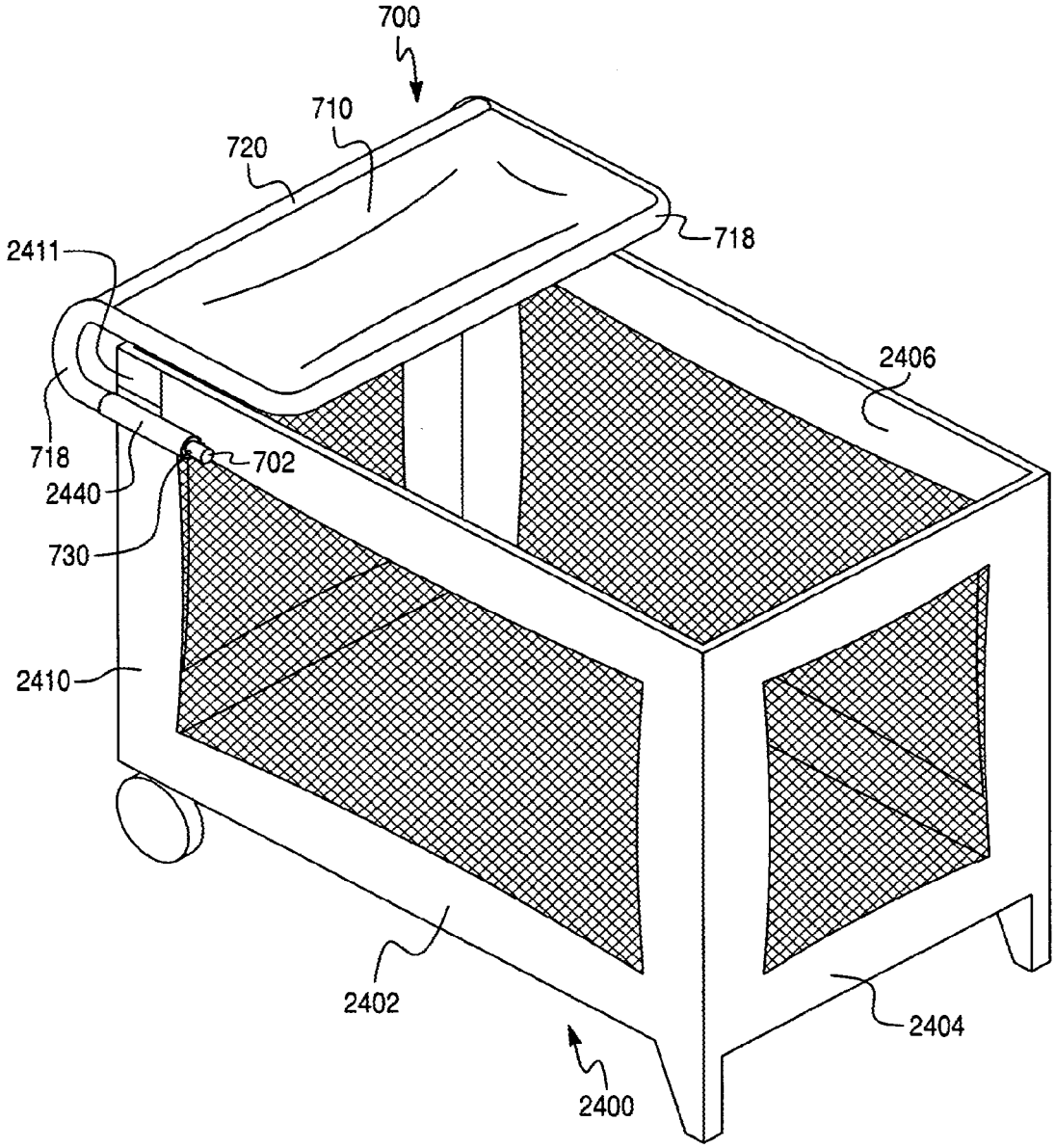
FIG. 21 is perspective view of the changing table of FIG. 19 attached to a playard.
Figure 22:
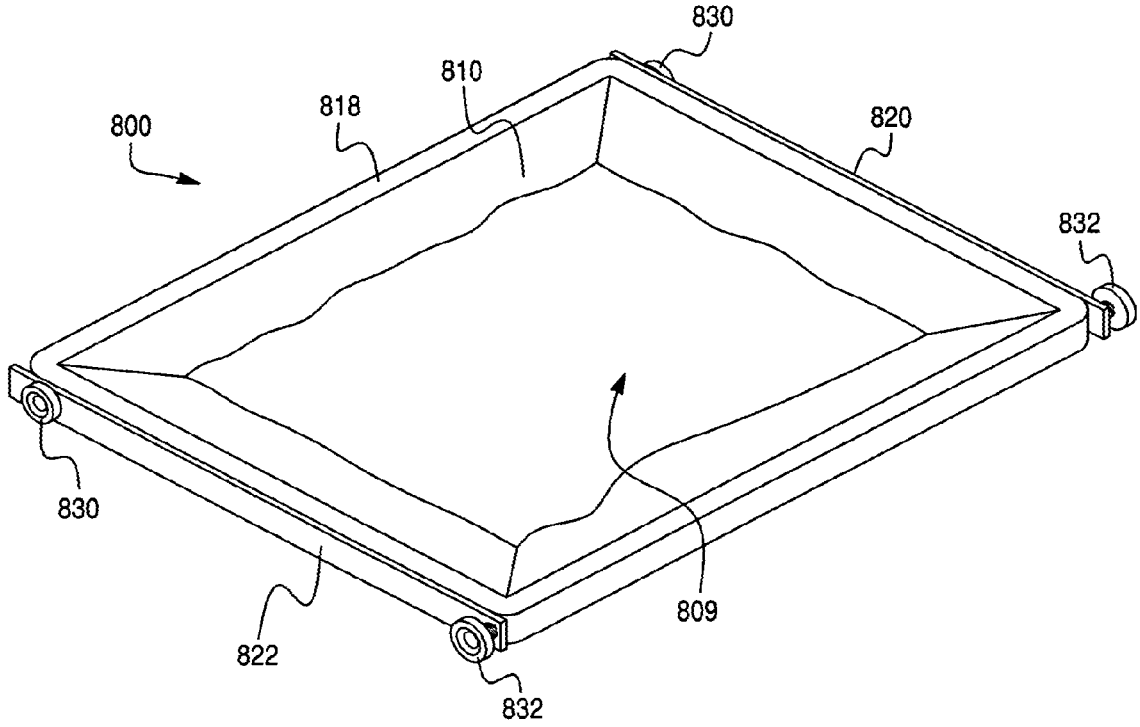
FIG. 22 is a perspective view of a seventh embodiment of a changing table that is configured to releasably engage a playard.

FIGS. 19-21 are representative of another changing table embodiment according to the present invention that is configured to be releasably engaged to a playard 2400. Although only one side of the changing table 700 and the playard 2400 may be shown in particular figures, it is to be understood that the other side of the changing table 700 and the playard 2400 are the mirror image of the side that is shown. Accordingly, whereas various features of the changing table 700 and the playard 2400 are shown and described, it is to be understood that mirror images of those features are provided on the opposite side of the changing table 700 and the playard 2400.

The changing table 700 includes a platform 710, which is sized to support a child, and a support structure to which the platform 710 is coupled. The support structure can be generally rectangular in shape. The platform 710 can be suspended from the support structure such that a concave child changing area 709 is formed. The platform 710 can be formed of a fabric material, such as vinyl or polyester, or other material (or combination of materials) that is strong enough to support a child's weight. The support structure can include first and second beams 718, 720. The first beam 718 can have three generally U-shaped portions, two of which are parallel to each other and perpendicular to the third. The first two U-shaped portions can be sized to determine the height of the platform 710 above the playard 2400. The second beam 720 connects the otherwise open end of the perpendicular third U-shaped portion, thereby providing a defined perimeter for the platform 710.

The changing table 700 is releasably engaged to the playard 2400. Accordingly, a caregiver can remove the changing table 700 from the playard 2400 when the caregiver wants to collapse the playard 2400 for storage or travel. In this regard, the changing table 700 includes changing table mounts that can releasably engage the playard 2400. The changing table mounts of this embodiment can include legs 702, which may, as shown, be formed as part of the support structure 718, 720. More specifically, the changing table mounts are in the form of legs 702 that are integrally formed as parts of the first beam 718.

Each of the legs 702 includes one or more release actuators. The release actuators can be fasteners such as spring-actuated Valco® buttons 730. The legs 702 are configured to be received in sockets 2442 formed in housings 2440. The housings 2440 are connected to corner brackets 2411 of the playard 2400 and extend along exteriors of the sidewalls 2402, 2406 of the playard 2400. Alternatively, the housings 2440 could be connected to the corner posts 2410 of the playard 2400.

More specifically, the sockets 2442 are sized to receive the legs 702 of the changing table 700, when the spring-actuated Valco® buttons 730 are inwardly depressed into the legs 702. As a result, the legs 702 may pass through the sockets 2442 of the housings 2440 until the spring-actuated Valco® buttons 730 are free to outwardly spring past end surfaces 2309 of the housings 2440, as shown in FIG. 20. When the spring-actuated Valco® buttons 730 snap behind the end surfaces 2409 of the housings 2440, the changing table is releasably engaged to the playard 2400, as shown in FIG. 21. The changing table 700 may be released from the playard 2400 by depressing inwardly the spring-actuated Valco® buttons 730 until they clear the end surfaces 2409 of the housings 2440, and simultaneously pulling the legs 702 outwardly through the housings 2440.

This releaseable engagement of the changing table 700 and the playard 2400 enables the changing table 700 to be completely removed from the playard 2400, if desired. Moreover, the rigidity of the spring-actuated Valco® buttons 730 and the housings 2440 not only enables the engagement of the changing table 700 to the playard 2400 to be releasable, it also enables the changing table 700 to withstand an upward or outward force of 25 pounds or less applied to the platform 710, without disengaging from the playard 2400. In this embodiment, the changing table 700 can remain engaged with the playard 2400 when a force of 25 pounds or less is applied anywhere on the changing table 700 other than the spring-actuated Valco® buttons 732 of the changing table mount. Accordingly, if a child, who is positioned in the playard 2400, inadvertently bumps or pushes the changing table 700 upwardly or outwardly with a force of 25 pounds or less, the changing table 700 will remain engaged to the playard 2400.

FIGS. 22-23 and 24A-24B illustrate another changing table embodiment according to the present invention that is configured to be releasably engaged to a playard 2500. Although only one side of the changing table 800 and the playard 2500 may be shown in particular figures, it is to be understood that the other side of the changing table 800 and the playard 2500 are the mirror image of the side that is shown. Accordingly, whereas various features of the changing table 800 and the playard 2500 are shown and described, it is to be understood that mirror images of those features are provided on the opposite side of the changing table 800 and the playard 2500.

The changing table 800 includes a platform 810, which is sized to support a child, and a general rectangular and rigid support structure 818 to which the platform 810 is coupled. The platform 810 can be suspended from the support structure 818 such that a concave child changing area 809 is formed. The platform 810 can be formed of a fabric material, such as vinyl or polyester, or other material (or combination of materials) that is strong enough to support a child's weight.

The changing table 800 is releasably engaged to the playard 2500. Accordingly, a caregiver can remove the changing table 800 from the playard 2500 when the caregiver wants to collapse the playard 2500 for storage or travel. In this regard, the changing table 800 includes changing table mounts that can releasably engage the playard 2500. The changing table mounts of this embodiment can include rails 820, 822 that are connected to opposite sides of the support structure 818.

Figure 23:
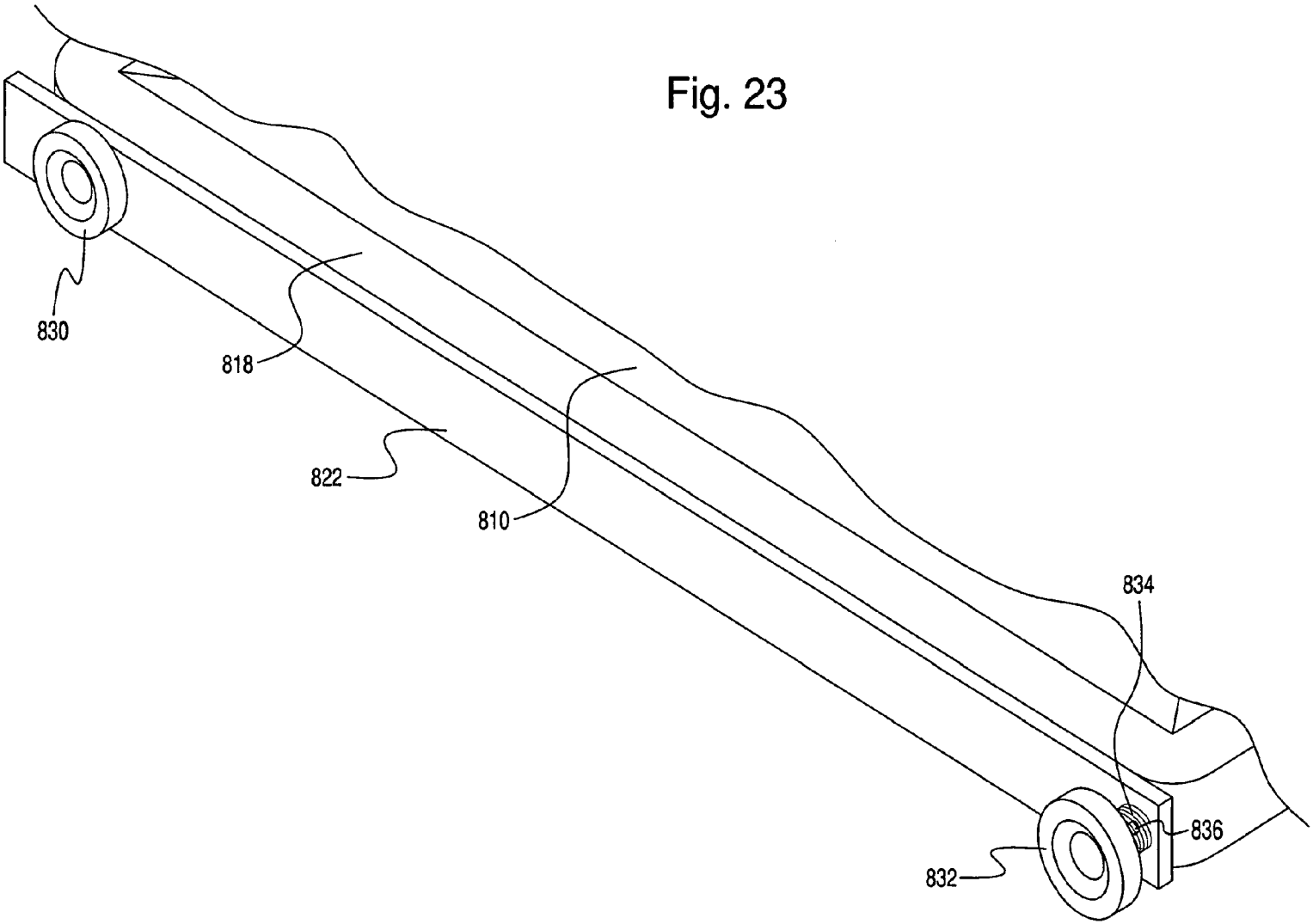
FIG. 23 is a close-up perspective view of a changing table mount of the changing table of FIG. 22, the view illustrating a rail of the changing table mount that is configured to slide within a track formed on an upper surface of a playard.

Each of the rails 820, 822 includes a passive wheel 830 and a spring-biased wheel 832 that acts as a release actuator. The passive wheels 830 are configured to rotate freely on axles (not shown). On the other hand, although the spring-biased wheels 832 are also rotatable about axles 836, the wheels 832 include springs 834 that outwardly bias the wheels 832 along the axles 836, as shown in FIG. 23.

Figure 24A:
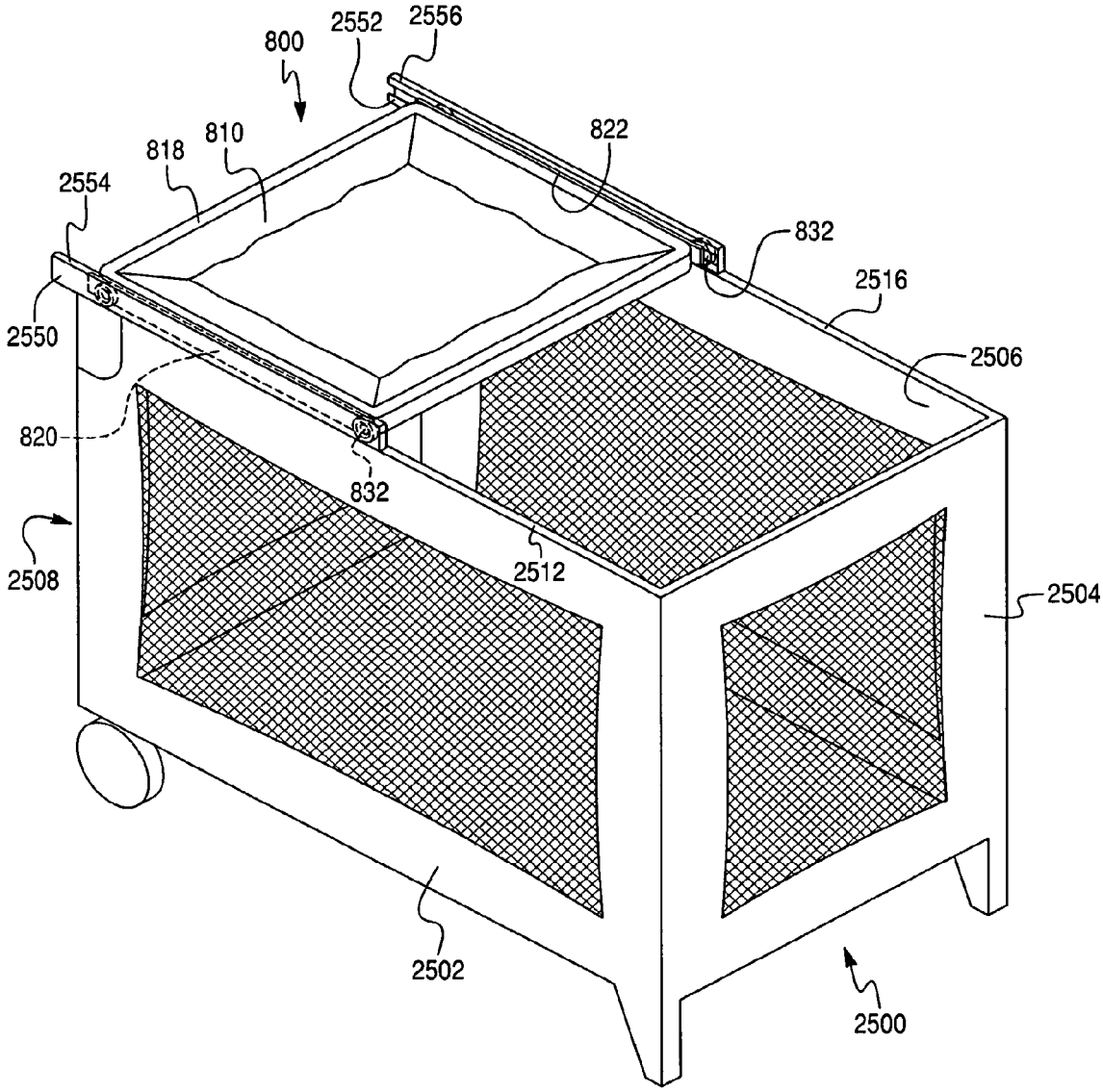
FIG. 24A is a perspective view of the changing table of FIG. 22 attached to a playard, the view illustrating the changing table in an in-use position.
Figure 24B:
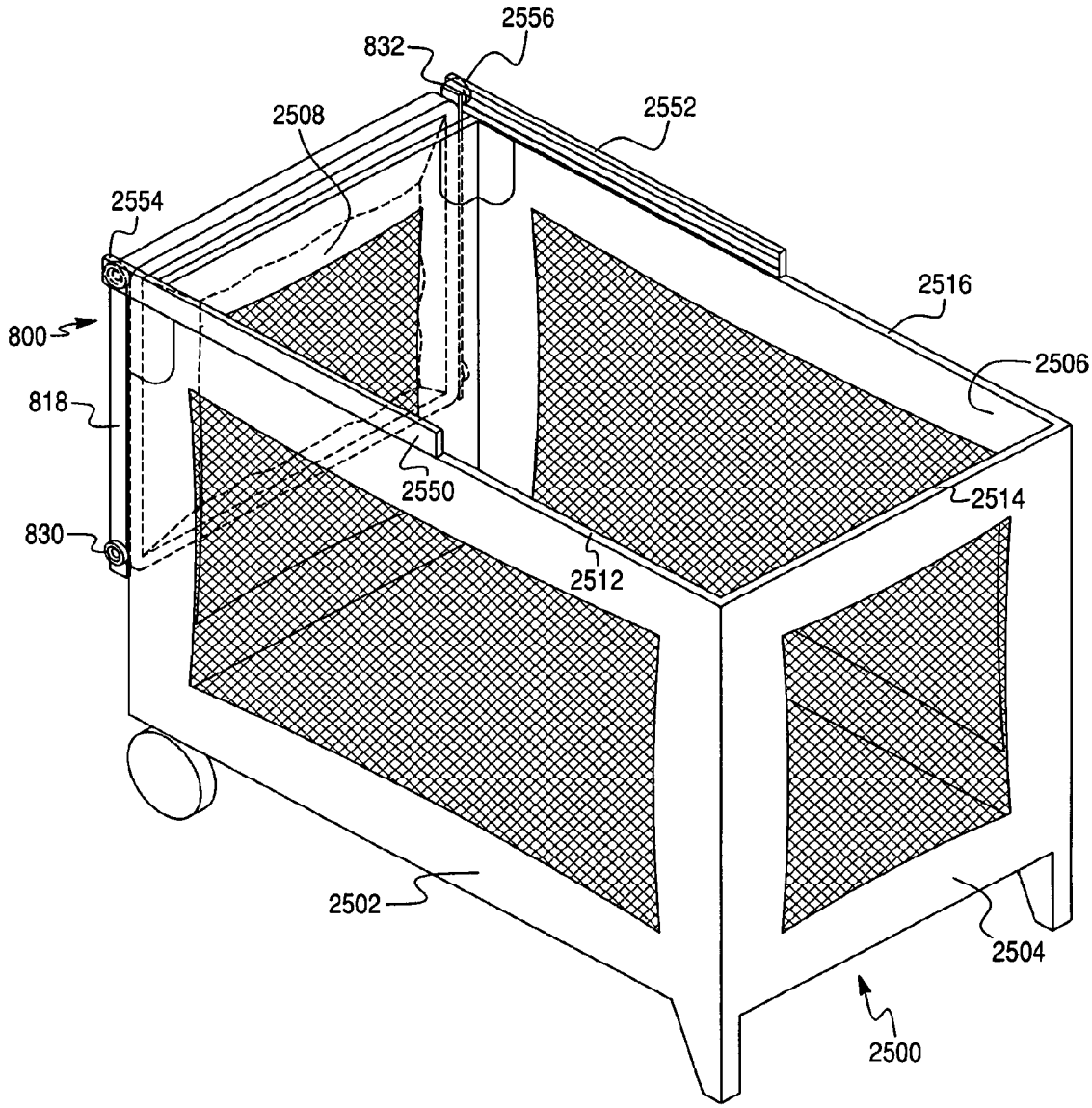
FIG. 24B is a perspective view of the changing table of FIG. 22 attached to the playard of FIG. 24A, the view illustrating the changing table in a storage position.
Figure 25:
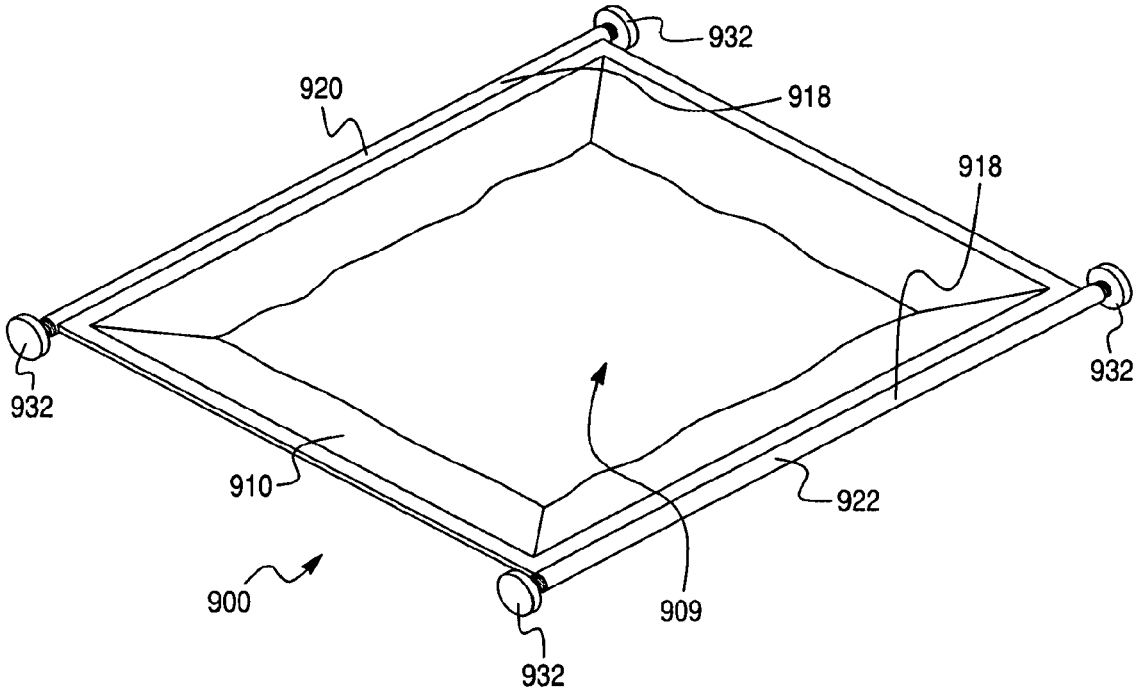
FIG. 25 is a perspective view of an eighth embodiment of a changing table that is configured to releasably and slidably engage a playard.
Figure 26:
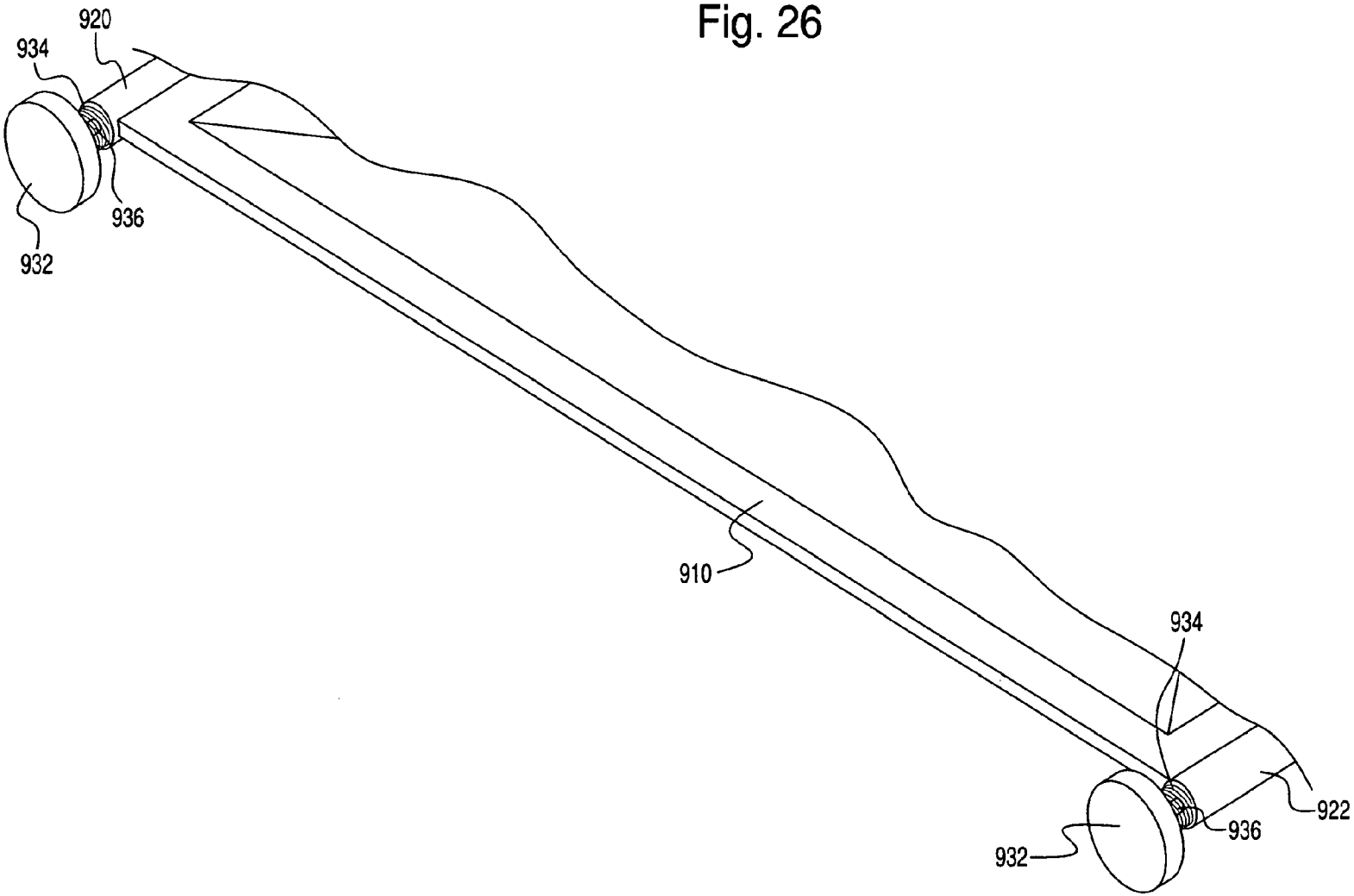
FIG. 26 is a close-up perspective view of a changing table mount of the changing table of FIG. 25, the view illustrating that the changing table mount includes two rails that are configured to slide within tracks formed on an upper surface of a playard.

As shown in FIG. 24A, the rails 820, 822 of the changing table 800 may be received by tracks 2550, 2552 that are formed on top rails 2512, 2516 of sidewalls 2502, 2506 of a playard 2500. The longitudinal axes of the rails 820, 822 and longitudinal axes of the tracks 2550, 2552 are substantially parallel.

To position the rails 820, 822 of the changing table 800 in the tracks 2550, 252 of the playard 2500, the spring-biased wheels 832 can be inwardly depressed (i.e., the springs 836 can be compressed) so that the wheels 832 will align with the tracks 2550, 2552. After the spring-biased wheels 832 are received in the tracks 2550, 2552, the remainder of the changing table 800 may slide, by means of the rails 820, 822, along and relative to the tracks 2550, 2552. Moreover, as the passive wheels 830 are not spring biased, when they reach the tracks 2550, 2552, the passive wheels 830 will be readily received in the tracks 2550, 2552. When the rails 820, 822 of the changing table 800 are fully received in the tracks 2550, 2552, the changing table 800 and its platform 810 will be in the in-use position shown in FIG. 25A.

To move the platform 810 from the in-use position to a storage position, the caregiver may pull outwardly the support structure 818 toward the endwall 2508 until such point that only the spring-biased wheels 832 remain within extensions 2554, 2556 of the tracks 2550, 2552. When the spring-biased wheels 832 are within the extensions 2554, 2556, the support structure 818 of the changing table 800 may be lowered alongside an exterior of an endwall 2508 of the playard 2500, until the changing table 800 and the platform 810 are positioned in the storage position shown in FIG. 24B. Moreover, the platform 810 may remain in the storage position as a result of the spring-biased nature of the spring-biased wheels 832, which are outwardly biased against the tracks 2550, 2552.

A caregiver may completely remove the changing table 800 from the playard 2500, rather than position it in the storage position. To remove the changing table 800, the caregiver initially can slide the changing table 800 along the tracks 2550, 2552 until the spring-biased wheels 832 are positioned in the extensions 2554, 2556 of the tracks 2550, 2552. The extensions 2554, 2556 can include holes (not shown) through which a caregiver can access the wheels 832. The caregiver can inwardly depress the spring-biased wheels 832 along the axles 836, thereby releasing the wheels 832 (and, therefore, the changing table 800) from the tracks 2550, 2552. This releasable engagement of the changing table 800 and the playard 2500 enables the changing table 800 to be completely removed from the playard 2500, if desired.

The engagement between the rails 820, 822 and the tracks 2550, 2552 enables the changing table 800 to withstand an upward or outward force of 25 pounds or less applied to the platform 810, without disengaging from the playard 2500. In this embodiment, the changing table 800 can remain engaged with the playard 2500 when a force of 25 pounds or less is applied anywhere on the changing table 800 other than the spring-biased wheels 832 of the changing table mount. Accordingly, if a child, who is positioned in the playard 2500, inadvertently bumps or pushes the changing table 800 upwardly or outwardly with a force of 25 pounds or less, the changing table 800 will remain engaged to the playard 2500.

As an alternative to the previously described tracks 2550, 2552, each track could be formed as a two piece track system having a top-half track and a bottom-half track that can be screwed together around the wheels 830, 832. In yet another embodiment, the wheels could be shaped so the playard top rails could function as bottom-half tracks, and top-half tracks could be mounted to the playard top rails with the wheels therebetween.

As another alternative, the wheels 830, 832 of the changing table 800 both can be spring-biased wheels that can be actuated to release the wheels 830, 832 from the tracks 2550, 2552. The tracks 2550, 2552 also can include a set of detents to keep the wheels 830, 832 properly positioned in the tracks 2550, 2552. For example, the tracks 2550, 2552 could include detents in the track extensions 2554, 2556 so that the wheels 830, 832 would not inadvertently be disengaged from the tracks 2550, 2552, unless purposefully maneuvered out of the tracks 2550, 2552 by a caregiver.

FIGS. 25-26 and 27A-27B illustrate another changing table that is configured to be releasably engaged to a playard 2600. Although only one side of the changing table 900 and the playard 2600 may be shown in particular figures, it is to be understood that the other side of the changing table 900 and the playard 2600 are the mirror image of the side that is shown. Accordingly, whereas various features of the changing table 900 and the playard 2600 are shown and described, it is to be understood that mirror images of those features are provided on the opposite side of the changing table 900 and the playard 2600.

The changing table 900 includes a flexible platform 910, which is sized to support a child, and a support structure 918 to which the platform 910 is coupled. The platform 910 can be suspended from the support structure 918 such that a concave child changing area 909 is formed, similar to a hammock. The platform 910 can be formed of a fabric material, such as vinyl or polyester, or other material (or combination of materials) that is strong enough to support a child's weight.

The changing table 900 is releasably engaged to the playard 2600. Accordingly, a caregiver can remove the changing table 900 from the playard 2600 when the caregiver wants to collapse the playard 2600 for storage or travel. In this regard, the changing table 900 includes changing table mounts that can releasably engage the playard 2600. The changing table mounts of this embodiment can include rails 920, 922 that define the support structure 918. Four spring-biased wheels 932 extend axially from rails 920, 922, i.e., axles 936 of the wheels 932 are aligned with longitudinal axes of the associated rails 920, 922. The spring-biased wheels 932 may, in each instance, act as a release actuator.

Figure 27A:
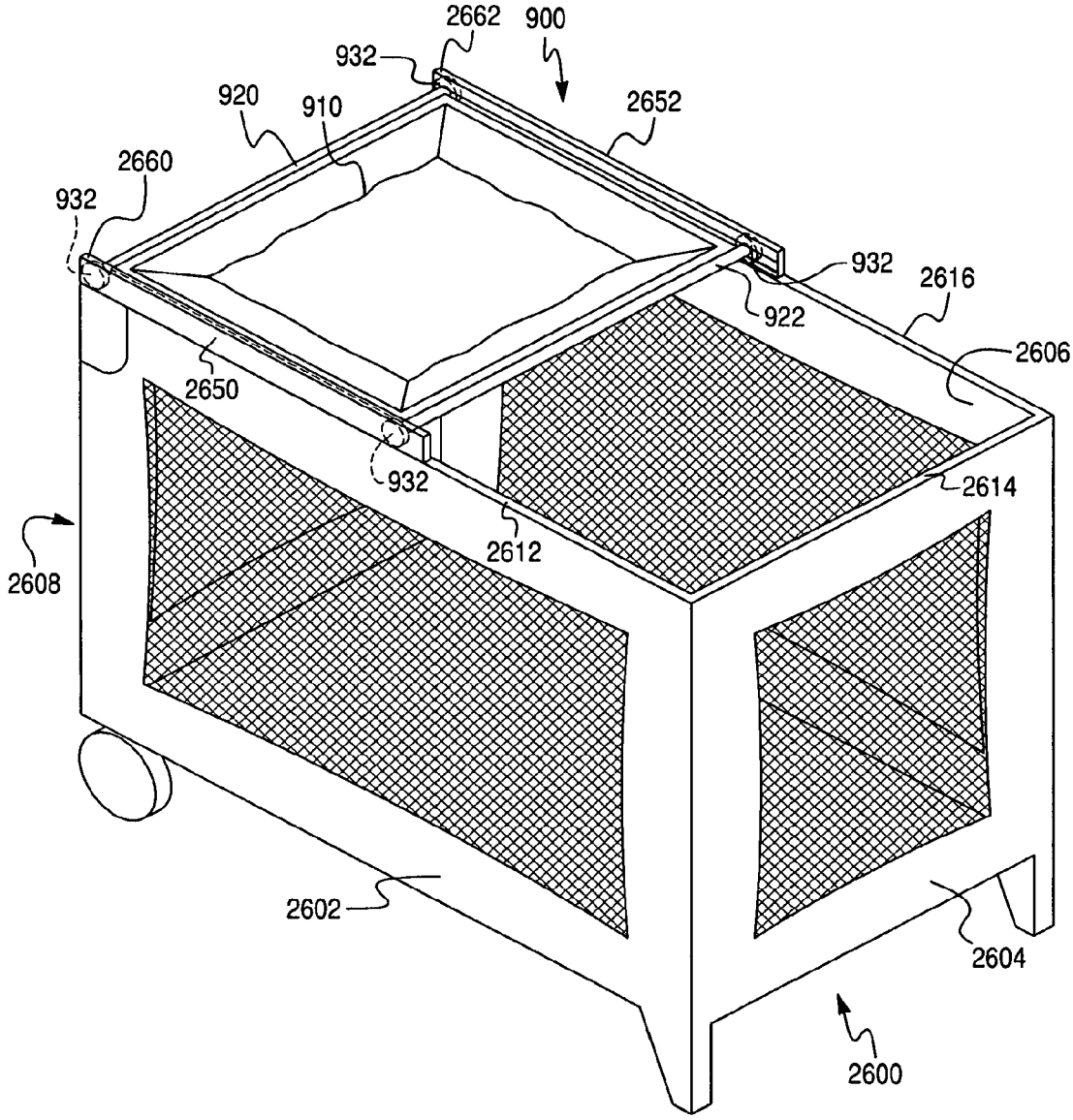
FIG. 27A is a perspective view of the changing table of FIG. 25 attached to a playard, the view illustrating the changing table in an in-use position.
Figure 27B:
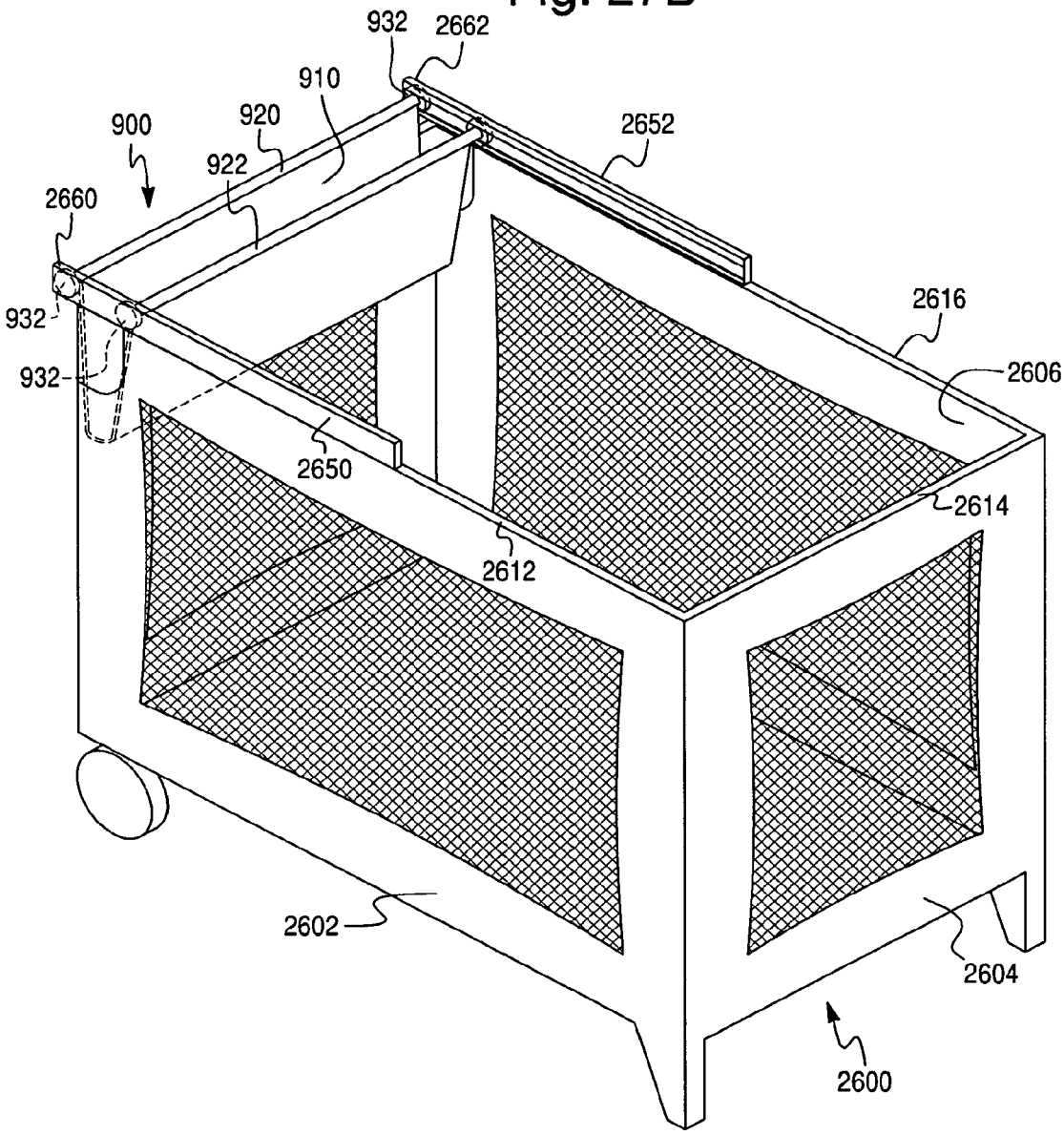
FIG. 27B is a perspective view of the changing table of FIG. 25 attached to the playard of FIG. 27A, the view illustrating the changing table in a storage position.

As a result of the spring-biased nature of the wheels 932, the springs 934 of each of the wheels 932 can be inwardly compressed along their axles 936, in order for the wheels 932 to be received within corresponding tracks 2650, 2652 formed on the top rails 2612, 2616 of a playard 2600. The wheels 932 are spring-loaded to bias them in an outward direction, insuring that the wheels 932 do not inadvertently disengage from the tracks 2650, 2652. As shown in FIGS. 27A-27B, the longitudinal axes of the rails 920, 922, and longitudinal axes of the tracks 2650, 2652 are substantially perpendicular.

As a result of the flexible nature of the platform 910, the rails 920, 922 can be separated along the tracks 2650, 2652 to move the platform 910 into an in-use position (as shown in FIG. 27A) or brought together along the tracks 2650, 2652 to move the platform 910 into a storage position (as shown in FIG. 27B).

A caregiver may completely remove the changing table 900 from the playard 2600, rather than position it in the storage position. To remove the changing table 900, the caregiver initially can slide the first rail 920 toward the endwall 2608 such that the spring-biased wheels that are axially affixed to the first rail 920 are positioned within extensions 2660, 2662 of the tracks 2650, 2652. The extensions 2660, 2662 can include holes (not shown) through which a caregiver can access the wheels 932. The caregiver can depress inwardly the spring-biased wheels 932 on rail 920 along their axles 936, thereby releasing the wheels 932 and the rail 910 from the tracks 2550, 2552. Thereafter, the second rail 922 can be slid such that the spring-biased wheels 932 that are axially affixed to the second rail 922 are positioned within the extensions 2660, 2662 of the tracks 2650, 2652. The caregiver then can depress inwardly the spring-biased wheels 932 along their axles 936, thereby releasing the wheels 932 and the second rail 920 (and, therefore, the changing table 900) from the tracks 2550, 2552. This releasable engagement of the changing table 900 and the playard 2600 enables the changing table 600 to be completely removed from the playard 2600, if desired.

When the platform 910 is in the in-use position, the engagement between the rails 920, 922 and the tracks 2650, 2652 enables the changing table 900 to withstand an upward or outward force of 25 pounds or less applied to the platform 910, without disengaging from the playard 2600. In this embodiment, the changing table 900 can remain engaged with the playard 2600 when a force of 25 pounds or less is applied anywhere on the changing table 900 other than the spring-biased wheels 932 of the changing table mount. Accordingly, if a child, who is positioned in the playard 2600, inadvertently bumps or pushes the changing table 900 upwardly or outwardly with a force of 25 pounds or less, the changing table 900 will remain engaged to the playard 2600.

As an alternative to the previously described tracks 2650, 2652, each track could be formed as a two piece track system having a top-half track and a bottom-half track that can be screwed together around the wheels 932. In yet another embodiment, the wheels could be shaped so the playard top rails could function as bottom-half tracks, and top-half tracks could be mounted to the playard top rails with the wheels therebetween.

As another alternative, the tracks 2650, 2652 also can include a set of detents to keep the wheels 932 properly positioned in the tracks 2650, 2652. For example, the tracks 2650, 2652 could include detents in the track extensions 2660, 2662 so that the wheels 932 would not inadvertently be disengaged from the tracks 2650, 2652, unless purposefully maneuvered out of the tracks 2650, 2652 by a caregiver.

As an alternative to forming tracks on the top rails of the playards 2500, 2600, the tracks can form part of the changing table mount of changing tables 800, 900. In such an alternative embodiment, the tracks on the changing tables 800, 900 can be mounted to the playard top rails.

FIGS. 28, 29, and 30A-30B depict another changing table embodiment that is configured to be releasably engaged to a playard 2700. Although only one side of the changing table 1000 and the playard 2700 may be shown in particular figures, it is to be understood that the other side of the changing table 1000 and the playard 2700 are the mirror image of the side that is shown. Accordingly, whereas various features of the changing table 1000 and the playard 2700 are shown and described, it is to be understood that mirror images of those features are provided on the opposite side of the changing table 1000 and the playard 2700.

The changing table 1000 includes a platform 1010, which is sized to support a child in a child changing area 1009. The platform 1010 can be formed of a rigid material, a flexible material (such as fabric or vinyl), or any combination of such materials. For example, the platform 1010 can be formed of a rigid material with a softgoods padding layer.

The changing table 1000 is releasably engaged to the playard 2700. Accordingly, a caregiver can remove the changing table 1000 from the playard 2700 when the caregiver wants to collapse the playard 2700 for storage or travel. In this regard, the changing table 1000 includes changing table mounts that can releasably engage the playard 2700. The changing table mounts of this embodiment can include projections 1032 that extend from two hingedly joined platform parts 1007, 1009 that define the platform 1010.

Figure 28:
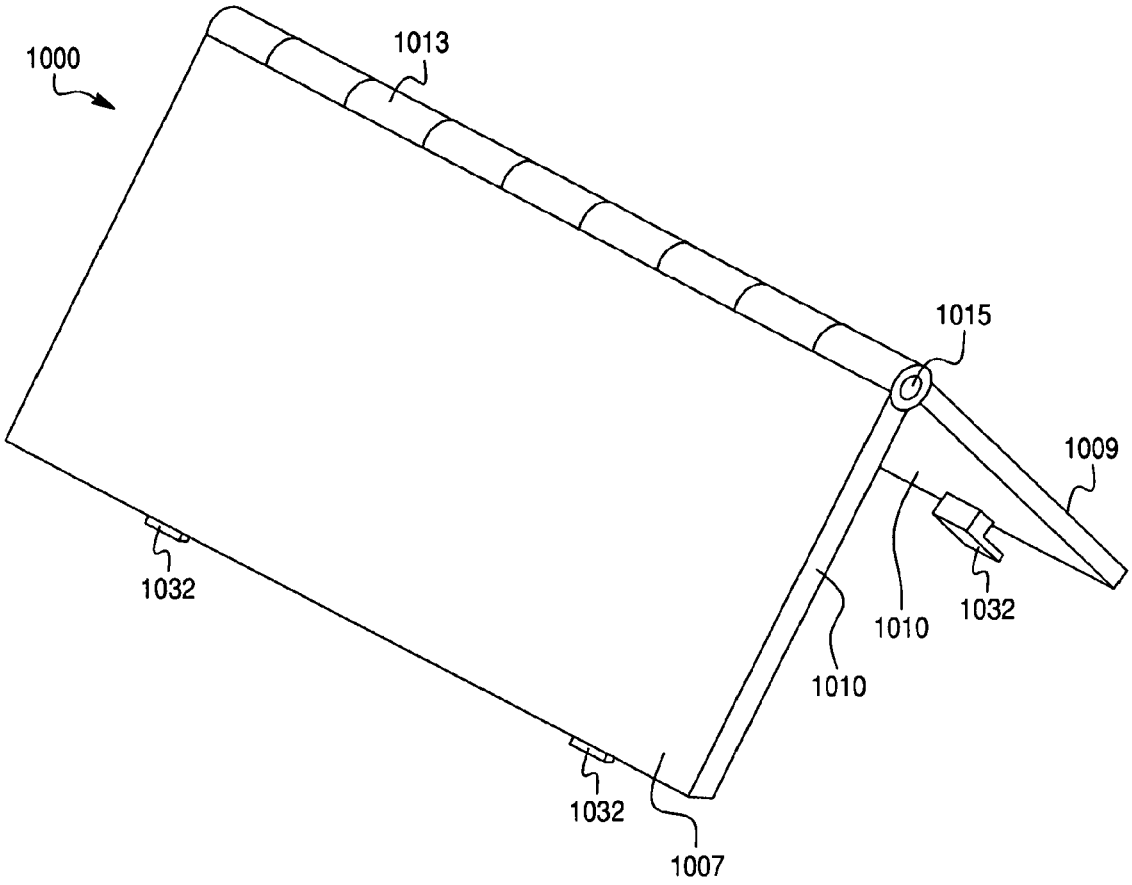
FIG. 28 is a perspective view of a ninth embodiment of a changing table that is configured to releasably engage a playard.
Figure 29:
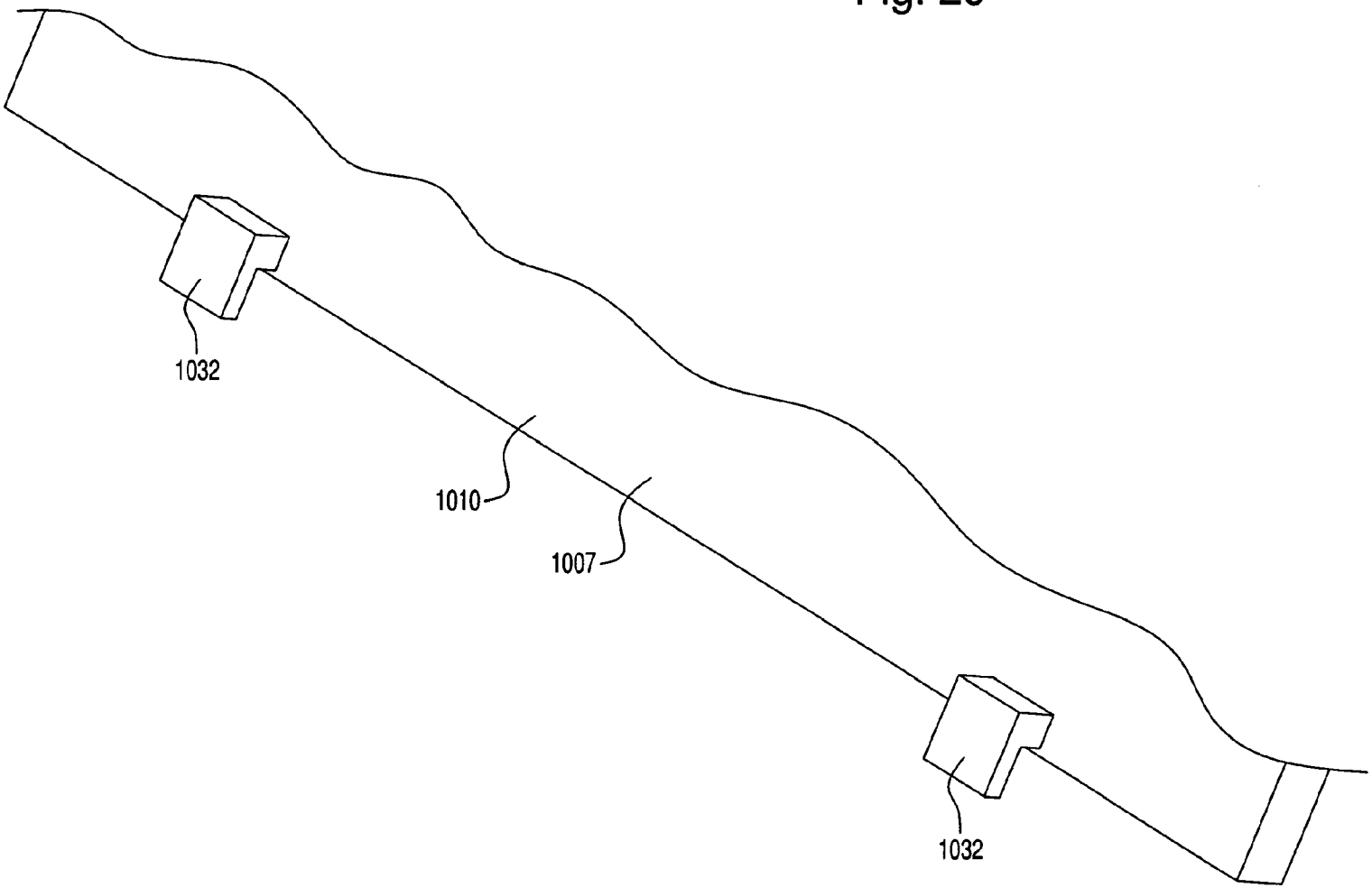
FIG. 29 is a close-up perspective view of a changing table mount of the changing table of FIG. 28, the view illustrating that the changing table mount includes projections that extend from a platform part.
Figure 31:
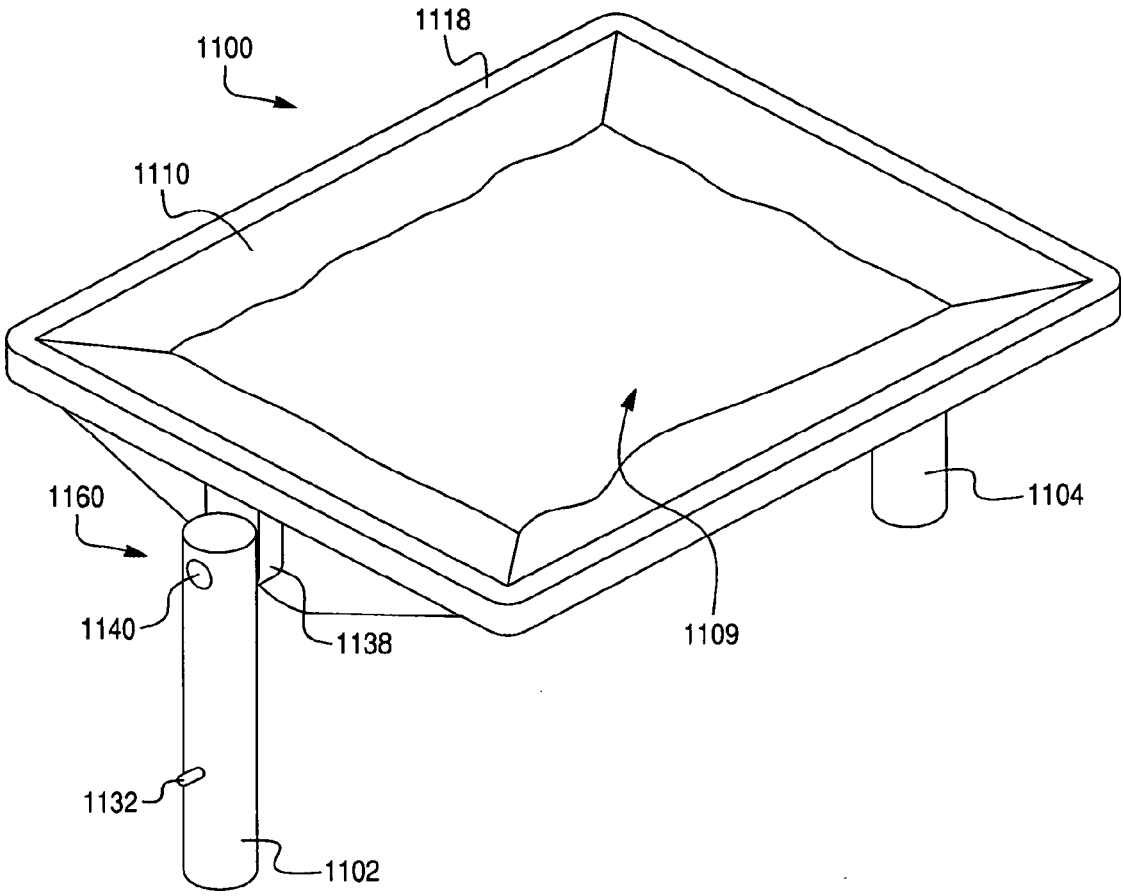
FIG. 31 is a perspective view of a tenth embodiment of a changing table that is configured to releasably engage a playard.
Figure 32:
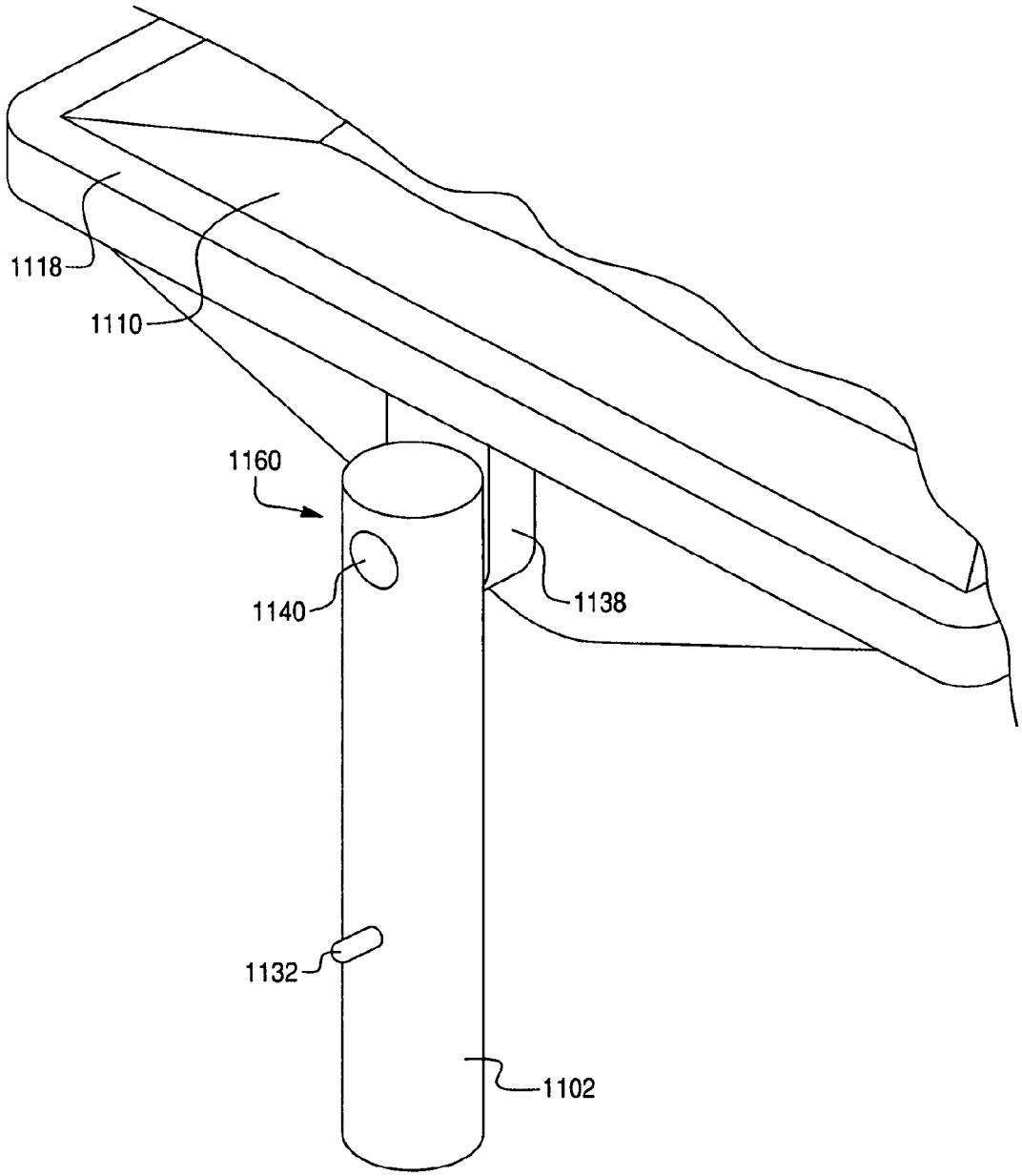
FIG. 32 is a close-up perspective view of a changing table mount of the changing table of FIG. 31, the view illustrating a leg and a corresponding pivot joint of the changing table mount.

As shown in FIG. 28, the platform parts 1007, 1009 are joined together by a hinge 1013. The hinge 1013 enables the platform 1010 to be moved between a folded, storage position (FIG. 28) and an open, planar, in-use position (FIG. 30A). A push-button hinge lock mechanism 1015 can be provided to lock the platform 1010 in the in-use position. The push-button hinge lock mechanism 1015 can be the same as the lock mechanism 212 shown in FIGS. 5A and 5B and, therefore, a duplicative discussion of the workings thereof will be omitted.

The platform parts 1007, 1009 can include one or more projections 1032 that serve as changing table mounts. The projections 1032, which can project from lower surfaces of the platform parts 1007, 1009, are sized to be received in corresponding slots 2730 formed in, or below, the side rails 2712, 2716 of a playard 2700, as shown in FIG. 30B. The platform parts 1007, 1009 also can include projections that project from their upper surfaces to snap over the side rails 2712, 2716 during engagement of the changing table 1000 to the playard 2700. To releasably engage the hinged changing table 1000 to a playard 2700, the platform parts 1007, 1009 are initially bent into the position shown in FIG. 28. Subsequently, the platform parts 1007, 1009 are opened such that the projections 1032, which extend therefrom, are aligned with corresponding slots 2730 formed in, or below, the side rails 2712, 2716 of the playard 2700. Finally, when the projections 1032 and slots 2730 are aligned, the platform parts 1007, 1009 are completely opened to the planar, in-use position shown in FIG. 30A.

When the platform 1010 is opened to the in-use position, the engagement of the projections 1032 and the slots 2730 inhibits a further downward rotation of the platform 1010. Moreover, to inhibit an inadvertent upward rotation of the platform 1010, the push-button hinge lock mechanism 1015 automatically locks the hinge 1013, thereby inhibiting movement of the platform parts 1007, 1009 relative to each other. To move the platform 1010 back into the folded position so that the changing table 1000 may be completely removed from the playard 2700, a caregiver can depress a lock actuator push-button of the push-button hinge lock mechanism 1015, enabling the platform parts 1007, 1009 to rotate upward and toward each other.

This releasable engagement of the changing table 1000 and the playard 2700 enables the changing table 1000 to be completely removed from the playard 2700, if desired. Moreover, as a result of the engagement of the projections 1032 and the slots 2730, and the locking function of the push-button hinge lock mechanism 1015, when the platform 1010 is in the in-use position shown in FIG. 30A, the changing table 1000 is configured to withstand an upward or outward force of 25 pounds or less applied to the platform 1010, without disengaging from the playard 2700. In this embodiment, the changing table 1000 can remain engaged with the playard 2700 when a force of 25 pounds or less is applied anywhere on the changing table 1000 other than the lock actuator push-button of the push-button hinge lock mechanism 1015. Accordingly, if a child, who is positioned in the playard 2700, inadvertently bumps or pushes the changing table 1000 upwardly or outwardly with a force of 25 pounds or less, the changing table 1000 will remain engaged to the playard 2700.

In an alternative embodiment, the width of the platform 1010, not including the projections 1032, may be slightly wider that the width of the playard 2700. As a result, to position the platform 1010 in the in-use position, a downward force could be applied to the platform 1010 that is sufficient to push the sides of the playard 2700 (either rails 2712, 2716 or sidewalls 2702, 2706, whichever includes the slots 2730) away from each other until the platform 1010 snaps into place in the playard 2700. Moreover, as a result of tension applied to the hinge 1013 by the sides of the playard 2700, an upward force sufficient to overcome this tension would be necessary to move the platform 1010 out of the in-use position. If the force necessary to move the platform 1010 out of the in-use position is greater than 25 pounds, the push-button hinge lock mechanism 1015 may be unnecessary.

In another alternative embodiment, the changing table 1000 can include a support structure that has two U-shaped frame element hinged together at their free ends. A flexible platform can be mounted to the interior of the support structure like a picture mounted to a picture frame. Projections can extend from the U-shaped frame elements to releasably engage the changing table to the playard 2700 in a manner similar to that described above.

FIGS. 31, 32, and 33A-33B illustrate a juvenile product including a playard 2800 and an elevated changing table 1100. Although only one side of the changing table 1100 and the playard 2800 may be shown in particular figures, it is to be understood that the other side of the changing table 1100 and the playard 2800 are the mirror image of the side that is shown. Accordingly, whereas various features of the changing table 1100 and the playard 2800 are shown and described, it is to be understood that mirror images of those features are provided on the opposite side of the changing table 1100 and the playard 2800.

The changing table 1100 includes a platform 1110, which is sized to support a child, and a support structure 1118 to which the platform 1110 is coupled. The support structure 1118 can be generally rectangular in shape, and the platform 1110 can be suspended from the support structure 1118 such that a concave child changing area 1109 is formed. The platform 1110 can be formed of a fabric material, such as vinyl or polyester, or other material (or combination of materials) that is strong enough to support a child's weight.

The changing table 1100 is releasably engaged to the playard 2800. Accordingly, a caregiver can remove the changing table 1100 from the playard 2800 when the caregiver wants to collapse the playard 2800 for storage or travel. In this regard, the changing table 1100 includes changing table mounts that can releasably engage the playard 2800. The changing table mounts of this embodiment can include depending posts 1138, 1139, pivot joints 1160, 1162, and legs 1102, 1104.

The depending posts 1138, 1139 project generally perpendicularly from the support structure 1118. Each of the depending posts 1138, 1139 is connected to a leg 1102, 1104 by means of a pivot joint 1160, 1162. At least one of the pivot joints 1160, 1162 is controlled by a push-button lock mechanism 1140. The push-button lock mechanism 1140 can be the same as the push-button lock mechanism 212 that was previously described with respect to FIGS. 5A-5B, except that the two block receiving spaces 266 of the first and second gear housings 270, 248 and the corresponding block teeth 264 of the gear 244 are oriented at 90° with respect to the fastener 242 rather than being diametrically opposed on opposite sides of the fastener 242. Each of the legs 1102, 1104 includes at least one release actuator, which may be a fastener such as a spring-actuated Valco® button 1132.

Although the legs 1102, 1104 are shown as being cylindrical (i.e., circular in cross-section), no particular shape is required and, therefore, other shapes (e.g., rectangular shaped cross-sections) may be employed. The legs 1102, 1104 can releasably engage corresponding housings 2820, 2822 of the playard 2800.

Each of the housings 2820, 2822 includes a socket into which the legs 1102, 1104 may be journalled. In addition, each of the housings 2820, 2822 also can include one or more holes, for example one lower hole 2830 and one upper hole 2832. The housings 2820, 2822 can include other intermediate holes to enable adjustment of the platform 1110 to various heights above the playard 2800. The holes 2830, 2832 are configured to receive the spring-actuated Valco® buttons 1132 of the legs 1102, 1104. As a result, the spring-actuated Valco® buttons 1132 may be compressed into the legs 1102, 1104 such that the legs 1102, 1104 may be received in the sockets of the housings 2820, 2822. When the legs 1102, 1104 are lowered such that the spring-actuated Valco® buttons 1132 align with one of the holes 2830, 2832 of the housings 2820, 2822, the spring-actuated Valco® buttons 1132 will spring through such holes 2830, 2832. Correspondingly, to remove the changing table 1100 from the playard 2800, a caregiver can depress inwardly the spring-actuated Valco® buttons 1132 and can then simultaneously pull the legs 1102, 1104 out of the housings 2820, 2822.

Figure 33A:
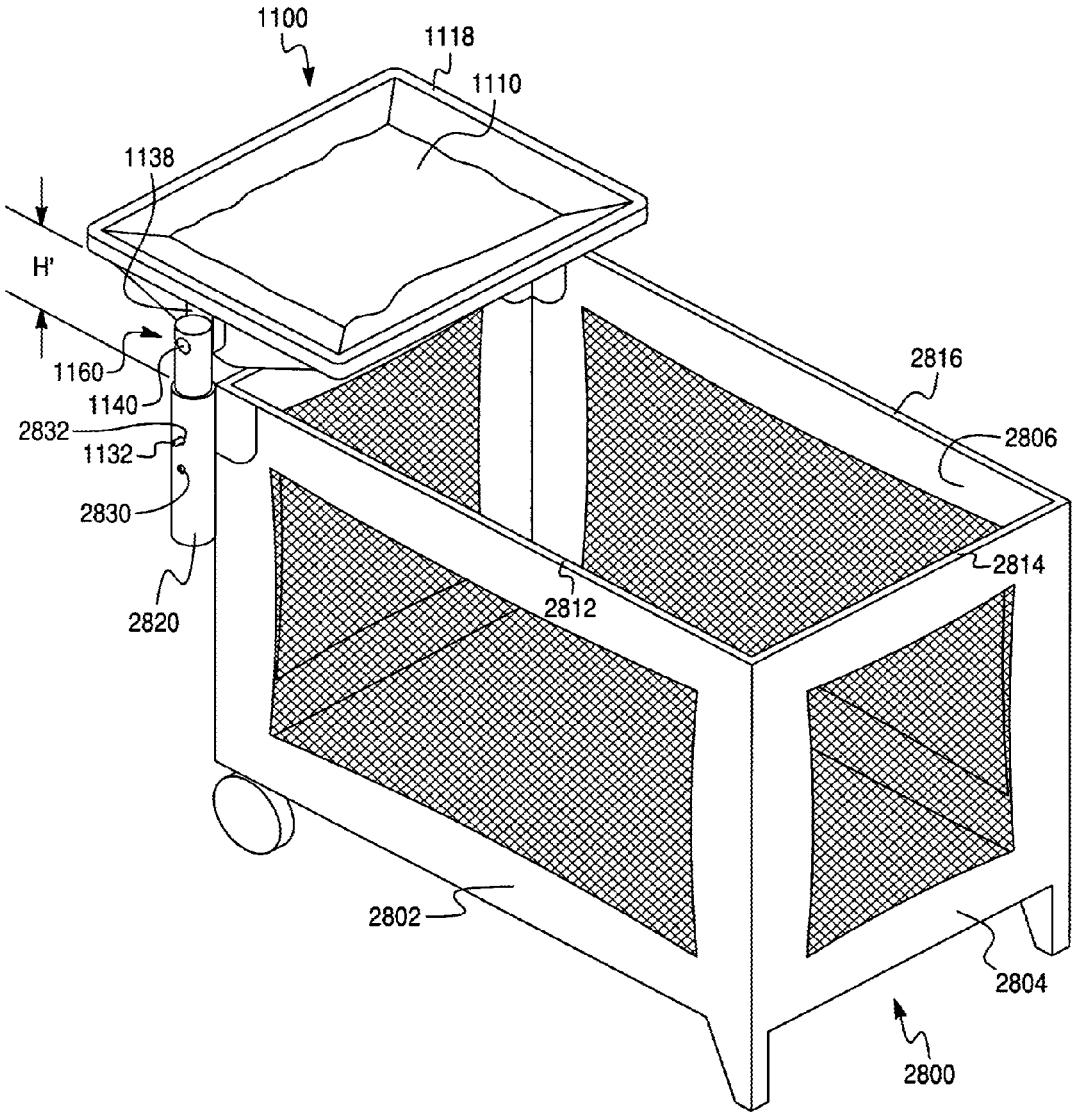
FIG. 33A is a perspective view of the changing table of FIG. 31 attached to a playard, the view illustrating the changing table in an in-use position.
Figure 33B:
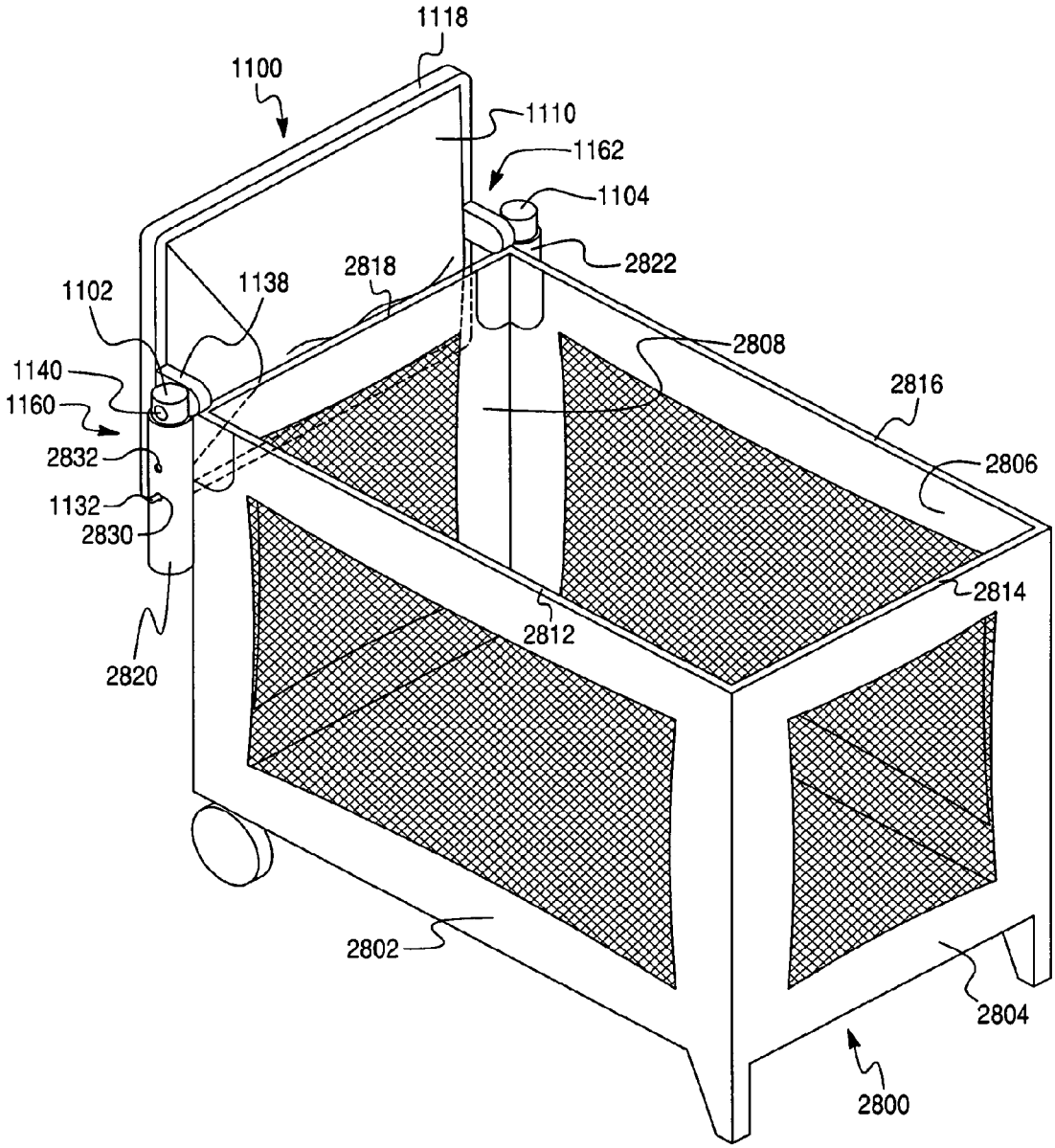
FIG. 33B is a perspective view of the changing table of FIG. 31 attached to the playard of FIG. 33A, the view illustrating the changing table in a storage position.

After the legs 1102, 1104 are received in the housings 2820, 2822, the platform 2810 may be positioned in either an in-use position (FIG. 33A) or in a storage position (FIG. 33B). To position the platform 2810 in the in-use position, the legs 1102, 1104 are positioned in the housings 2820, 2822 such that the spring-actuated Valco® buttons 1132 are aligned with, and spring through, the upper holes 2832. At this time, the push-button lock mechanisms 1140 may be depressed to enable the support structure 1118 to rotate toward the in-use position shown in FIG. 33A. When the support structure 1118 reaches the in-use position, the gears 244 of the push-button lock mechanisms 1140 will spring into the first gear housings 270, thereby immobilizing the posts 1138, 1139 (which contain the second gear housings 248) with respect to the legs 1102, 1104 (which contain the first gear housings 270).

To move the platform 1110 into the storage position of FIG. 33B, the push-button lock mechanisms 1140 can be depressed and the support structure 1118 can be rotated to a generally vertical position. When the support structure 1118 reaches the generally vertical position, the gears 244 will spring into the first gear housings 270, thereby immobilizing the posts 1138, 1139 with respect to the legs 1102, 1104. The changing table 200 can remain in this position or can be lowered into the storage position shown in FIG. 33B by depressing the spring-actuated Valco® buttons 1132 into the legs 1102, 1104 and lowering the legs 1102, 1104 until the spring-actuated Valco® buttons 1132 are aligned with, and spring into, the lower holes 2830 in the housings 2820, 2822.

Moreover, when the spring-actuated Valco® buttons 1132 engage the lower holes 2830, the posts 1138, 1139 can abut the upper rail 2818 of the playard 2800. As a result of the abutment between the upper rail 2818 and the posts 1138, 1139, the posts are further prevented from rotating. Accordingly, even if both of the push-button lock mechanisms 1140 were inadvertently depressed, the abutment of the upper rail 2818 and the posts 1138, 1139 would inhibit the support structure 1118 of the changing table 1100 from rotating toward a position parallel to the in-use position shown in FIG. 33A.

As a result of the engagement of the spring-actuated Valco® buttons 1132 in holes 2830, 2832, the changing table 1100 is able to withstand an upward or outward force of 25 pounds or less applied to the platform 1110, without disengaging from the playard 2800. In this embodiment, the changing table 1100 can remain engaged with the playard 2800 when a force of 25 pounds or less is applied anywhere on the changing table 1100 other than the spring-actuated Valco® buttons 1132 of the changing table mount. Accordingly, if a child, who is positioned in the playard 2800, inadvertently bumps or pushes the changing table 1100 upwardly or outwardly with a force of 25 pounds or less, the changing table 1100 will remain engaged to the playard 2800.

According to another aspect of this embodiment, which provides a changing table 1100 elevated above the top rails of the playard 2800, openings can be defined at least in part by a portion of the changing table 2800 and a nearest one of the top rails 2812, 2816, 2818. For those openings in which a curious child conceivably could place his head, a portion of the opening in a direction normal to the nearest side rail can have a height of at least 9 inches so that the child can readily withdraw his head from the opening. For example, an opening can be defined between support structure 1118 of the changing table 1100 and the side rail 2812, and a portion of that opening in a direction normal to top rail 2812 can have a height H" of at least 9 inches. Thus, should a curious child decide to place his head in such an opening between the changing table 1100 and a nearest top rail 2812, 2816, 2818, the child will be able to freely pass his head back-and-forth through that opening.

Figure 34:
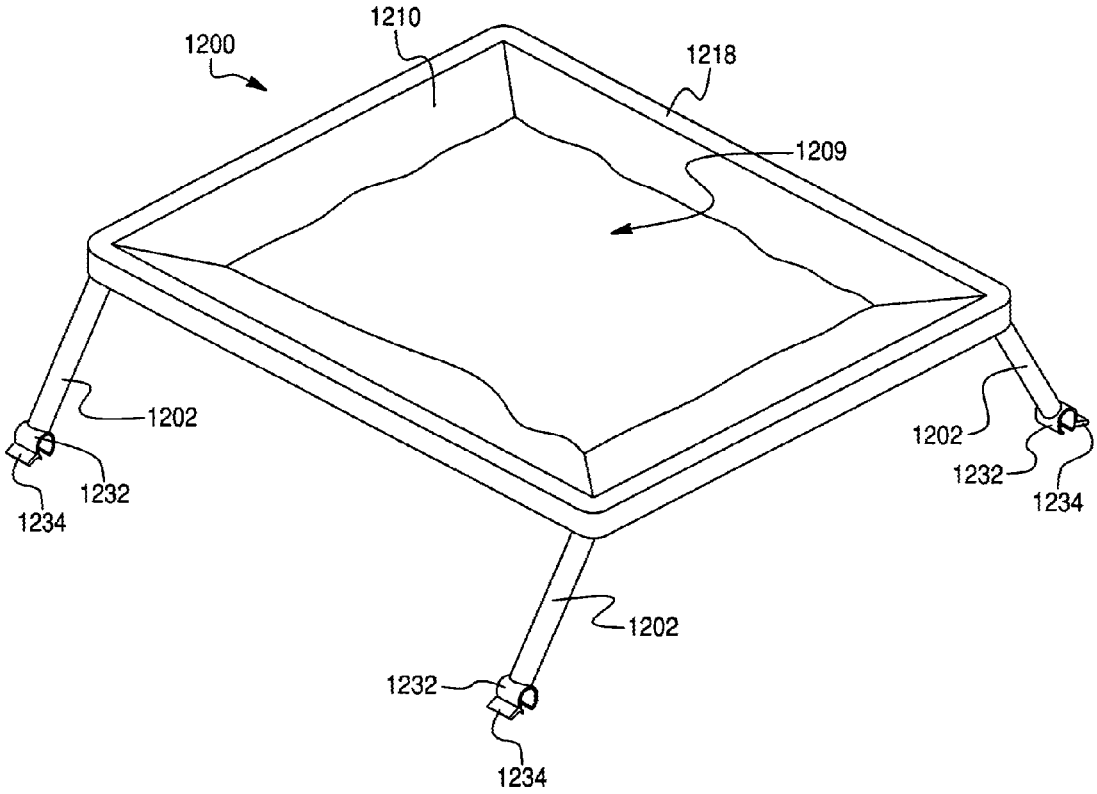
FIG. 34 is a perspective view of an eleventh embodiment of a changing table that is configured to releasably engage a playard.
Figure 35:
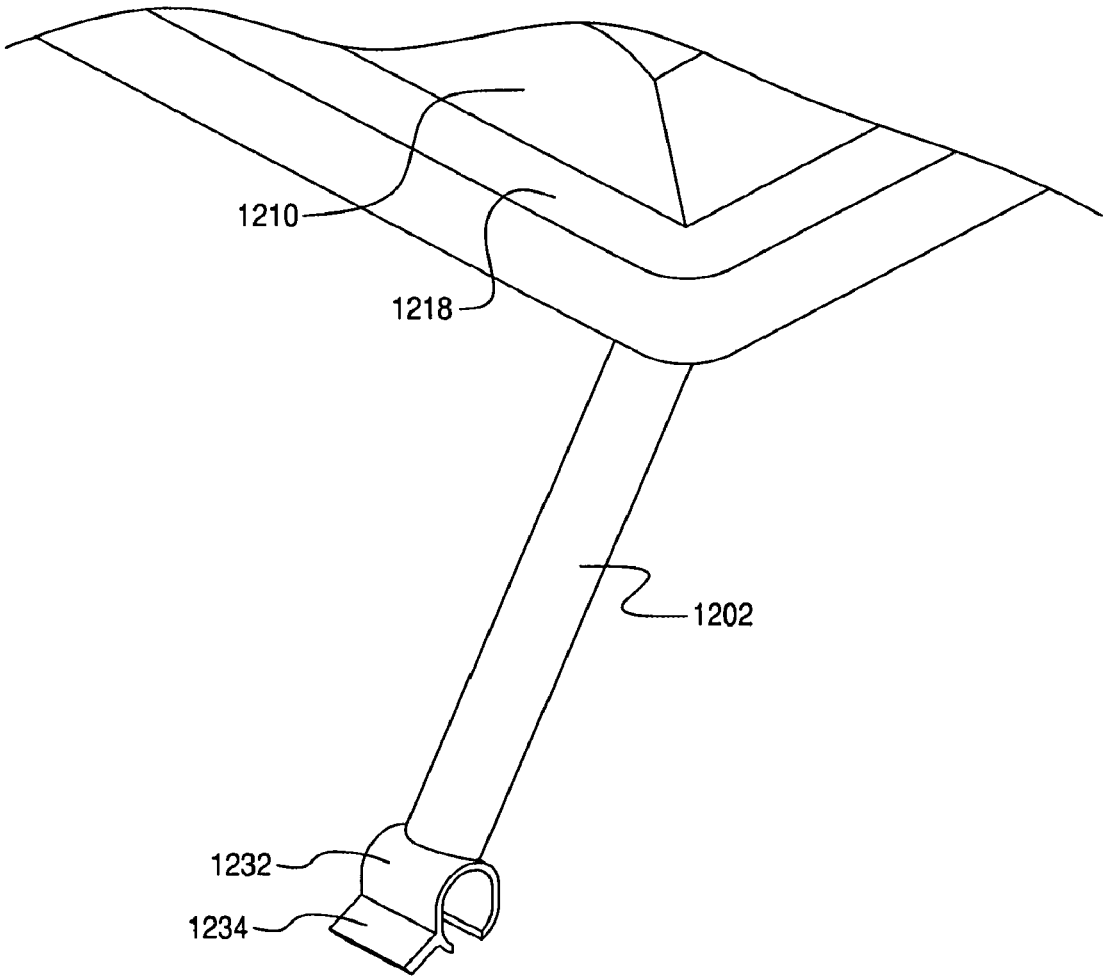
FIG. 35 is a close-up perspective view of a changing table mount of the changing table of FIG. 34, the view illustrating a leg of the changing table mount.
Figure 36:
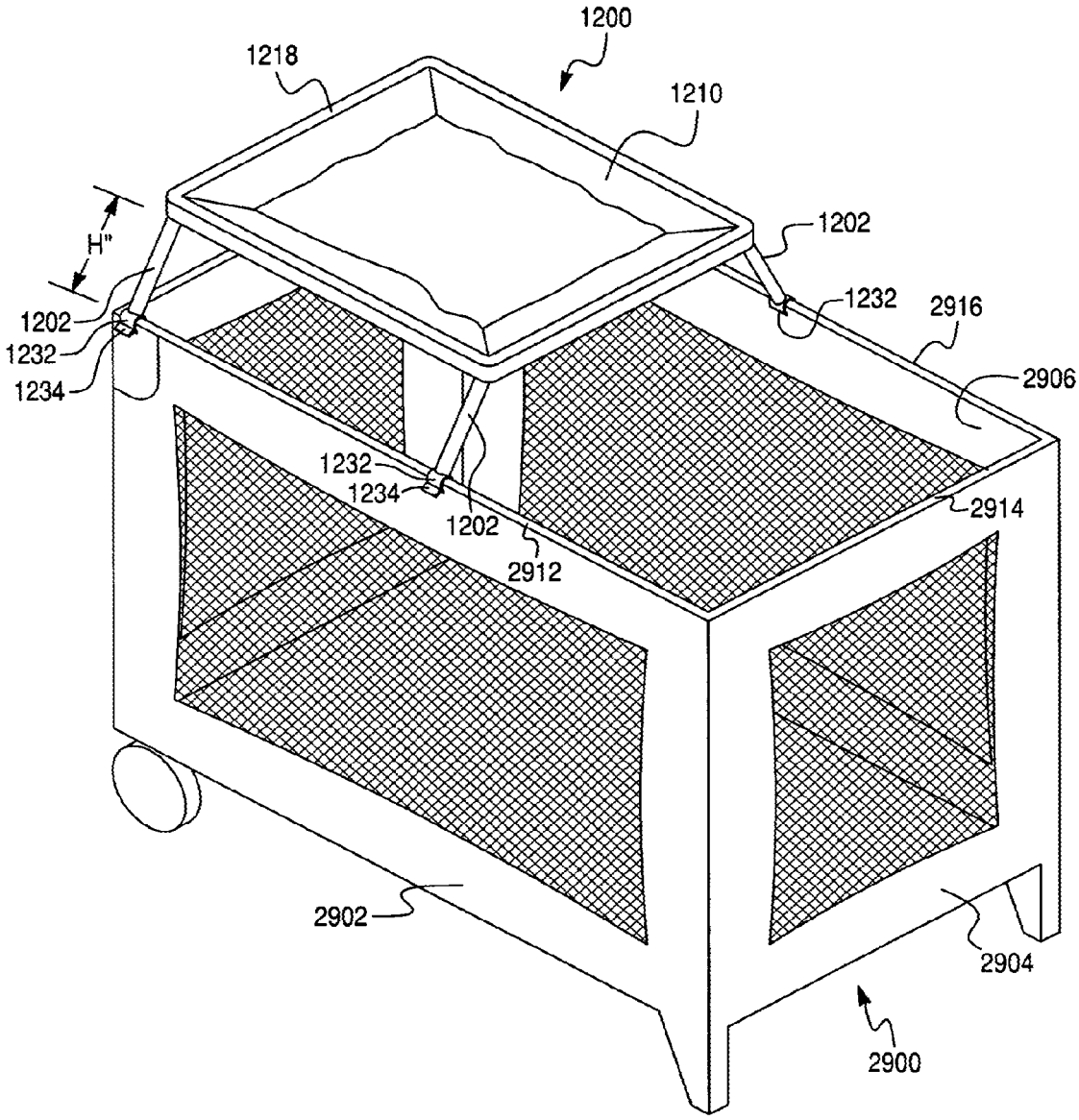
FIG. 36 is a perspective view of the changing table of FIG. 34 attached to a playard.

FIGS. 34-36 illustrate another juvenile product including a playard 2900 and an elevated changing table 1200 configured to be releasably engaged to the playard 2900. Although only one side of the changing table 1200 and the playard 2900 may be shown in particular figures, it is to be understood that the other side of the changing table 1200 and the playard 2900 are the mirror image of the side that is shown. Accordingly, whereas various features of the changing table 1200 and the playard 2900 are shown and described, it is to be understood that mirror images of those features are provided on the opposite side of the changing table 1200 and the playard 2900.

As shown in FIG. 34, the changing table 1200 includes a platform 1210 and a support structure 1218 to which the platform 1210 is coupled. The support structure 1218 can be generally rectangular in shape, and the platform 1210 can be suspended from the support structure 1218 such that a concave child changing area 1209 is formed. The platform 1210 can be formed of a fabric material, such as vinyl or polyester, or other material (or combination of materials) that is strong enough to support a child's weight.

The changing table 1200 is releasably engaged to the playard 2900. Accordingly, a caregiver can remove the changing table 1200 from the playard 2900 when the caregiver wants to collapse the playard 2900 for storage or travel. In this regard, the changing table 1200 includes changing table mounts that can releasably engage the playard 2900. The changing table mounts of this embodiment can include legs 1202. Each of the legs 1202 includes a c-clip 1232 that extends from the lower ends of the associated leg 1202. The c-clips 1232 are configured to clamp onto side rails 2912, 2916 of a playard 2900, as shown in FIG. 36. Each of the c-clips 1232 can include a release actuator in the form of a tab 1234.

To releasably engage the changing table 1200 with the playard 2900, a caregiver can position the changing table 1200 such that the c-clips 1232 of the legs 1202 are aligned with respective side rails 2912, 2916 of the playard 2900. Subsequently, the caregiver can push downwardly the changing table 1200 such that the c-clips 1232 clamp onto the side rails 2912, 2916. If desired, this changing table 1200 can include reinforcing male (or female) snap members that can engage corresponding female (or male) snap members on the playard 2900, thereby further securing the changing table 1200 to the playard 2900.

If the caregiver wishes to remove the changing table 1200, the caregiver can lift upward (or outward) on tabs 1234 of the c-clips 1232 to disengage the c-clips 1232 from the side rails 2912, 2916. This releasable engagement of the changing table 1200 and the playard 2900 enables the changing table 1200 to be completely removed from the playard 2900, if desired.

As a result of the engagement of the c-clips 1232 and the rails 2912, 2916, the changing table 1200 is configured to withstand an upward or outward force of 25 pounds or less applied to the platform 1210, without disengaging from the playard 2900. In this embodiment, the changing table 1200 can remain engaged with the playard 2900 when a force of 25 pounds or less is applied anywhere on the changing table 1200 other than the release actuator tabs 1234 of the c-clips 1232 of the changing table mount. Accordingly, if a child, who is positioned in the playard 2900, inadvertently bumps or pushes the changing table 1200 upwardly or outwardly with a force of 25 pounds or less, the changing table 1200 will remain engaged to the playard 2900.

According to another aspect of this embodiment, which provides a changing table 1200 elevated above the top rails of the playard 2900, openings can be defined at least in part by a portion of the changing table and a nearest one of the top rails 2912, 2916, 2918. For those openings in which a curious child conceivably could place his head, a portion of the opening in a direction normal to the nearest side rail can have a height of at least 9 inches so that the child can readily withdraw his head from the opening. For example, an opening can be defined between support structure 1218 of the changing table 1200 and the side rail 2912, and a portion of that opening in a direction normal to top rail 2912 can have a height H" of at least 9 inches. Thus, should a curious child decide to place his head in such an opening between the changing table 1200 and a nearest top rail 2912, 2916, 2918, the child will be able to freely pass his head back-and-forth through that opening.

Figure 37A:
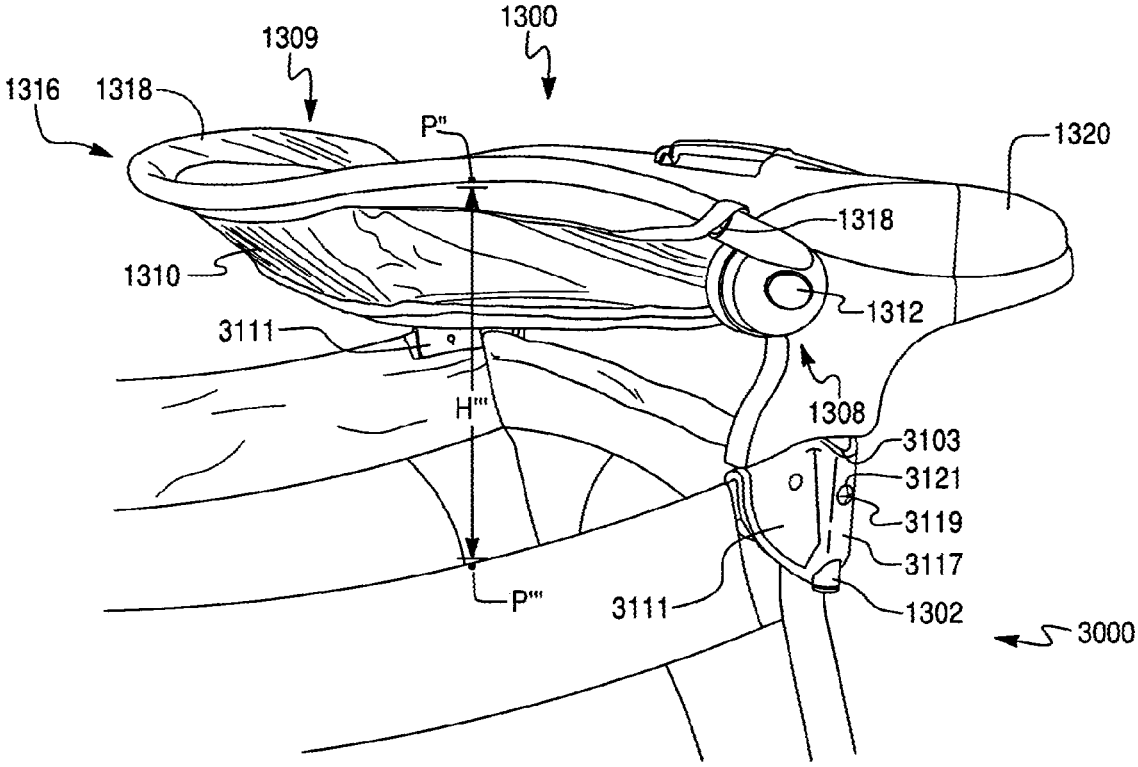
FIG. 37A is a close-up perspective view of a twelfth changing table embodiment fixedly attached to a playard, the view illustrating the changing table in an in-use position.
Figure 37B:
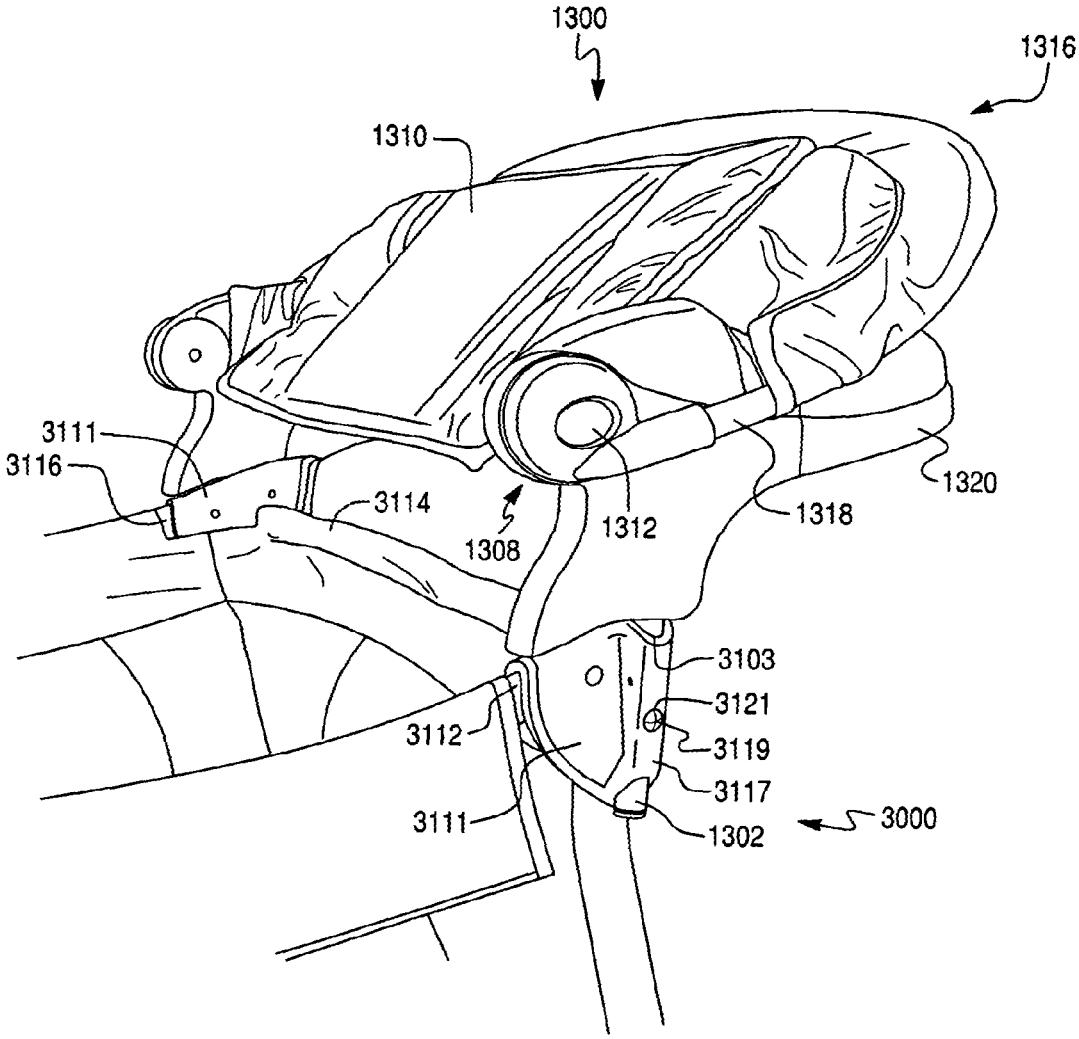
FIG. 37B is a close-up perspective view of the changing table of FIG. 37A attached to the playard in a storage position.

FIGS. 37A-37B illustrate another changing table 1300 that is fixedly engaged to a playard 3000. Although only one side of the changing table 1300 and the playard 3000 may be shown in particular figures, it is to be understood that the other side of the changing table 1300 and the playard 3000 are the mirror image of the side that is shown. Accordingly, whereas various features of the changing table 1300 and the playard 3000 are shown and described, it is to be understood that mirror images of those features are provided on the opposite side of the changing table 1300 and the playard 3000.

The changing table 1300 can include a platform 1310 sized to support a child and a support structure 1316 to which the platform 1310 is coupled. The support structure 1316 in this embodiment includes a generally U-shaped bar 1318 (shown best in FIG. 37B), a diaper organizer 1320, and pivot joints 1308 that connect the U-shaped bar 1318 and the diaper organizer 1320.

The U-shaped bar 1318, which may be at least partially covered by softgoods (as shown), and the diaper organizer 1320 of the support structure 1316 support the platform 1310. The platform 1310 may be suspended from the U-shaped bar 1318 and the diaper organizer 1320 such that a child changing area 1309 is formed. The child changing area 1309 can be concave to facilitate maintaining a child on the platform 1310 when, for example, a caregiver is changing the child's diaper.

The platform 1310 can be formed of a fabric material, such as vinyl or polyester, or other material (or combination of materials) that is strong enough to support a child's weight. Moreover, the platform 1310 can be formed of the same material that serves as the softgoods that encircle the U-shaped bar 1318.

The platform 1310 can be pivotally movable relative to the playard 3000 between an in-use position (FIG. 37A) and a storage position (FIG. 37B). Pivot joints 1308 enable this movement. Each pivot joint 1308 joins an end of the U-shaped bar 1318 to the diaper organizer 1320. Each pivot joint 1308 includes a push-button lock mechanism 1312 that enables the U-shaped bar 1318, and the platform 1310 supported by the U-shaped bar 1318, to move between the in-use position (FIG. 37A) and the storage position (FIG. 37B). The push-button lock mechanisms 1312 may be the same as the push-button lock mechanism 212 previously discussed with respect to FIGS. 5A-5B and, therefore, a duplicative discussion thereof will be omitted.

The changing table 1300 is fixedly engaged to the playard 3000. In this regard, the changing table 1300 includes changing table mounts that fixedly engage the playard 3000. The changing table mounts of this embodiment can include first and second legs 1302 that are coupled to the diaper organizer 1320. Although only one leg 1302 is shown, it is to be understood that the other leg 1302 is provided on the other side of the changing table 1300.

The legs 1302 are fixedly engaged in first and second housings 3117 of the playard 3000, respectively. In this embodiment, the housings 3117, one of which is shown in FIGS. 37A-37B, are mounted to adjacent corner brackets 3111 of the playard frame at an end of the playard 3000. The housings 3117 each include a socket 3103 into which the legs 1302 slide. Rivets 3119, which may be, e.g., bolts, pins, screws, etc., are then journaled through holes 3121 in the housings 3117 and through corresponding holes (not shown) in the legs 1302, thereby fixedly engaging the changing table 1300 to the housings 3117 of the playard 3000.

Although the legs 1302 are shown as being generally tubular in shape, the shape of the legs 1302 (and the corresponding shape of the sockets 3103) is not limiting, and other shapes (e.g., legs and sockets having rectangular cross-sections) are fully within the scope of the invention.

According to another aspect of this embodiment, an opening can be defined at least in part by the changing table support structure 1316 and a nearest one of the top rails 3112, 3114, 3116. For example, the opening can be defined by the U-shaped bar 1318, the diaper organizer 1320, and the side rail 3112 of the playard. A portion of the opening in a direction normal to the side rail 3112 is at least 9 inches. For example, with respect to FIG. 37A, at least one point P" on the U-shaped bar 1318 is a separated from a nearest point P'" on the nearest top rail, here, a side rail 3112, of the playard 3100 by a height H'". The distance of the height H'" is least 9 inches. As a result of this spacing between the U-shaped bar 1318 and the side rail 3112, if a curious child in the playard 3000 places his head into the opening between the changing table 1300 and the playard top rail 3112, the child can readily withdraw his head from the opening.

Although the above embodiments illustrate changing table platforms that do not include a child restraint harness or strap to secure a child to the platform, it will be understood that alternative embodiments can include such a child restraint harness or strap.

As a result of the foregoing changing table embodiments, a changing table may be engaged to a playard in such a manner that an upward or outward force of less than or equal 25 pounds may be applied to the changing table, without causing the changing table to disengage from the playard. Moreover, and in addition, a changing table may be positioned a sufficient distance above the top rails of the playard such that an adult, when changing a diaper, is not forced into an uncomfortable stooped position. Specifically, the changing table may be elevated to a height that is between about 34 inches and about 40 inches above a surface on which the playard rests. The elevated changing table can be designed such that, where an opening is present between the changing table and a nearest of the playard top rails, and a child conceivably could place his head in the opening, the opening is sized to allow ready passage of the child's head back-and-forth through the opening. For example, a portion of the opening in a direction normal to the nearest top rail can be at least 9 inches. Finally, and in addition, the platform of the changing table may be moved relative to the playard between an in-use position and a storage position that is outside of, or along an exterior side of, the playard.

Various embodiments of the invention have been set forth herein for the purpose of illustration. However, various modifications, adaptations, and alternatives may occur to one skilled in the art without departing from the inventive concept.

For example, whereas the rotatable changing table 600 was described as being locked in the in-use position by means of spring-loaded fasteners 620, 622, other fasteners could be employed. By way of a specific example, the spring-loaded fasteners 620, 622 could be replaced by latches having spring-loaded locking fingers that lock around the top rails of the playard to maintain the changing table in an in-use position. To release the changing table from the top rails, a release handle may be provided to disengage the spring-loaded locking fingers.

Another alternative embodiment may include a pivotable changing table that is connected releasably to the playard. In such a changing table embodiment, the platform of the changing table may move from an in-use position adjacent the rail of the playard to a storage position along a sidewall of the playard. Moreover, the platform may move between the in-use and storage positions by collapsing a support linkage such as a 4-link support system that is connected to the corner brackets and/or the corner posts of the playard. The platform of this alternative embodiment also may be disposed entirely outside the playard in its in-use position with the 4-link support system being connected to exterior surfaces of the corner brackets and corner posts.

Another alternative embodiment may include a changing table that has a pivotal connection, such as a hinged connection, between an edge of a changing table and an end rail of the playard. The pivotal connection may be coupled to the corner brackets at either end of the end rail. The changing table may be locked in the in-use position with respect to the end rail by a lock mechanism. The lock mechanism may include a push-button lock actuator positioned at an end of the pivotal connection. The platform of the changing table may pivot between a storage position along an outer side of the playard and an in-use position over the playard.

Another alternative embodiment may include a changing table that has spring-loaded dovetail clips that project from edges of the changing table. The dovetail clips could, for example, be sized to flex around correspondingly sized retainers formed on the playard. As a result, when the dovetail clips pass around the retainers, the clips would then elastically snap under the retainers, thereby releasably securing the changing table to the playard.

Another alternative embodiment may include a changing table that has hooks that project from edges of the changing table. The hooks could, for example, be sized to flex around correspondingly sized retainers formed on the playard such that the hooks bend when passing around the retainers and then snap back elastically under the retainers. The retainers can be provided by an undercut geometry built into the corner brackets or into top rail release latches.

Another alternative embodiment may include an elevated changing table that has plastic or cloth flaps that extend between the changing table support structure and the top rails of the playard. More specifically, the changing table could include three flaps that extend between the changing table support structure and three of the top rails of the playard, respectively.

Another alternative embodiment may include, for example, a changing table that has a pair of sidewalls configured to rest alongside opposite walls of the playard. Each sidewall of the changing table may include a component that has spikes and a spike adapter to receive the spikes. The spikes can pass through the sides of the playard and connect to the spike adapter, thereby releasably locking the changing table to the playard.

Another alternative embodiment may include a changing table that has through-holes provided in support structure sidewalls of the changing table. The through-holes could, for example, be sized to receive spring-loaded buttons provided on the top rails of the playard. When the changing table is lowered onto the top rails of the playard, the inside surfaces of the support structure sidewalls will be positioned alongside the outer surfaces of the top rails of the playard, and the spring-loaded buttons will snap into the through-holes. A caregiver can press the spring-loaded buttons inward to disengage the changing table from the playard.

Another alternative embodiment may include a changing table that has spring-loaded latches. The latches may be configured to clamp automatically onto the top rails of the playard when the latches are pushed downwardly onto the top rails. Release handles may be provided on the changing table to disengage the latches.

Another alternative embodiment may include a changing table that has dovetail mortises or dovetail tenons that are configured to engage corresponding dovetail tenons or mortises formed on the playard. The dovetail mortises or dovetail tenons provided on the changing table could be in the form of rails that are configured to be slidingly received in, or on, correspondingly shaped dovetail tenons or mortise tracks formed on the playard.

Figure 38:
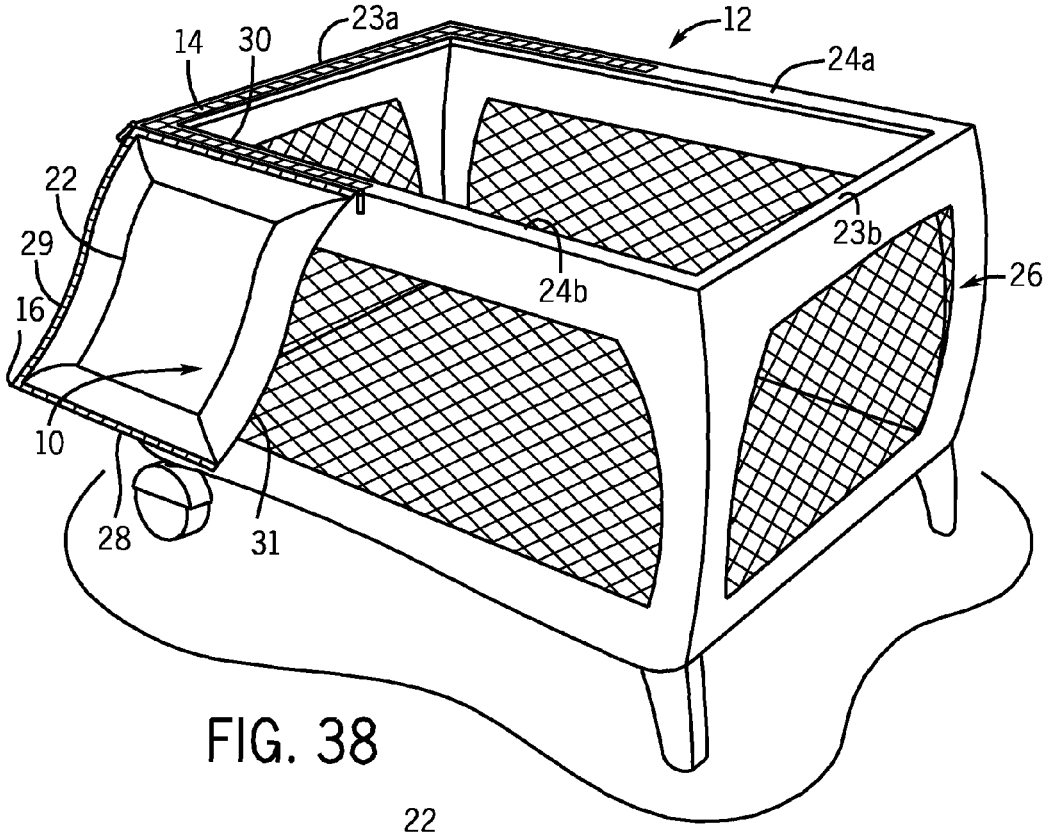
FIG. 38 is a perspective view of a changing table that is configured to releasably engage a playard by a zipper mount and is shown in a storage configuration.
Figure 39:
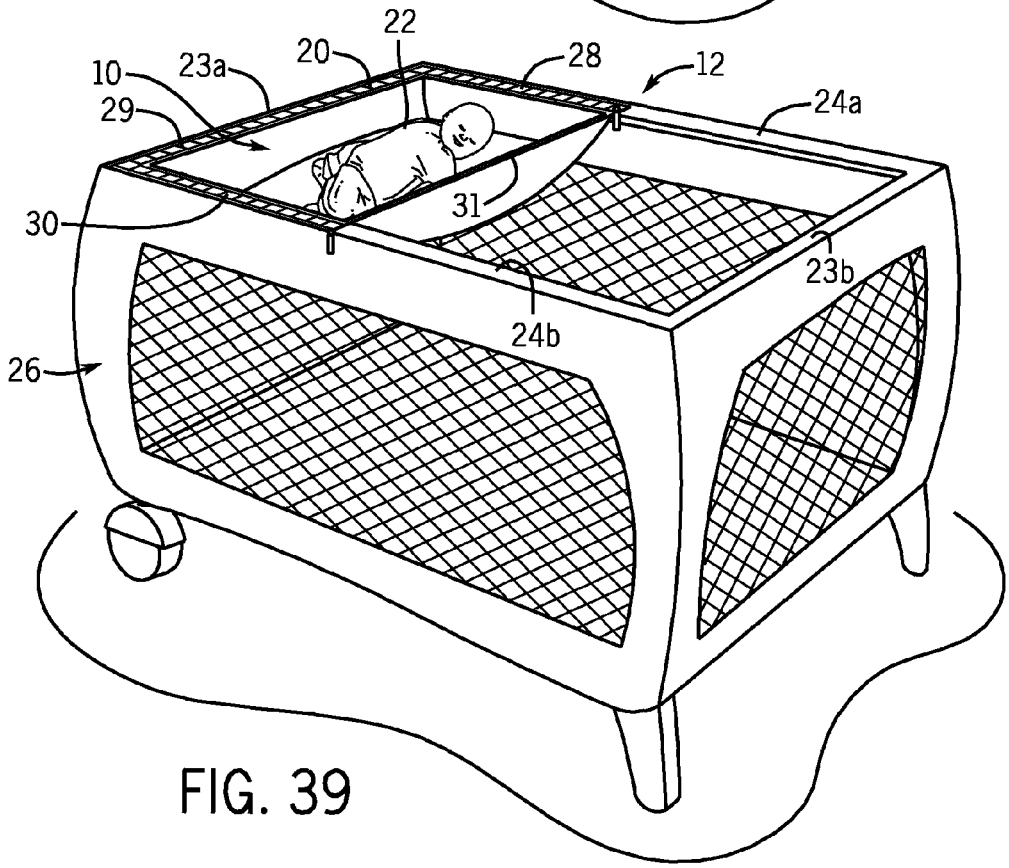
FIG. 39 is a perspective view of the changing table of FIG. 38 in an in-use configuration.

As shown in FIGS. 38 and 39, another alternative embodiment may include a changing table 10 that has one half of a zipper 14 along a portion of its perimeter. The corresponding half of the zipper 16 may be provided on the playard 12. As a result, the changing table 10 may be zipped onto and unzipped from the playard 12. In the example of FIG. 38, the changing table 10 is shown in a storage configuration with two sides unzipped from the playard 12. In the example of FIG. 39, the changing table 10 is shown in an in-use configuration with the corresponding zipper parts 14, 16 engaged to one another to form a closed zipper 20 on three sides of the playard 12.

The changing table 10 includes a flexible platform 22 sized to support a child and coupled to the playard 12. The platform 22 can be suspended such that a concave child changing area is formed. In the example of FIG. 38, the playard 12 has a frame including a plurality of top rails including two end rails 23*a*, 23*b* and two side rails 24*a*, 24*b* and has a fabric frame cover 26 functioning as a floor and walls of the playard. Three sides 28, 29, 30 of the changing table platform 22 are supported by the zipper 20. A fourth side 31 of the changing table 10 can be supported by a beam (not shown) that may be inserted in a pocket on the changing table 10 that spans at least two of the top rails 28*a*, 28*b*. The platform 22 can be formed of a fabric material, such as vinyl or polyester, or other material (or combination of materials) that is strong enough to support a child's weight.

Another alternative embodiment may include a changing table that has Velcro® straps that extend from edges of the changing table. Ends of the Velcro® straps could, for example, be inserted through slots formed in, or on, the walls of the playard. More specifically, the straps could be inserted into slots that are formed in walls of the playard below the rails thereof. The straps could then be wrapped around the rails and fastened to corresponding Velcro® material provided elsewhere on the straps, on the playard, or the changing table.

Another embodiment may include a changing table that has male or female buckle members that can engage corresponding buckle members provided on the playard.

Another alternative embodiment may include a changing table that has a retractable platform provided within a spring-loaded roll in the manner of a window shade. The spring-loaded roll may be configured to engage a top rail of the playard. The platform may be withdrawn from a storage position in the roll to an in-use position at which the platform may be fastened by any of the previously mentioned fastening devices (e.g., hooks, Velcro® straps, spring-loaded buttons, etc.) to the playard. To return the platform to the storage position, the fastening devices would be released and a quick burst of tension would be applied to the platform, thereby releasing a spring catch mechanism in the roll and, in turn, causing the spring action of the roll to retract the platform.

In light of the foregoing, this description should not be deemed to be a limitation on the scope of the invention. Accordingly, the true scope and spirit of the invention are indicated by the following claims.

What is claimed is:

1. A changing table for use with a playard comprising:

a flexible platform that is sized to support a child;

a plurality of panels joined to edges of the platform at a plurality of joints; and a changing table mount arranged to releasably engage the platform to the playard including a plurality of straps located at edges of the panels, each strap having a fastener, and a plurality of c-clips located on an underside of the platform at the joints, wherein the platform is adapted to be suspended by the changing table mount above a floor area of the playard, and wherein each strap is adapted to be removably received in corresponding slots of the playard and the plurality of c-clips are adapted to releasably engage side rails and an end rail of the playard.

2. The changing table according to claim 1, further comprising a support structure, wherein the platform is coupled to the support structure, and wherein the changing table mount is coupled to or part of the support structure.

3. The changing table according to claim 2, wherein the support structure further comprises a beam adapted to extend between the side rails of the playard spanning an open top of the playard, and wherein the beam is received within a pocket of the platform.

4. The changing table according to claim 1, wherein the corresponding slots are formed in, or on, corresponding sidewalls and an endwall of the playard.

5. The changing table according to claim 1, wherein the straps each fasten to themselves with the fastener.

6. The changing table according to claim 5, wherein each fastener includes at least one of a male snap fastener and a female snap fastener, and wherein the straps are folded onto themselves such that the female snap members of the straps align with the corresponding male snap members.

7. The changing table according to claim 1, wherein the platform is formed of a fabric material, such as vinyl or polyester, or other material or combination of materials that is strong enough to support a child's weight, and wherein the platform forms a concave child changing area.

8. A playard and changing table combination comprising:

a playard having an enclosure with a floor area;

a changing table with a flexible platform sized to support a child and a plurality of panels joined to the platform at a plurality of seams; and a changing table mount that suspends the platform above the floor area of the playard thereby forming a child changing area and to releasably engage the platform to the playard, the changing table mount including a plurality of straps attached to edges of the plurality of panels and a plurality of c-clips positioned on an underside of the changing table at the seams, wherein each strap has a fastener and is removably received in a corresponding slot of the playard and each c-clip releasably engages top rails of the playard.

9. A juvenile product comprising:

a playard having a fabric body forming walls and a floor; and a changing table with a flexible platform that is sized to support a child and having at least one panel coupled to the platform at a joint, the changing table including at least one changing table mount adapted to suspend the platform above the floor of the playard and to releasably engage the platform to the playard, wherein, the at least one changing table mount includes at least one c-clip on an underside of the changing table at the joint and at least one strap at a free edge of the panel, the strap having at least one fastener adapted to removably connect the strap to the playard, and wherein the strap is removably received in a corresponding slot of the playard.

10. The juvenile product according to claim 9, wherein the changing table mount comprises a plurality of straps which engage corresponding slots on the playard and wherein the straps fasten to themselves with the fastener.

11. The juvenile product according to claim 9, wherein the fastener comprises a male snap fastener and a female snap fastener.

12. The juvenile product according to claim 9, wherein the c-clip is configured to engage a top rail of the playard.

* * * * *